US007455195B2

(12) United States Patent
Mekata

(10) Patent No.: US 7,455,195 B2
(45) Date of Patent: Nov. 25, 2008

(54) CONTAINER FOR DISCHARGING PLURAL CONTENTS, A DISPENSER USING THE CONTAINER, AND A PROCESS FOR PRODUCING THE DISPENSER

(75) Inventor: Satoshi Mekata, Ibaraki (JP)

(73) Assignee: Daizo Co., Ltd., Osaka (JP)

( * ) Notice: Subject to any disclaimer, the term of this patent is extended or adjusted under 35 U.S.C. 154(b) by 475 days.

(21) Appl. No.: 10/518,696

(22) PCT Filed: Jun. 26, 2003

(86) PCT No.: PCT/JP03/08074

§ 371 (c)(1),
(2), (4) Date: Jul. 21, 2005

(87) PCT Pub. No.: WO03/091128

PCT Pub. Date: Nov. 6, 2003

(65) Prior Publication Data

US 2006/0054634 A1 Mar. 16, 2006

(30) Foreign Application Priority Data

| | | |
|---|---|---|
| Jun. 26, 2002 | (JP) | 2002-186671 |
| Sep. 13, 2002 | (JP) | 2002-307654 |
| Feb. 21, 2003 | (JP) | 2003-45109 |
| Apr. 9, 2003 | (JP) | 2003-105918 |

(51) Int. Cl.

| | |
|---|---|
| ***B65D 83/00*** | (2006.01) |
| ***B65D 83/14*** | (2006.01) |
| ***B65D 83/60*** | (2006.01) |
| ***B65D 83/62*** | (2006.01) |
| ***B65D 83/66*** | (2006.01) |
| ***B65D 83/68*** | (2006.01) |

(52) U.S. Cl. ..... 222/94; 222/95; 222/105; 222/136

(58) Field of Classification Search ..... 222/136, 222/94–95, 105, 386.5, 402.13, 135
See application file for complete search history.

(56) References Cited

U.S. PATENT DOCUMENTS 2,518,145 A * 8/1950 Jenson ..... 222/386.5

(Continued)

FOREIGN PATENT DOCUMENTS

JP 29-017360 Y 12/1954

(Continued)

OTHER PUBLICATIONS

International Search Report for PCT/JP03/08074 mailed on Aug. 5, 2003.

*Primary Examiner*—Kevin P. Shaver
*Assistant Examiner*—Andrew P Bainbridge
(74) *Attorney, Agent, or Firm*—Cheng Law Group PLLC

(57) ABSTRACT

An aerosol container 190*a* provided with an outer container 11, a collapsible inner bag 12 inserted in the outer container, and a valve 13. The inner bag 12 comprises an upper and lower chamber 27, 26 and the chambers are divided at a constriction part formed in the middle of the inner bag by a partitioning member 72. The valve 13 has communicating holes that communicates valve 13 with the upper chamber 27 and the lower chamber 26 through a dip tube 28. An inner bag type aerosol product may be obtained by charging different kind of contents A and B into the container. Two-liquid reaction type agents, such as hair dye. enzyme hair dye, hair dress agent or setting agent for hair, reduction of inflammation pain killer, anti-heat flushes, coolants, pack agents, cleansing agents, shaving foams, moisturizers, antipersipirants. vitamin preparations, emollients and etc. may be preferably used for the combination of the contents for aerosol product.

20 Claims, 39 Drawing Sheets

U.S. PATENT DOCUMENTS

| | | | | | |
|---|---|---|---|---|---|
| 2,973,883 | A | * | 3/1961 | Modderno | 222/94 |
| 3,217,936 | A | * | 11/1965 | Abplanalp | 222/136 |
| 3,295,727 | A | * | 1/1967 | Kates et al. | 222/136 |
| 3,325,056 | A | * | 6/1967 | Lewis | 222/94 |
| 3,377,002 | A | * | 4/1968 | Weber | 222/333 |
| 3,482,736 | A | * | 12/1969 | Green | 222/94 |
| 3,511,414 | A | * | 5/1970 | Kinnavy et al. | 222/136 |
| 3,518,018 | A | * | 6/1970 | Woods | 401/46 |
| 3,540,623 | A | * | 11/1970 | Wittke et al. | 222/94 |
| 3,608,782 | A | * | 9/1971 | Sathicq | 222/94 |
| 3,651,990 | A | * | 3/1972 | Cernei | 222/94 |
| 3,685,696 | A | * | 8/1972 | Marraffino | 222/136 |
| 3,704,814 | A | * | 12/1972 | Ruscitti | 222/136 |
| 3,720,376 | A | * | 3/1973 | Morane et al. | 239/308 |
| 3,722,750 | A | * | 3/1973 | Fox, Jr. | 222/94 |
| 4,014,463 | A | * | 3/1977 | Hermann | 222/135 |
| 4,355,739 | A | * | 10/1982 | Vierkotter | 222/134 |
| 4,469,252 | A | * | 9/1984 | Obrist | 222/135 |
| 4,579,258 | A | * | 4/1986 | Brown et al. | 222/323 |
| 4,673,107 | A | * | 6/1987 | Obrist | 222/94 |
| 4,750,647 | A | * | 6/1988 | Cohen | 222/386.5 |
| 5,034,014 | A | * | 7/1991 | Wenke | 8/408 |
| 5,071,038 | A | * | 12/1991 | Credle, Jr. | 222/129.2 |
| 5,145,083 | A | * | 9/1992 | Takahashi | 220/203.24 |
| 5,153,231 | A | * | 10/1992 | Bouquet et al. | 521/88 |
| 5,167,347 | A | * | 12/1992 | Wiegner et al. | 222/94 |
| 5,215,225 | A | * | 6/1993 | Kopp | 222/129 |
| 5,339,990 | A | * | 8/1994 | Wilder | 222/135 |
| 5,348,392 | A | * | 9/1994 | Bouquet et al. | 366/162.3 |
| 5,387,034 | A | * | 2/1995 | Bauer et al. | 366/130 |
| 5,433,350 | A | * | 7/1995 | Graubart | 222/136 |
| 5,439,141 | A | * | 8/1995 | Clark et al. | 222/136 |
| 5,637,087 | A | * | 6/1997 | O'Neil et al. | 604/82 |
| 5,820,956 | A | * | 10/1998 | Hatakeyama et al. | 428/36.6 |
| 5,988,575 | A | * | 11/1999 | Lesko | 248/213.2 |
| 6,182,865 | B1 | * | 2/2001 | Bunschoten et al. | 222/136 |
| 6,230,943 | B1 | * | 5/2001 | Miyamoto et al. | 222/394 |
| 6,520,377 | B2 | * | 2/2003 | Yquel | 222/1 |
| 7,156,132 | B2 | * | 1/2007 | O'Dougherty et al. | 141/114 |
| 2001/0027981 | A1 | * | 10/2001 | Yquel | 222/136 |
| 2002/0185501 | A1 | * | 12/2002 | Yquel | 222/94 |
| 2004/0226964 | A1 | * | 11/2004 | Bourque et al. | 222/136 |
| 2007/0045342 | A1 | * | 3/2007 | Pigliacampo et al. | 222/129 |
| 2007/0241133 | A1 | * | 10/2007 | Smith et al. | 222/129 |

FOREIGN PATENT DOCUMENTS

| | | | |
|---|---|---|---|
| JP | 53-030166 | B2 | 8/1978 |
| JP | 02-048055 | Y2 | 12/1990 |
| JP | 03-039910 | B2 | 6/1991 |
| JP | 05-034780 | Y2 | 9/1993 |
| JP | 05-036854 | Y2 | 9/1993 |
| JP | 05-254581 | A1 | 10/1993 |
| JP | 08-169482 | A1 | 7/1996 |
| JP | 09-254990 | A1 | 9/1997 |
| JP | 3079150 | B2 | 6/2000 |
| JP | 2002-059985 | A1 | 2/2002 |
| JP | 2003-040368 | A1 | 2/2003 |
| WO | WO-96/18556 | A1 | 6/1996 |

* cited by examiner

CONTAINER FOR DISCHARGING PLURAL CONTENTS, A DISPENSER USING THE CONTAINER, AND A PROCESS FOR PRODUCING THE DISPENSER

FIELD OF THE INVENTION

This present invention is related to a container for discharging plural contents, a dispenser using the container, and a process for producing the dispenser.

BACKGROUND ART

Conventionally, as a dispenser for discharging plural contents, a two-fluid mixing type aerosol product is known in which different contents are charged in two aerosol containers respectively. These containers are bundled and discharging members for a common nozzle are mounted on the stem of the valves. The contents are not mixed before been discharged and mixed for the first time when they are discharged. For example, a two-fluid reaction type hair-dye composed of the first agent containing oxidation dye and the second agent containing oxidant are charged in each container and mixed in the process of discharging. However, since this type is composed of two bundled containers, the structure of the discharging member is complicated. More, it is difficult to activate the valves simultaneously and to operate the valves equally. Further, because it increases the length in the direction of coupling, it makes it difficult to grasp the container by hand. Furthermore, since this type needs two containers, the contents must be inserted separately. This will result in high cost. Also this can result in producing aerosol product with different pressure, due to the difference of the amount of the propellant charged in each container. Which means it is difficult to adjust the discharging volume of the two.

On the other hand, in the U.S. Pat. No. 3,079,150, a dispenser of one container filled with a plurality of contents is disclosed. This dispenser has a collapsible inner bag inserted in the outer container and different kinds of the contents especially gelatinous contents charged in the inner bag in layers. This dispenser can discharge the contents continuously in multi-layers, each layer made of different content, (multilayer discharging) at the time of discharging gelatinous contents from one nozzle or spout. Since it is composed of one container, the structure is simple and it is easy to grasp by hand. Further, since it discharges the contents by a propellant charged in one container, the pressure is equal and the discharging volume of both contents can be adjusted easily.

FIG. 3 in the above Patent, discloses an inner bag with a lengthwise fold lines, crimps or ribs, to secure the inner bag to be folded inward from three direction (of four direction). The similar inner bag is also disclosed in FIG. 3 and FIG. 4 of the Japanese unexamined Patent Application No. H08-169482.

The dispenser of the above U.S. Pat. No. 3,079,150 needs to fill the inner bag with a plurality of contents slowly so that the contents are not mixed, because the upper contents are charged sequentially directly after the lower contents are charged into the bag. This makes it difficult to speed up the charging rate causing low charging efficiency. Further, mutual mixing of contents happens during the storage or the transportation depending on the contents. In such a case, the user cannot obtain the effectiveness of the active ingredient when discharged, because reaction of active ingredients of the contents is induced inside the inner bag. And although the inner bag with crimps in lengthwise direction has an advantage that only a small amount of residue remains in the inner bag after discharging all the contents because of the uniform folding of the inner bag, the mixing of the contents cannot be prevented.

Further in the Japanese unexamined Patent Application No. 2003-40368, a dispenser for discharging a plural of contents having a plural of cylinders in the outer container is disclosed. Because this dispenser comprises two cylinders and two pistons, each content can be stored individually. The contents can be preserved without been mixed during the storage or the transportation. However, it increases the component parts of the dispenser. More, it is difficult to charge the contents into the cylinder when dispenser with only one cylinder is used.

This invention is directed to provide a container for discharging plural contents and its manufacturing process which facilitates high speed charging of contents without mutual mixing of contents and with the least provability of mixing in storage or transportation. Also maintaining an advantage of conventional aerosol products that "the contents are charged in one container, having simple structure, being easy to grasp by hand and easy to adjust the discharging volume because of a same pressure."

SUMMARY OF THE INVENTION

A container for discharging plural contents according to the present invention is characterized by comprising; an outer container, a collapsible inner bag having a plural of chambers inserted in the outer container, a plural of passages communicating each chamber with an atmosphere, a dispensing valve releasing the passages simultaneously, a discharging member activating the valve, wherein the inner bag is substantially one bag divided into plural chambers by compartment element, and each chamber has at least a collapsible part.

In such a container, it is preferable that the passage allows a flowing of the contents and at least one of the passages has a means to stop the flowing when the valve is closed, and it is more preferable that an opening of at least one of the chambers is closed by the valve. It is further preferable that the passage independently communicates each chamber with the atmosphere.

Further, it is preferable that the inner bag has upper and lower chambers provided vertically, and an easily closable partitioning isolates the lower chamber from the upper chamber, except for the passage which communicates the lower chamber with the atmosphere.

In such an easily closable partitioning, a partitioning member engaged on the constriction of size smaller than the opening formed at midway of the inner bag to isolate the lower chamber from the upper chamber, except for the passage which communicates the lower chamber with the atmosphere, may be used.

It is preferable that a part of the passage from the lower chamber to the valve is a tube and penetrates the upper chamber, and it is more preferable that at least a part of such a tube is placed as to be movable up and down against the valve housing and/or the partitioning. More, it is preferable that the container further comprises a gas absorbent provided on outer surface of the inner bag and/or inside of the outer container.

A dispenser for dispensing plural contents according to the present invention is characterized by comprising; the container described above, contents of two or more different kinds, and a means for pressurizing the inner bag to discharge the contents, wherein each chamber is filled with one kind of content. "A means for pressurizing the inner bag" herein referred to includes, a compression air charged in a space between the outer container and the inner bag, a pump to vacuum the contents charged in the inner bag, and a pump to press the inner bag by pressurizing the space between the inner bag and the outer container.

In such a dispenser, it is preferable that the container has two chambers and each chamber is filled with different kind of content. Further, a capacity ratio of the chambers is from 1:5 to 5:1 and the contents charged in the chambers are discharged in the same ratio as the capacity ratio. And the preferred contents contain reactive components, which react and display an effect when the contents are contacted or mixed with each other. It is preferable that the reaction of the reactive components is any one of the reactions selected from the group consisting neutralization, hydration, redox-reaction, ion-exchange reaction, dissolution, and decomposition.

Further, in a dispenser having two chambers and two kinds of the contents, the content charged in one of the chamber may be a first agent of hair-dye containing oxidation dye and the content charged in the other chamber may be a second agent of hair-dye containing oxidant. When the contents of the above are used, it is preferable that the inner bag has upper and lower chamber, the inner bag is formed by blow forming using synthetic resin with laminated structure having gas-absorbance layer or gas-barrier layer, the first agent of hair-dye contains amines, and the first agent is charged in the upper chamber and the second agent is charged in the lower chamber. It is more preferable that the dispenser further comprises a means to check the remaining amount of the contents.

A process for producing dispenser in this present invention is a process for producing dispenser having a container described above, contents of different kinds and a propellant charged in the outer container, comprising a steps of; placing the inner bag into the outer container, charging the contents into the chambers after fixing the valve to the outer container, and charging the propellant into a space between the outer container and the inner bag anytime after inserting the inner bag into the outer container.

Further, a process for producing dispenser having container with upper and lower chambers and with a partition to open and close an opening between the chambers, comprising a steps of, charging one content into one chamber, isolating one chamber from the other chamber, charging the other content into the other chamber, fixing the valve to the outer container, charging the propellant into a space between the inner bag and the outer container with anytime before fixing the valve to the outer container.

The container for discharging a plural of contents according to present invention has an inner bag with a plural of chamber divided by compartment element. Thereby avoid the mixture of the contents during the charging of contents and enables the high speed charging of the contents, although one content is charged into the one chamber directly after the other content is charged into the other chamber subsequently. Therefore the charging efficiency can be increased. Further, the mixture of the content can be prevented during the storage and the transportation. So this container can be used for the contents that must be first mixed at the time of discharging. This container becomes a dispenser by charging the contents into chamber, fixing a means to press the inner bag, for example the charging a propellant or a compression air into the space between the outer container and the inner bag, and fixing the valve to the opening of the outer container for sealing.

A pump to vacuum the contents charged in the inner bag, and a pump to press the inner bag by pressurizing the space may be used for the means to press the inner bag, other than charging the compression air. In this case, a pump integral with valve or separated from valve may be fixed after charging the contents.

The dispenser of the above may be used by opening or releasing the valve, or by operating the pump to vacuum or to press the contents. In this case, the contents charged in the chamber discharge from the nozzle or the spout fixed to the valve through the passage and the valve, because the chambers and the valve are communicated by the passage. The contents are discharge in the mixture or the sheathed form depending on the viscosity of the content and the resistance of the flow system due to the structure of the valve or the spout. These dispensed form of content or the dispensing operation are substantially the same with the previously mentioned U.S. Pat. No. 3,079,150. So it has a simple structure and is easy to handle compare to the conventional aerosol product with two containers. Further, because all the contents charged in the inner bag receive same pressure, it is easy to control the discharging amount of the content.

The phrase "substantially one bag" includes a bag having a plural of the chambers, and a plural of chambers linked or combined as a unit. The phrase "a dispensing valve releasing the passages simultaneously" includes the valve that release the air-tight passage such as aerosol valve, the valve that open the passage when user operate the piston such as pump valve, the valve that open the passage when user presses or grasp such as the squeeze bottle equipped with the valve, and valve that release the passage closed by a check valve.

Where the container with the passage has a means to stops the flowing when the valve is close, it prevent the flow between the chamber and the valve or between the chambers. Therefore, the dispenser with two liquid reactive contents may be efficiently used until the last without the mixing with each other. Especially, when all the passages have said means, flowing of the mixed contents from valve, where the content may be mixed, to the chambers can be prevented. In a result, the non-reacted contents may be safely preserved in the chambers, despite of the repeating operation of dispensing small amount.

In case that the opening of at least one of the chambers is closed by the valve, the passage from the chamber to the valve can be easily secured. Further, the charging of the contents will be eased, because the opening of such a chamber will have same size of diameter with the valve. The phrase "the opening of the chamber is closed by the valve" includes the opening of the chamber closed by both the valve housing and the valve mounting cup.

In case that the passage independently communicates each chamber with the atmosphere, the contents charged in the chamber will not be mixed in the valve or in the container. Therefore it is easy to control the quality of the content containing reactive component that reacts when they contact with each other. More, when the combination of the reactive components that cure or creates the reactant of solid matter at the time of mixture is used as the contents, this invention may prevent the blocking of the valve or the discharging member by the above.

In such a container of above, where the inner bag has upper and lower chambers provided vertically, and an easily closable partitioning isolates the lower chamber from the upper chamber, except for the passage which communicates the lower chamber and the atmosphere, two kinds of contents can be charged in one inner bag. So the structure is simple and handling is easy. The user can isolates the lower chamber from the upper chamber except for the passage after the charging of the content to the lower chamber. Thereby the content charged into the upper chamber will not contact or mix with the contents charged into the lower chamber, despite of the high speed charging of the content to the upper chamber. This will result in high efficiency. Further, where the partitioning is not only easily closed but is free for opening and closing. The same effect of the above may be earned by closing the partitioning after opening the partitioning by hand or by pressure of the charging process to charge the contents into the lower chamber.

In case of that the inner bag has a constriction of size smaller than the opening formed at its midway, and a partitioning member is engaged on the constriction to isolate the lower chamber from the upper chamber, except for the passage which communicates the lower chamber with the atmosphere, the manufacturing of the inner bag will be eased. The inner bag does not need the structure for opening and closing the opening of the chambers in itself. This partitioning member, for example, can be easily attached to the inner bag by previously attached to the dip tube that is a part of the passage.

Where a part of the passage from the lower chamber to the valve is a tube and penetrates the upper chamber, the manufacturing of the container will be ease due to the simplicity of the structure of the container. More, when the tube is corrosion resistance against the contents, the mixture of the contents due to the corrosion of the tube can be prevented. Further, when at least a part of the tube is placed as to be movable up and down against the valve housing and/or the partitioning, it will prevent the tube departing from the partitioning member due to the deformation of the inner bag during or after the charging of the contents.

Further, where a container of the above further comprises a gas absorbent provided on outer surface of the inner bag and/or inside of the outer container, a gas formed by decomposition of the contents can be absorbed efficiently. In such a case, the increasing of the pressure due to the permeation of the gas through the inner bag and the degradation of the contents can be prevented. A gas maybe, the decomposition of the hydrogen peroxide and ammonia gas from the ammonia.

The contents that are charged in a dispenser of the present invention do not mix with each other at the time of charging because it comprises the container written in above. So the charging efficiency of the content is high. Further, the contents hardly mix with each other during the storage and the transportation. More, because the dispenser of the present invention has a means to pressure the inner bag, the inner bag collapse by receiving a force from the outside to the inside. This enhances the degree of adhesion between the inner bag and the partitioning member, which further shuts the lower chamber from the upper chamber. This dispenser is best suit for the configuration like this.

Where the container has two chambers and these chambers are filled with two kinds of contents and a capacity ratio of the chambers is from 1:5 to 5:1 and the contents charged in the chambers are discharged in the same ratio as the capacity ratio, the effect of the planning is easily accomplished with no waste left over on the one side. Where the contents contain reactive components in which react and display an effect when the contents are contacted or mixed with each other, the reactive components can be stably conserved and prevent the degradation of the dispenser, because this dispenser comprises the container of the above and the contents are supplied in the chambers divided by the partitioning. Further, where the reaction of the reactive components is any one of the reactions selected from the group consisting neutralization, hydration, redox-reaction, ion-exchange reaction, dissolution, and decomposition, it is more preferable because these effects can be displayed from one container.

In case that the content charged in one of the chamber is a first agent of hair-dye containing oxidation dye and the content charged in the other chamber is a second agent of hair-dye containing hydrogen peroxide, the contents display the hair-dye effect when the contents are mixed with each other at the time of discharging from the dispenser. And because the dispenser of the present invention comprises the container of the above, these unstable contents can be preserved for long period of time in each chamber without been mixed until it is discharged.

Where the inner bag has upper and lower chamber, and the inner bag is formed by blow forming using synthetic resin with laminated structure having gas-absorbance layer or gas-barrier layer, the bottom of the inner bag is formed by gluing the inner surface of the inner bag. So the gas-absorbance layer or a gas-barrier layer does not lie between the inner bag and the outer container at the glued part. In such a case when the contents charged in the chambers includes the gas that permeates through the resin of the inner bag, the gas leaks outside at the bottom and the product as a whole deteriorates. Further, although the inner layer of the inner bag is gas-absorbance layer or gas-barrier layer the gas may leak through the attachment surface. In such a case, when the first agent of hair-dye contains amines, and the first agent is charged in the upper chamber and the second agent is charged in the lower chamber, the permeation of the gas generated from amines through the bottom of the inner bag can be prevented. Especially, when the amines is ammonia, this dispenser can prevent the lowering of the ammonia concentration and maintain the pH of the oxidation dye. As a result, the oxidation dye can be stored stably. Further, because the second agent is charged in the lower chamber the second agent can also be stably preserve. It prevents the contact reaction of the oxidant especially hydrogen peroxide with the metal parts of valve.

Where a means to check the remaining amount of the contents is comprised, the amount of the contents can be confirmed even the outer container is not transparent. So the problem of not acquiring enough effect of the contents due to running down of the contents supplied in the dispenser during in use may be prevented.

A process for producing dispenser having any one of a container described above, different kinds of contents and a propellant charged in the outer container, has a method of placing the inner bag into the outer container, and charging the contents into the chambers after fixing the valve to the outer container, can charge both contents to each chamber without mixing with other contents. The propellant are usually charged anytime before the valve is been fixed to the outer container, but when the container has gas-charging valve at the bottom of the outer container the propellant may be charged before or after the contents are charged into the container after the valve is been fixed.

The dispenser with the inner bag having an upper and lower chambers and a propellant charged in the outer container, comprising, a steps of charging one content into one chamber, isolating one chamber from the other chamber, charging the other content into the other chamber, fixing the valve to the outer container, charging the propellant into a space between the inner bag and the outer container anytime before fixing the valve to the outer container. This dispenser enables to charge the contents with high charging rate without mixing the contents with the other. Further, where the evacuation of the air between the outer container and the inner bag is carried out before the charging of the propellant, the preservation of the contents for quite a while may be accomplish due to the prevention of the contact between the contents and the oxygen in the air. Further, where the evacuation of the air in each chamber is carried out before the fixing of the valve by opening the valve, the stability of the contents greatly increase.

THE PREFERRED EMBODIMENT OF THE PRESENT INVENTION

Figure 1:
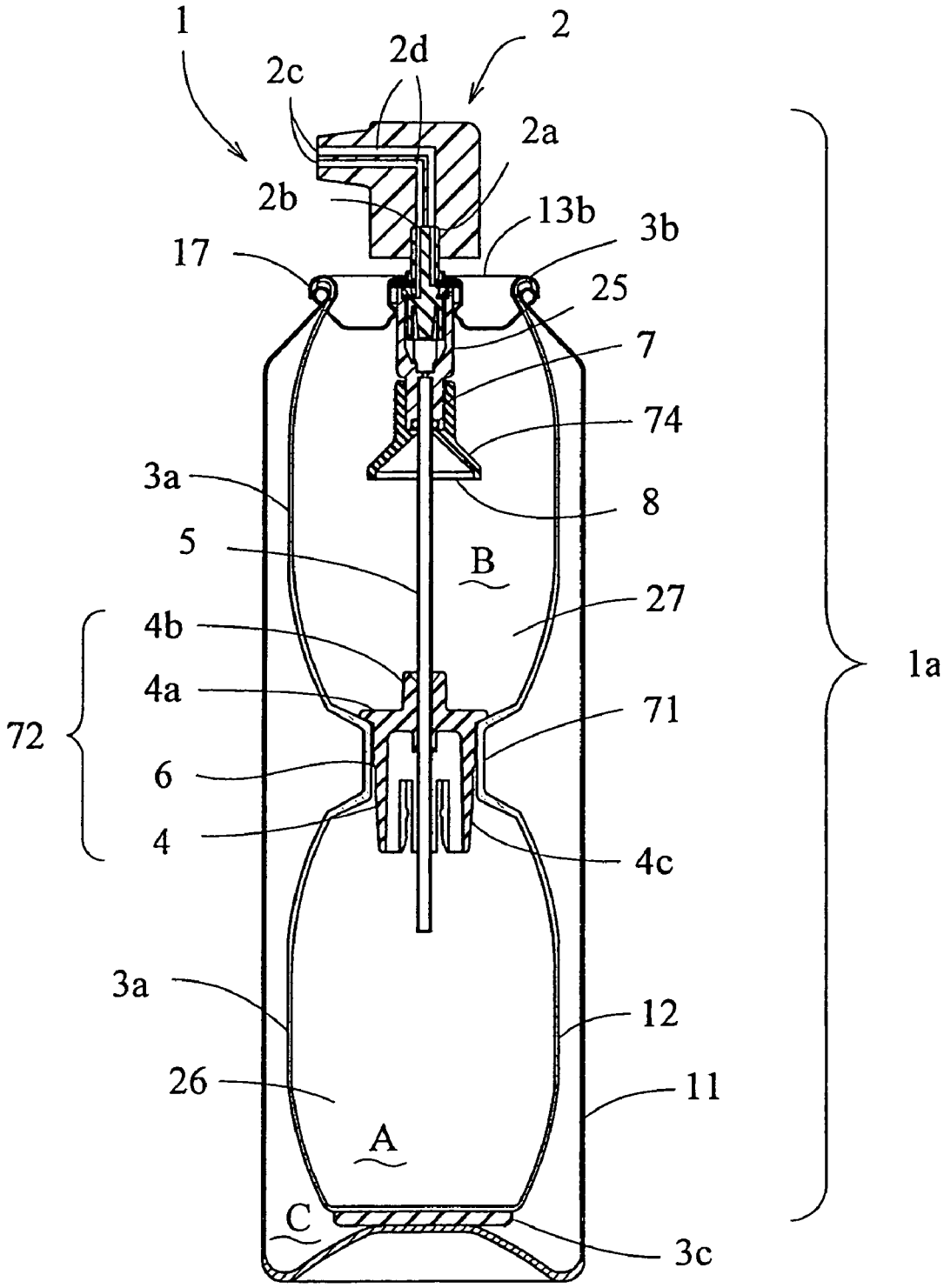
FIG. 1 is a front cross sectional view of the first embodiment of the container according to the present invention.

FIG. 1 shows a figure where a container of the present invention is applied to an inner bag type double-structured aerosol container. The double-structured aerosol container 1 comprises an outer container (or container body) 11 having rigidity; an inner bag 12 that is held in the outer container and has flexibility; a partitioning member 72 dividing the inner bag in chambers 27 and 26 into an upper part and a lower part; a valve 13*b* attached in an opening of the outer container 11; an engaging member 74 attached to a lower part of the valve; a tube 5 for communicating the valve 13*b* with a lower chamber 26; and an discharging member 2 attached to the valve 13*b*.

A conventionally well-known container maybe used as the container 11, which is obtained in a way that metal plates, such as of aluminum and of tin, is formed using reducing work etc. to obtain a cylindrical body having a bottom, shoulder part and neck part are formed in an upper part by necking processing etc., and a bead 17 is formed in a top end of the neck part by curling processing. Moreover, other materials, such as synthetic resins and resisting pressure glass, may also be adopted.

The inner bag 3 is a cylindrical body having a bottom and comprises a body 3*a* of the inner bag that has an upper chamber 27, a lower chamber 26, and constriction part 71 intervening between the upper and lower chambers; a neck part 3*b* of the inner bag that is formed at a top end of the body, and that has a flange part formed at a top end; and a bottom 3*c* of the inner bag for closing a lower end of the body.

The constriction part 71 has a radius smaller than a radius of the body 3*a*, the upper and lower chambers 27 and 26 are formed being tapering down toward the constriction part 71. This may easily shrink the upper and lower chambers 27 and 26 with discharge of the contents, and as a result, may make a residual quantity of the contents smaller. Moreover, a lower part of the lower chamber 26 is formed being tapered so that a bottom area may become smaller, which makes accommodation of the inner bag into the container easier.

The partitioning member 72, where a lower side face 4*c* of the body is tapered down, is closely inserted into the constriction part 71 and comprises the cylindrical body 4 having a bottom, a flange part 4*a* formed being tapered in an upper part of the body, and a cylindrical engaging member 4*b* projecting from a top face of the body, where an inner surface of top end is being tapered spreading outside, and fitting in closely with the tube 5. In addition, in the lower side face 4*c*, an annular projection part 6 projecting outside in a radial direction and engaging with the constriction part is provided. Engaging of this annular projection part 6 and the constriction part 71 prevents the partitioning member 72 to separate from the constriction part 71. This engagement seals the lower chamber 26 of the inner bag thoroughly, except for tube 5, when the partition member 72*b* is inserted into the constriction part 71 with the tube 5 being inserted.

Figure 5:
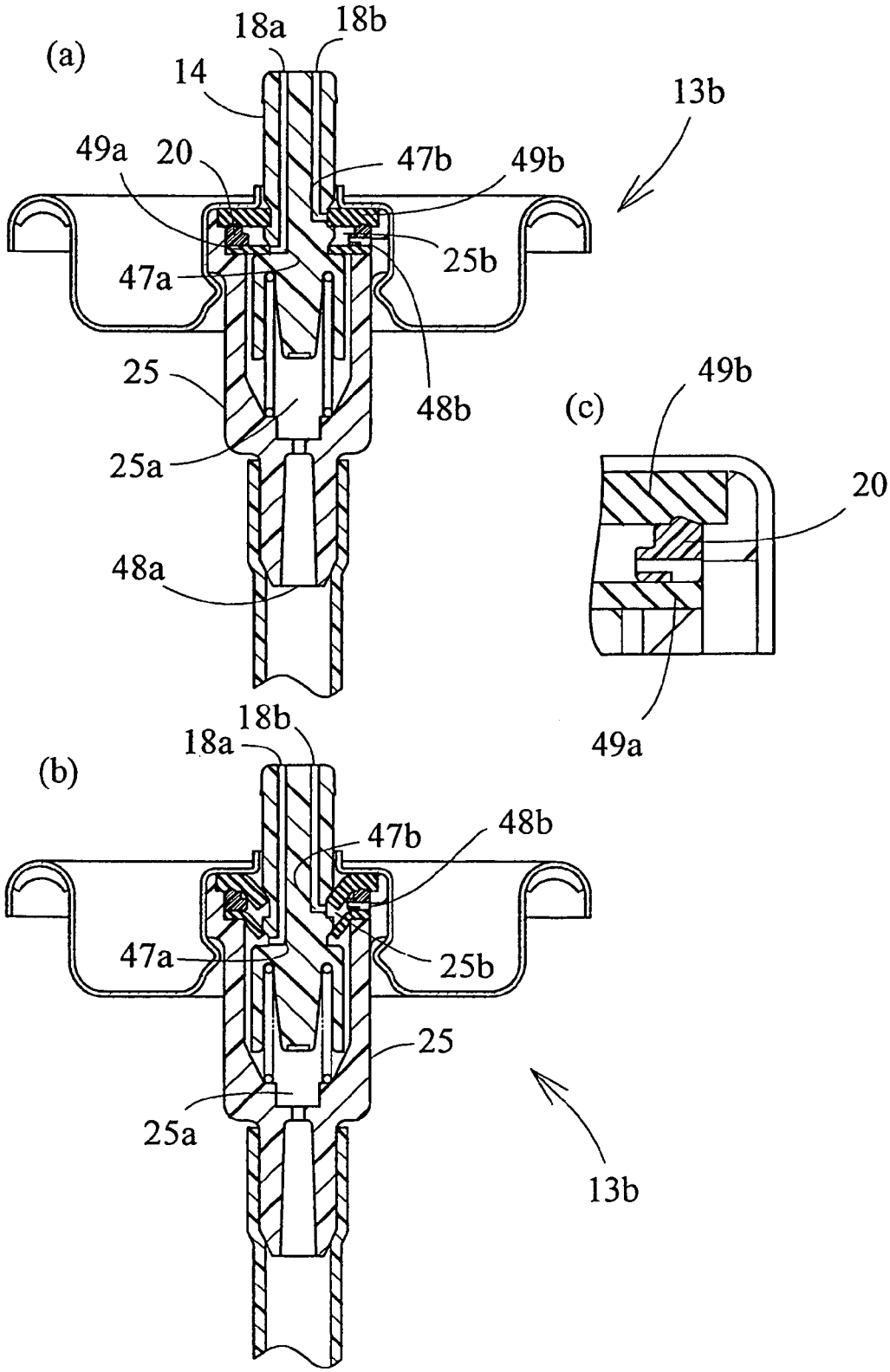
FIG. 5*a* is a front cross sectional view of the aerosol valve that has same structure with the aerosol valve of FIG. 3*b*.
FIG. 5*b* is a front cross sectional view of the aerosol valve with valve opened.
FIG. 5*c* is partially enlarged cross sectional view of FIG. 5*a*.

A valve 13*b* has, as shown in FIG. 5, a mounting cup 45 crimped to the bead 17 of the container 11; a housing 46 held in a center of the mounting cup; a stem 47 inserted in the housing 46 so as to be freely movable in up-and-down direction and having two stem pores 47*a* and 47*b*; a stem rubber 49*a* and 49*b* fitting with the stem pores 47*a* and 47*b* within the housing; a cylindrical fixing member provided between the stem rubbers and for fixing near a periphery end of each of the stem rubbers; and a spring that always energizes the stem upward.

Such configuration provides to inside of the housing a lower compartment 25*a* divided by an inner wall of the housing 25, the stem 14, and the lower stem rubber 49*a*; and an upper compartment 25*b* divided by upper and lower stem rubbers 49*a* and 49*b* and a fixing member 20.

In addition, the stem 14 has two discharging orifices, and channels 18*a* and 18*b* in the stem being mutually independent from the discharging orifice. Each of the channels in those stems is in communication with upper and lower stem holes 47*a* and 47*b*, respectively, and communicates to each chamber via the upper and lower compartments 25*a* and 25*b*.

Referring to FIG. 1, in a lower part of the housing of the container 1 there is provided a cylindrical projection part 7, having the tube 5 inserted thereto, that is inserted to the engaging member 74. Moreover, a gasket is provided in a lower inner surface of the projection part 7, which provides sealing between the tube 5 and the housing 25, and simultaneously prevents omission of the tube 5.

The engaging member 74 is fitted to a projection part of a valve, and has a cylindrical form whose lower opening 8 is tapered open and downward. When the tube 5 inserted in the partitioning member 72 is equipped to the valve 13*b*, the engaging member 74 guides the tip of the tube 5 to the projection part 7 of a lower end of the valve by just adjusting a tip of the tube 5 to contact with a lower opening of the engaging member, making insertion of the tube 5 into the valve easier.

The tube 5 is inserted into the projection part 7 of the housing 46, and is extended below, and is of materials of metal (for example, stainless steel) or of synthetic resins having corrosion resistance to contents. Synthetic resin coated layers may be provided on an outer surface and/or on an inner surface of a metal tube. The dispenser product may be fully consumed using these configurations, without mixing of the contents with each other.

The discharging member 2 comprises a valve engaging member 2*b* having two communication holes 2*a*; two ejecting holes 2*c*; and channels 2*d* in the discharging member for communicating the communication hole 2*a* with the ejecting hole 2*c*, respectively. The opening of the valve by operating the discharging member will independently discharges the contents separately discharged from a stem of the valve, without mixing.

In the present invention, a content A is charged into the lower chamber 26 of the inner bag, the partitioning member is inserted into the constriction part, the lower chamber is isolated except for channels (or passages), subsequently, a content B is charged into the upper chamber 27, an opening of the upper chamber is closed by placing or fitting the valve on an opening of the inner bag, a propellant C is charged into a space between the container 11 and the inner bag 12 by under-cup charging method etc., the valve is fixed to the container, and finally a dispenser 1*a* may be obtained. A charging valve for propellant may also be provided in a bottom of the container 11 etc.

As materials for inner bags of such containers, for example, there may be used synthetic resins, such as, linear low density polyethylenes (LLDPE), low density polyethylenes (LDPE), high-density polyethylenes (HDPE), polypropylenes (PP), polyethylene terephthalates (PET), polybutylene terephthalates (PBT), polyethylenenaphthalates (PEN), polyacrylonitriles (PAN), ethylene-vinylalcohol copolymers (EvOH), Nylons (NY), polyphenylene sulfides (PPS), polyvinyl chlorides (PVC), polyvinylidence chlorides (PVDC); metallic foils, such as aluminum (Al). When the synthetic resins are used, the resins are molded by a blow molding method etc.

into a cylindrical body having a bottom, and thus an inner bag of the container may be obtained.

As structures of the inner bag, there may be mentioned a monolayer structure of the synthetic resin, or two or more kinds of laminated structures (for example, LDPE/EvOH/LDPE, LDPE/NY/LDPE, etc.), or furthermore, metallic foils laminated with synthetic resins (for example, LDPE/Al/LDPE etc.), and each chamber has at least a flexible part which deforms by a pressure difference. A thickness of the inner bag is 0.1 through 2.0 mm, and preferably 0.3 through 1.0 mm, in consideration of easiness of blow molding, or flexibility. In addition, according to contents charged, a thickness of the upper and lower chambers of the inner bag may arbitrarily be set, for example, a thickness of only one chamber may set thicker. Moreover, according to contents, partially different qualities of materials may be used. Additionally, inner bags may be molded using composite materials. Further, in addition to the synthetic resin, including: volatile rust preventives, such as, dicyclo hexyl ammonium nitrite, dicyclo hexyl ammonium caprylate, and cyclohexyl amine carbamate etc.; gas absorbents, such as ferrous oxide; conductive powders, such as carbon black; metal powders, such as silver and nickel; antistatic agents, such as carbon fiber.

FIG. 2*a* and FIG. 2*b* show another embodiment where a container of the present invention is applied to a double-structured aerosol container 10 of inner bag type. The double-structured aerosol container 10 comprises a container 11 having rigidity; an inner bag 12 having flexibility held in the container; and a valve 13 (refer to FIG. 2*b*) attached in an opening of the container 11. Conventionally well-known containers may be used for the container 11 as in the above-mentioned embodiment.

The inner bag 12 is substantially same as conventional inner bags except that it may be constituted freely openable and closable to have a state that communicates an upper part with a lower part in a center section 21 (FIG. 2*a*), and a state that isolates the upper part from the lower part (FIG. 2*b*).

Inside of the inner bag 12 is divided into a lower chamber 26 and an upper chamber 27 via a center section 21, in a state where the center section 21 is closed as shown in FIG. 2*b*, upper and lower chambers 27 and 26 are mutually almost isolated except for a dip tube 28 provided in a valve 13. A dip tube used in the container having upper and lower chambers is a part of a passage that communicates the lower chamber with the valve, and that communicates the lower chamber with exterior (or an atmosphere), and may be of synthetic resins, or metals.

In the embodiment, a configuration freely openable and closable in the center section 21 comprises a bendable piece 32 having two or more sheets of inverse-triangled shape connected via bending lines 31 in a lower end of an upper cylinder 30; a bendable piece 35 having a triangled shape connected via bending lines 34 in an upper end of a lower cylinder 33; and cylindrical parts 36 having cornice shape provided between those bendable pieces 32 and 35. Tips of the upper bendable piece 32 and the lower bendable piece 35 are faced to each other. A upper end of the cylindrical parts 36 having a cornice shape is provided with a continuous saw-toothed shape via an oblique side of the upper bendable piece 32 having a triangle shape and the bending line 31. Similarly, a lower end is provided with a continuous saw-toothed shape via an oblique side of the lower bendable piece 35 having a triangle shape and the bending line 34. And in the cylindrical bellows-like part 36, a vertical line for connecting tips of upper and lower triangles is set as mountain fold bending line 40, and a vertical line for connecting bases of the upper and lower triangles is set as valley fold bending line 41. Accordingly, in the cylindrical part 36 having a cornice shape, a mountain fold bending line 40 and a valley fold bending line 41 are alternately arranged, as shown in FIG. 2*c*, and FIG. 2*d*, which enable the cylindrical part to be foldable.

In the inner bag 12 thus constituted, when elongated as in FIG. 2*a*, the bendable pieces 32 and 35 having a shape of an upper and a lower triangles are extended downward and upward, the cylindrical cornice part 36 presents an opened star-shape, as shown in FIG. 2*c*. Accordingly, it has a large opening in a center and, thereby, the lower chamber 26 of the inner bag 12 may be in communication with the upper chamber 27 with a wide area. On the other hand, when the flange 24 of the inner bag 12 is pushed down in a vertical direction of the container, or in a state where it is contracted in a vertical direction as in FIG. 2*b*, after a valve is crimped after charging of contents, the upper bendable piece 32 having a triangle shape and the lower bendable piece 35 having a triangle shape are bent inward, respectively, to give a shape where the upper part and the lower part are almost isolated except for a center part as shown in FIG. 2*b* and FIG. 2*d*. Then, those bendable pieces 32 and 35 give a folded star shape (FIG. 2*d*), while allowing inward deformation of the cylindrical cornice part 36, as mentioned above, and they are almost thickly closed in a vertical direction except for the dip tube 28. Moreover, in FIG. 2*d* there is shown a state where a clearance is provided between the upper and lower pieces of the cylindrical part 36, in order to help understanding, but actually, they are almost stuck firmly to each other. When the cylindrical cornice part 36 is shrunk as in FIG. 2*b*, the mountain fold bending line 40 is also vertically compressed, being pulled inward, and they curve inward while bent in horizontal direction.

The valve 13, as in FIG. 2*b*, comprises a mounting cup 45 crimped to a bead 17 of the container 11; a housing 46 held in a center of the mounting cup; a stem 47 held freely movable in vertical direction in the housing 46; a spring always energizing the stem upward (not shown); and the above-mentioned dip tube 28 extending downward from a lower end of the housing 46. The valve 13 is substantially same as conventional valves, except for comprising a communication hole 48 in communication with the upper chamber 27 of the inner bag 12, in a lower part of the housing 46. That is, the mounting cup 45 has a curved flange 50 crimped to the bead 17 via the flange 24 and a gasket 49 of the inner bag 12, and cylindrical housing hold part 51 with a bottom for holding the housing 46. The mounting cup 45 is, for example, of metal plates, such as aluminum and tinplate.

The housing 46 is a cylindrical type component made of synthetic resins, and a valve rubber (not shown) for opening and closing a stem hole of the stem 47 intervenes between a top end and underside of the mounting cup 45. As the stem 47, the spring, and the valve rubber, conventionally well-known materials may be employable. This housing 46 is in communication with the lower chamber 26 of the inner bag 12 via a dip tube 28, and with an upper part of the upper chamber 27 of the inner bag 12 through a communication hole 48. That is, the dip tube 28 and the communication hole 48 are a part of passages for communicating between an each chamber and an exterior. Adjustment of length and diameter of the passages may control a rate of flow from each chamber, and may also control discharged amount ratio of contents charged into each chamber to an suitable percentage. As the dip tube 28, metals (for example, stainless steel) having high corrosion resistance and non-permeability to contents, or synthetic resins may be used, or materials having a coated surface with synthetic resins may preferably be used. Use of these materials will prevent the reaction of contents charged in the upper and lower chambers with the dip tube. Thereby, a content in a lower part remained in the dip tube 28 and a content in an upper chamber 27 of outside of the dip tube 28 may not be permeated through the dip tube 28 to be mixed or reacted with each other via the dip tube 28.

Figure 3:
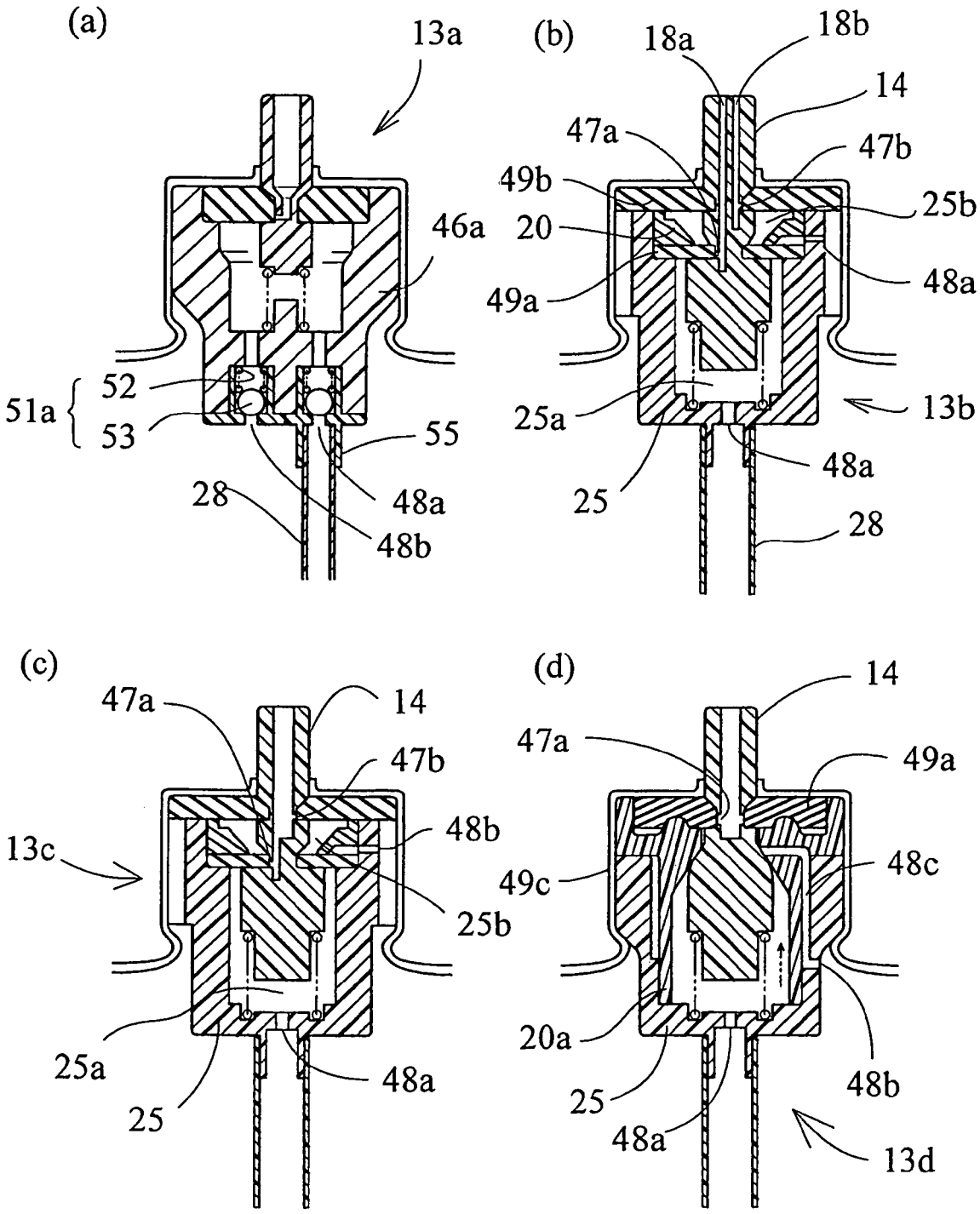
FIG. 3*a*, FIG. 3*b*, FIG. 3*c* and FIG. 3*d* are a front cross sectional view of the first embodiment of the aerosol valve used in the container according to the present invention.

Moreover, as valves used for an aerosol product of the present invention, there may be used a valve 13*a* with a check valve a shown in FIG. 3*a*; a valve 13*b* shown in FIG. 3*b*; a valve 13*c* shown in FIG. 3*c*, and furthermore a valve 13*d* shown in FIG. 3*d*. A housing 46*a* of the valve 13*a* shown in FIG. 3*a* has a pair of communication holes 48*a* and 48*b* in a lower end, one communication hole 48*a* is in communication with the lower chamber 26 of the inner bag through the dip tube 28 engaged to the dip tube engaging member 55, and another side communication hole 48*b* is in direct communication with the upper chamber 27 of the inner bag 12. A check valve 51*a* is provided in an upper part of these communication holes 48*a* and 48*b*. The check valve 51*a* is constituted with balls 53 placed in an upper part of the communication holes 48*a* and 48*b*, and springs 52 energized so that balls 53 may be pushed against the communication hole and as a result the communication hole may be closed.

Figure 4:
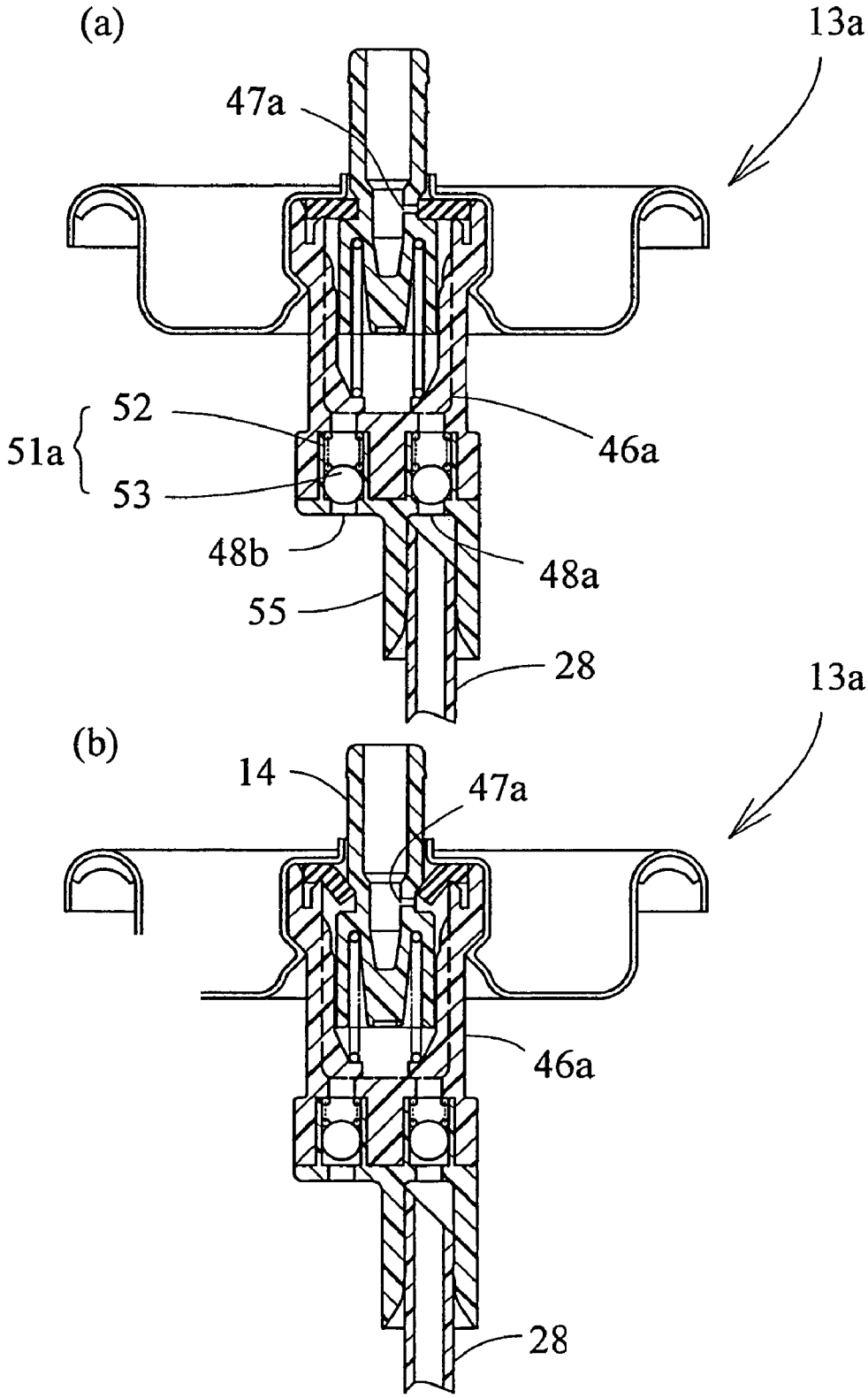
FIG. 4*a* is a front cross sectional view of the aerosol valve that has same structure with the aerosol valve of FIG. 3*a*.
FIG. 4*b* is a front cross sectional view of the aerosol valve with valve opened.

When discharging members, such as an injection button or a spout inserted in the stem 14, are pushed down and a stem hole 47*a* opens, inside of the container communicates with the atmosphere. Contents pushes up the ball 53 currently energized by the spring 52 with an aid of a pressure of a compressed gas charged in an interior space of the container, and thus discharge of contest will be performed from an discharging hole of the discharging member via the stem hole and the stem. However, since the ball 53 is energized downward with the spring 52 to close the communication hole in a usual state, the contents mixed within the housing 46*a* does not flow backward to each chamber. Thus, the check valve 51 allows a flow from each chamber to the valve, and prevents a flow to the chamber from the valve. Thus, return to chamber of the contents once mixed within the housing 46*a* can be prevented (refer to FIG. 4*a* and FIG. 4*b*). In this valve 13*a*, contents A and B contained in the upper and lower chambers are mixed within the housing 46*a* of the valve. Accordingly, each passage from each chamber to the passage holes 48*a* and 48*b* of the valve are mutually independent, and each channel from the communication holes 48*a* and 48*b* to exterior is shared.

The valve 13*b* shown in FIG. 3*b* has a housing 25; a stem 14 having two stem holes 47*a* and 47*b* held freely slidable in the housing; stem rubbers 49*a* and 49*b* fitting with those stem holes 47*a* and 47*b* within the housing; and a cylindrical fixing member 20 provided between the stem rubbers and for fixing near periphery end of each stem rubber. This configuration provides a lower compartment 25*a* divided by an inner wall of the housing 25, the stem 14, and the lower stem rubber 49*a*; and an upper compartment 25*b* divided by the upper and lower stem rubber 49*a* and 49*b* and the fixing member 20 in the housing. Moreover, the stem 14 has independent passages 18*a* and 18*b*, and the passages are in communication with each chamber via the lower and upper compartments 25*a* and 25*b* by the lower and upper stem holes 47*a* and 47*b*. That is, when the stem 14 is pushed down and the stem holes 47*a* and 47*b* are opened, the content in the lower chamber passes through the dip tube 28 from the lower chamber, and through the communication hole 48*a* of a lower end of the housing, reaches in the lower compartment 25*a*, and is stored therein, and on the other hand, the content in the upper chamber reaches in the upper compartment 25*b* through the communication hole 48*b*, and is stored therein. And these contents further go to a discharging orifice through the stem holes 47*a* and 47*b*, and passages 18*a* and 18*b* in the stem, respectively. Thus, use of this valve 13*b* enables simultaneous discharging, avoiding mixing of the contents of the upper and lower chambers, respectively. That is, use of this valve 13*b* can make each passages that communicates each chamber with the exterior or the atmosphere independent against the others. Such a configuration is particularly effective and preferable in following cases: a case where the contents in the upper and lower chambers of an aerosol product of the present invention may be mixed and reacts with each other to give curing, heat generation, heat absorption, discoloration, etc.; a case where the contents do not react each other but give different colors, respectively; a case where two liquids mixing well, that is, excellent in compatibility, for example, water and alcohol, etc. are in combination; and a case where a combination of contents having a small specific gravity difference(see FIG. 5*a*, 5*b*).

Figure 6:
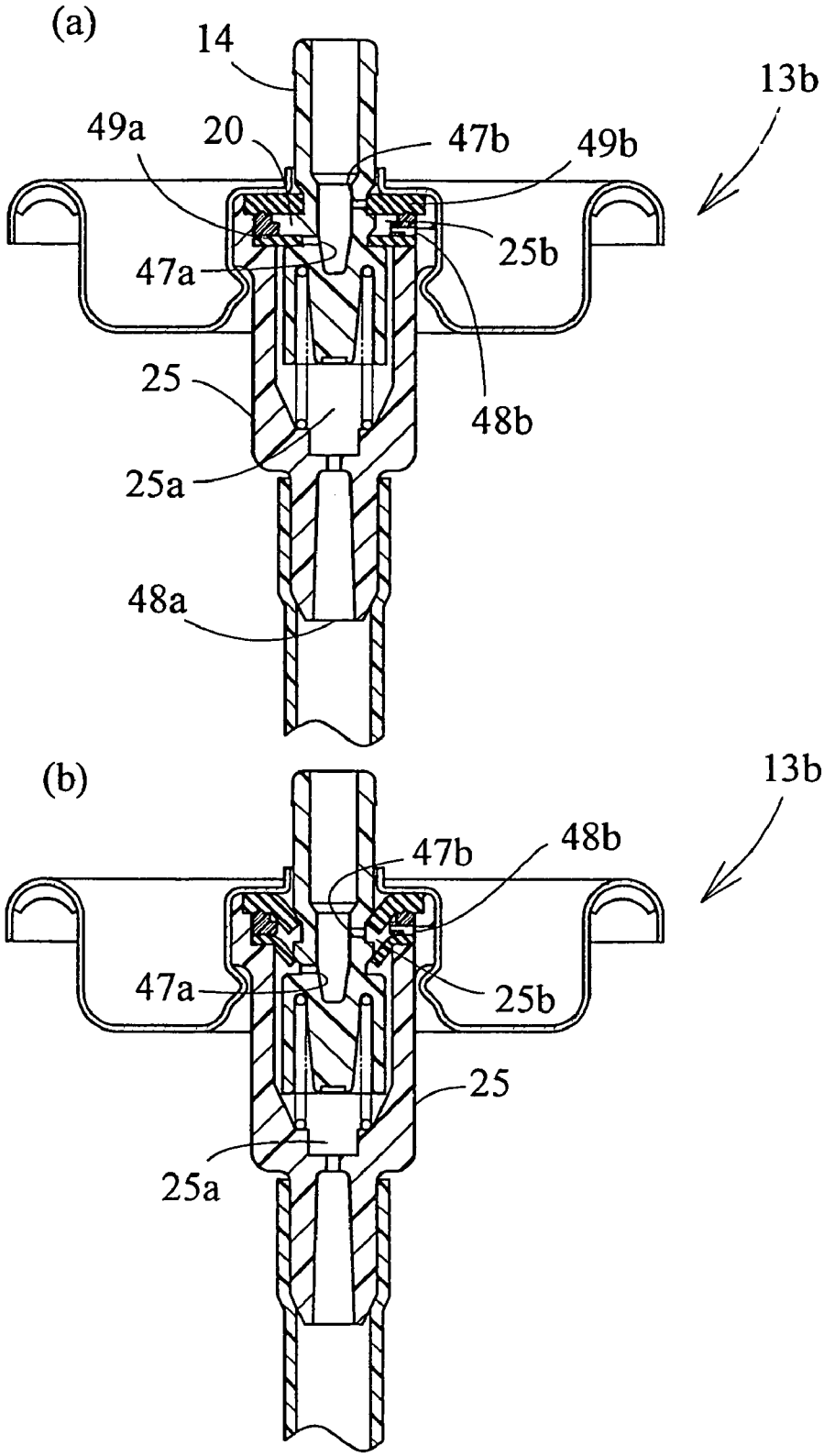
FIG. 6*a* is a front cross sectional view of the aerosol valve that has same structure with the aerosol valve of FIG. 3*c*.
FIG. 6*b* is a front cross sectional view of the aerosol valve with valve opened.

Valve 13*c* of FIG. 3*c* has one passage in the stem 14, and is constituted so that each contents may be mixed within the stem 14 after the contents are pushed out from each chamber to the stem holes 47*a* and 47*b* through each compartments 25*a* and 25*b*, respectively. Other configurations are same as of the valve 13*b* of FIG. 3*a*. Thereby, since the contents are mixed within the stem 14, mixed contents do not flow backwards into the valve, which enables stable preservation of the contents for long period of time. FIG. 6*a* and FIG. 6*b* show opening and closing state of a valve 13*c* substantially equivalent to this valve 13*c*.

Figure 7:
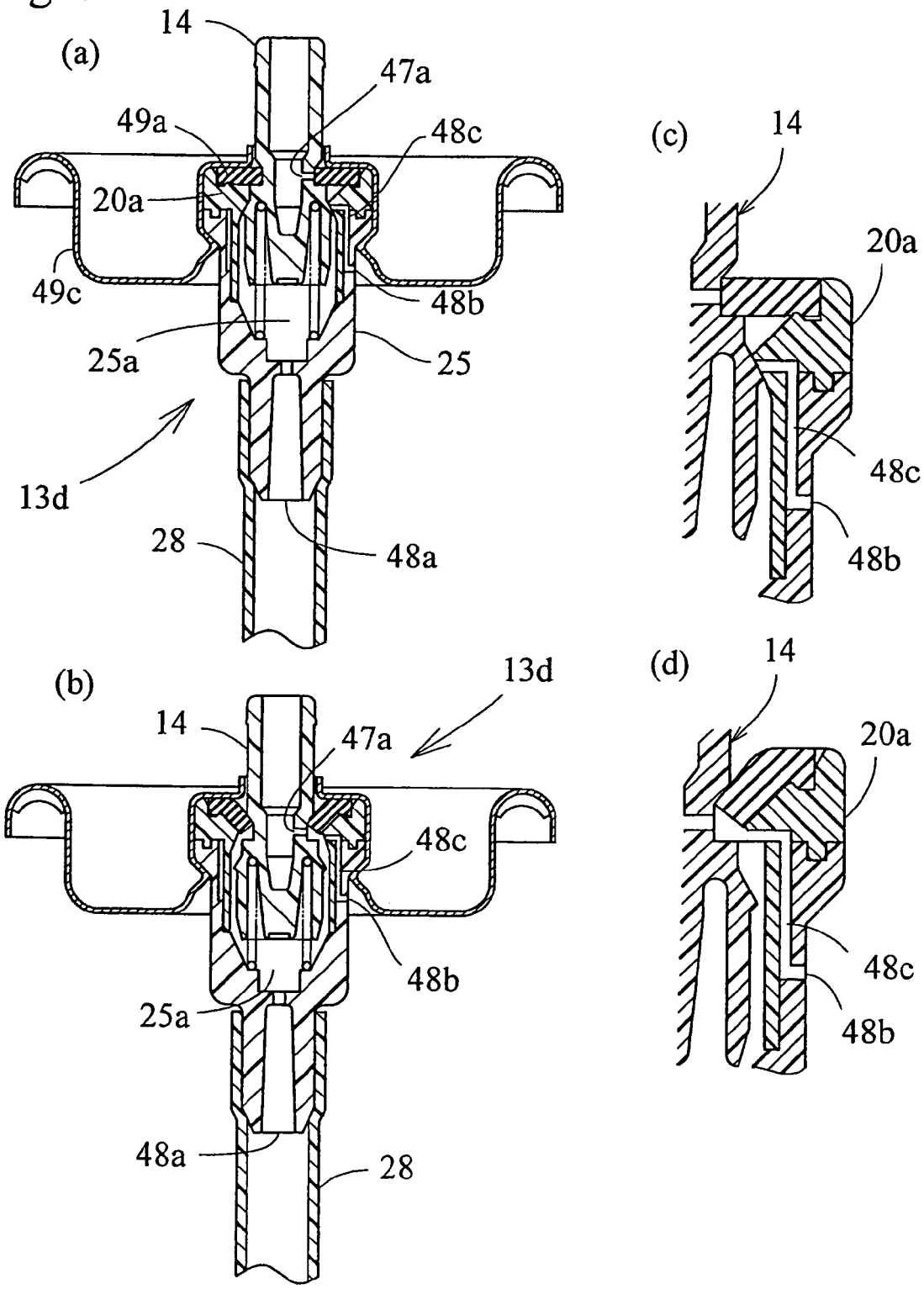
FIG. 7*a* is a front cross sectional view of the aerosol valve that has same structure with the aerosol valve of FIG. 3*d*.
FIG. 7*b* is a front cross sectional view of the aerosol valve with valve opened.
FIG. 7*c* is partially enlarged cross sectional view of FIG. 7*a*.
FIG. 7*d* is partially enlarged cross sectional view of FIG. 7*b*.
Figure 8:
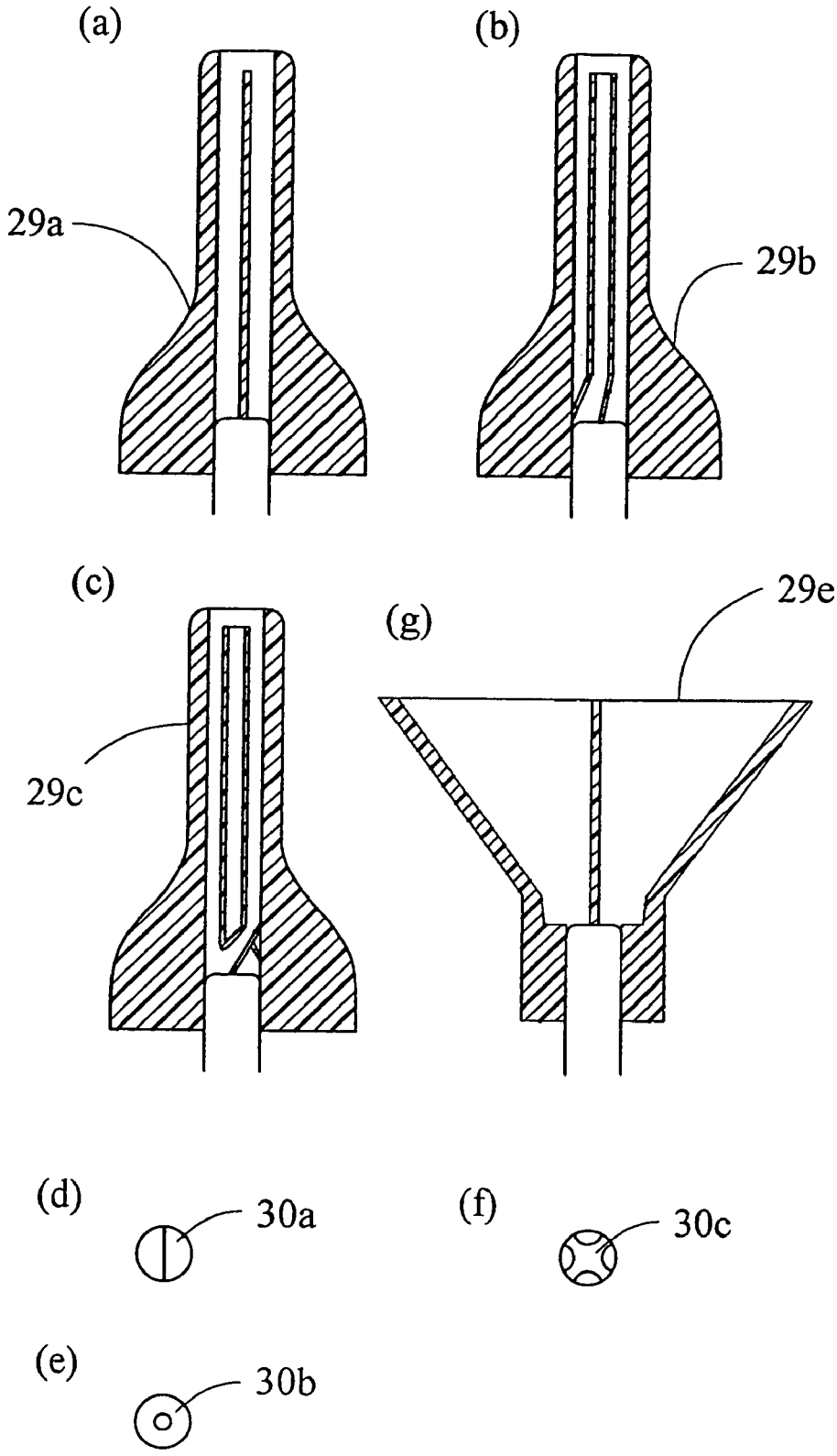
FIG. 8*a*, FIG. 8*b*, FIG. 8*c*, and FIG. 8*g* are a front cross sectional view of the first embodiment of the discharging member used in the container according to the present invention.
FIG. 8*d* to FIG. 8*f* are a cross sectional view of the discharged contents thereof, respectively.

Valve 13*d* of FIG. 3*d* comprises a housing 25; a stem 14 with stem holes 47*a* held being freely slidable in the housing; a cylindrical middle seal member 20*a* inserted between the housing inner wall and the stem; a stem rubber 49*a* engaged with the stem hole 47*a* provided on the middle sealing member; and a mounting cup 49*c* for fixing the valve to the container by crimping them to the container. Besides, the housing 25 has communication holes 48*a* and 48*b* in communication with upper and lower chambers. Thereby there is provided a configuration that the stem hole 47*a* is usually closed by the stem rubber 49*a*, and a content in the upper chamber flowing in via the communication hole 48*b* is blocked by a slope of the middle sealing member 20*a* and the stem 14, and the contents does not flow inside of the middle sealing member 20*a*. When the stem 14 is pushed down and the stem hole 47*a* opens, a content charged in a lower chamber will reach a inside compartment 25*a* through the dip tube 28, and the communication hole 48*a* of lower end of the housing, and will go toward the stem hole 47*a*. On the other hand, the content charged in the upper chamber goes directly to the stem hole 47*a* through the communication hole 48*b* in a housing side attachment wall, and the channel 48*c*. At this time, passage 48*c* and compartment 25*a* are in mutual communication, but a pressure gradient generated by a pressurizing agent passes contents upwards, so this pressure does not allow communication holes 48*a* and 48*b* to flow backwards. Thereby, the upper and lower contents meet and mix in the stem 14. Here, each of the passage 48*c* and the compartment 25*a* communicates substantially in independent with the upper and lower chambers, respectively, and each of them demonstrates functions as a compartment holding each content (refer to FIG. 7*a* and FIG. 7*b*). Thus, when the stem 14 of FIG. 3*b* is used as a stem, each passage that communicates each chamber with the exterior is mutually independent and the contents charged in each chamber discharge from each chamber to exterior without mixing. Moreover, an example in which a dip tube is inserted in outside of a cylindrical part under the housing is shown as a dip tube 28 here, but other insertion methods based on other Examples may be employed.

Figure 9:
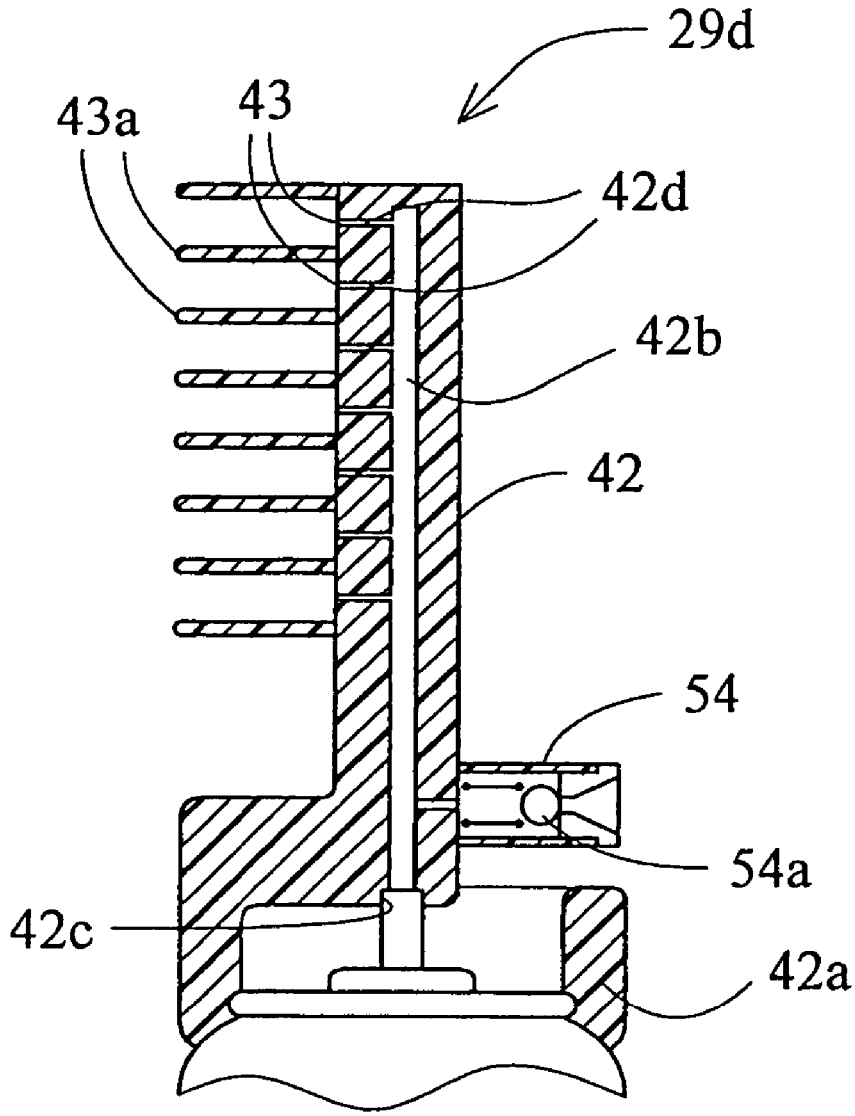
FIG. 9 is a front cross sectional view of the other embodiment of the discharging member used in the container.

Next, as a discharging member used for an aerosol product of the present invention, conventional spouts and members with nozzle may be used, and discharging members 29*a*, 29*b*, 29*c*, and 29*e* shown in FIG. 8*a*, FIG. 8*b*, FIG. 8*c*, and FIG. 8*g*, and a discharging member 29*d* shown in FIG. 9 may also be used. Discharging members 29*a*, 29*b*, 29*c*, and 29*e* shown in FIG. 8*a* through c and FIG. 8*g* are preferably used with valves (for example, a valve 13*b* in FIG. 3*b*, FIG. 5) that may discharge each content independently, and discharging member 29*d* in FIG. 9 may be used with valves enabling discharging of each content in a state mixed together therein (for example, a valve 13*a* in FIG. 3*a*, and FIG. 4; a valve 13*c* in FIG. 3*c* and of FIG. 6; a valve 13*d* in FIG. 3*d*), and with valve enabling independent discharge of the contents.

A discharging member 29*a* in FIG. 8*a* has a cylindrical form having a partition wall provided in a center, and may provide a content passed through therein with a discharged content 30*a* having a stripe-shaped cross section (refer to FIG. 8*d*). Besides, a discharging member 29*b* in FIG. 8*b* has a cylindrical form concentrically divided into two layers, and, may provide a content passed through therein with a discharged content 30*b* having a two-layered cross section (refer to FIG. 8*e*). Furthermore, a discharging member 29*c* in FIG. 8*c* has a cylindrical form having a divided circumference, and may provide a content passed through therein with a discharged content 30*c* having a cross section of spotted pattern (refer to FIG. 8*f*). Besides, the discharging port 47 may have a form extending tapered in a spatula-shape like a discharging member 29*e* of FIG. 8*g*.

A discharging member 29*d* in FIG. 9 with form of a comb comprises; a supporting member 42*a* engaging with a bead part of the valve; a beam member 42 continuously provided in the supporting member top; a plurality of branch member (teeth of a comb) 43*a* vertically provided at equal intervals from the beam member side face; a stem engaging member 42*c* provided in a bottom face of the beam member 42; an opening 54 for channel cleaning provided in a lower part of the beam member. The beam member 42 has a channel 42*b* provided inside in a straight line from a stem engaging member 42*c* up to a top; a plurality of discharging orifices 43 located on a side wall at equal intervals; and a plurality of channels 42*d* for connecting the channel 42*b* and the each discharging orifice 43. Besides, branch parts 43*a* are arranged at equal intervals between the discharging orifices 43 in the beam member side wall. Thereby, the contents flow from the stem to the channel 42*b* through the stem engaging member 42*c*, and is discharged from each discharging orifice 43. Members of this form may effectively be used for contents, such as hair dyes, treatment agents, and styling agents. Since aerosol products using this discharging member 29*d* has the discharging orifices 43 at the root of the branch part, combing action carries contents for hair to hair automatically, enabling homogeneous application. Also, an opening 54 for channel cleaning is in communication with the channel 42*b*, and a conventionally well-known ball type check valve 54*a* is provided near the opening. Furthermore, a cleaning method shown in utility model No. 2567137 may be used. For this purpose, a structure is adopted where contents do not leak from the channel opening 54 to outside of the discharging member 29*d* at the time of use. Since such a cleaning method is provided, contents remaining in the channel of the discharging members 29*d* may be flushed off by pouring in water and washing liquid from the channel opening 54 after use. As discharging members for an aerosol product of the present invention, application device currently disclosed in FIG. 1 and FIG. 7 of Japanese Unexamined Patent Publication No. 10-236539 may be used.

In an aerosol container 10 of FIG. 2 constituted as mentioned above: a first content A is charged in the lower chamber 26 from an top end opening of the inner bag 12; subsequently, the inner bag 12 is compressed downward to close the center section 21 and to mutually isolate the lower chamber 26 and the upper chamber 27; then a second content B is charged in the upper chamber 27 from the top end opening; then a propellant or a pressurizing agent are charged between the inner bag 12 and the container 11 using a method, such as undercup charging; and the mounting cup 45 of the valve 13 is crimped to the container 11, to obtain a double-structured aerosol product (dispenser product). Actually, a stem 47 is further equipped with a push button or a spout and a discharging member such as a discharging member 29*a* in FIG. 8*a*, a discharging member 29*b* in FIG. 8*b*, a discharging member 29*c* in FIG. 8*c*, or a discharging member 29*c* in FIG. 9, and furthermore a well-known discharging members. A jacket is given to the container with discharging member to obtain a finished product.

In the above-mentioned manufacturing process, a flange 24 of the inner bag 12 is pushed downward in an axial direction of the container during charging of contents, after charging of a first content A to the lower chamber 26. Thereby the inner bag is vertically shrunk to close the center section 21, As a result, the second content B will not easily be mixed with the first content A at the time of charging content B. For that purpose, this container enables charging of the second content B at a high speed, leading to an increase in working efficiency. Also, when the second content B is charged, the dip tube 28 is not yet attached, but the dip tube 28 is made to pass through a center of the center section 21 after charging of the second content B. However, the center section 21 may be closed after insertion of the dip tube 28 into the inner bag 12 and subsequently the second content B may be charged. In that case, only the dip tube 28 may be inserted first after charging of the first content A, and, subsequently the housing 46 may be fitted to a top end of the dip tube 28, after charging of the second content B. Or otherwise, the housing 46 and the mounting cup 45 may be attached in a top end of the dip tube 28 first, and, whole of the valve 13 may be dealt with as a module. Moreover, if a strength of the center section 21 is set so that a charging pressure at the time of charging of the second content B to the upper chamber 27 and a self-weight of the second content B to be charged may shrink the center section 21 of the inner bag 12 and may separate the upper and lower chambers 26 and 27 from each other. This makes easy charging of contents, propellants, or pressurizing agents, and easy crimping of the valve 13. Furthermore, in order to eliminate oxygen remained in the container, a vacuuming of the gas or exchanging of an inert gases or a liquefied gas may be performed before charging of pressurizing agents. As a result, it enables preservation of the contents over a long period of time as an aerosol product.

As contents charged in the inner bags used for an aerosol product of the present invention, both of the contents may be of a same kind, and preferably may also be contents of different kinds from each other. The above-mentioned contents of different kinds from each other include: a case where states of the contents (concentration) that are to be charged into each of the chamber, that is, active ingredients; amounts of blending, and blending components, such as solvent; and shape (difference of viscosity included) of contents, such as a shape of liquid, gel, and cream, are different from each other; and furthermore a case where states of the contents, that is, homogeneous system, and uneven system; emulsion system, and dispersion system, (appearance of contents, such as color tone and transparent feeling) are different from each other.

In a dispenser product of the present invention, the contents are charged in a container equipped with a plurality of the above-mentioned chambers mutually divided, both of the contents do not contact or mix with each other in the state where the contents are being charged in the chambers. Accordingly, as contents to be charged in each chamber, there may be used contents that cause reaction during or after discharging due to the contact or mixing etc. of each chamber, or contents blended with reaction components that are activated by mixing. Also, the reaction components may easily react with each other during or after discharging since contents easily mutually dissolve or mix are used. This demonstrates the effects well. As reactions generated by contacting or mixing of the contents, neutralization reactions, hydration reactions, oxidation/reduction reactions, ion exchange reactions, dissolution, acidolysis, etc. may be mentioned. As effects obtained by the reactions, generation of heat, cooling, thickening, coloring (discoloration), film formation, foaming, hidroschesis, etc. may be mentioned.

As combinations of reaction components participating in neutralization reaction, there may be mentioned: water-soluble polymers and pH regulators (acid components or alkaline components); for example, carboxy vinyl polymers and alkali components, acrylic acid/steareth copolymers, acrylic acid/ceteth copolymers and alkali components, acrylic acid/amino acrylic acids/PEG-alkyl (carbon numbers 10-20) copolymers, and acid components. These reagents may be used for application of setting agents for hairs, hair dyes, reduction of inflammation painkiller, ant-heat flushes, coolants, etc., and they display effects to thicken discharged contents (ejected matter) to improve adhesion, or to improve durability of cool feeling.

As combination of reaction components participating in hydration reaction, for example, there may be mentioned: polyhydric alcohols, such as glycerin, diethylene glycols, and propylene glycols, and water; and inorganic powders, such as anhydrous silicic acids, zeolites, sodium carbonate, and potassium carbonate, and water.

These are used for applications, such as moisturizers, cleansing cream agents, pack agents, and shaving foams, and obtaining a sense of heat caused by heat of hydration.

As combinations of reaction components participating in oxidation/reduction reaction, for example, dyestuffs, such as paraphenylene diamine, and oxidising agents, such as hydrogen peroxide and oxidizing enzymes; sodium sulfite and hydrogen peroxide; sodium thiosulfate and hydrogen peroxide, etc. may be mentioned. These are used for applications, such as hair dyes, moisturing creams, cleansing cream agents, pack agents, and shaving foams, and obtaining effects, such as hair dyeing by coloring (discoloration), and blood circulation acceleration, skin maceration by generation of heat.

As combinations of reaction components participating in ion exchange reactions, sodium alginate and calcium lactate, etc. may be mentioned. These are used for application of formation of protective layers, foods, play goods, idea articles, etc., etc., and obtaining a film formation effect.

As combinations of reaction component relating to dissolution, urea and water, calcium chloride (anhydrous) and water, chloro hydroxy aluminum and water, etc. may be mentioned. A combination of urea and water is used for application of anti-itch agents, emollients, keratin clearance agents, ointments, etc., and a feeling effect of cooling by endoergic reaction may be obtained. A combination of calcium chloride (anhydrous) and water is used for applications, such as moisturizers, cleansing cream agents, pack agents, shaving foams, and treatment agents, and heat sensation may be obtained.

A combination of chloro hydroxy aluminum and water is used as antiperspirants, and chloro hydroxy aluminum dissolves in water, and is ionized to demonstrate hidroscheisis effect.

As combinations of reaction components participating in decomposition reactions, for example, carbonates, such as sodium hydrogencarbonate, sodium carbonate, potassium hydrogencarbonate, and potassium carbonate, and acids, such as citric acid, tartaric acid, and phosphoric acid, may be mentioned. These component will decomposed to form carbon dioxide gas and when carbonates dissolve in aqueous solution including acid, and blending foaming agents, such as surface active agents together may give foaming effect. These are preferable in hair care products, cosmetics for human bodies, unregulated drugs, medicines, etc., but the application is, however, not especially limited. Carbon dioxide gas generated may provide blood circulation facilitatory effect, and this may be suitably used as hair restorers.

The reaction components are blended with different contents so that the reaction components may not react with each other in the state where contents are charged in a chamber. As examples of contents, for example, there may be mentioned compositions, such as: hair dyes described in Japanese Unexamined Patent Publication No. 10-45547, Japanese Unexamined Patent Publication No. 10-287534, Japanese Unexamined Patent Publication No. 2001-2537, Japanese Unexamined Patent Publication No. 2001-288055, Japanese Unexamined Patent Publication No. 2001-294519, Japanese Unexamined Patent Publication No. 2001-181159, Japanese Unexamined Patent Publication No. 2002-367294; enzyme hair dyes described in Japanese Unexamined Patent Publication No. 63-46313, Japanese Unexamined Patent Publication No. 06-172145; cleansing creams described in Japanese Unexamined Patent Publication No. 07-173033 etc.; pack agents described in Japanese Unexamined Patent Publication No. 06-336413, Japanese Unexamined Patent Publication No. 08-268828, Japanese Unexamined Patent Publication No. 200119606; treatment agents described in Japanese Unexamined Patent Publication No. 11-228332, Japanese Unexamined Patent Publication No. 11-279031; compositions for shaving described in Japanese Patent Publication No. 45-19996 official report etc.; and heat build-up compositions described in Japanese Unexamined Patent Publication No. 2003-19481, Japanese Unexamined Patent Publication No. 10-306276.

As shapes of the contents, a shape of liquid, gel, cream, paste, etc. may be mentioned and the shapes are not limited in particular. However, it is preferable to use contents having viscosity, such as a shape of gel, cream, paste, etc. giving little movement of reaction components caused by fluidity of the contents. In order to prevent unnecessary reactions caused by contact of contents in housing inside the valves, between chambers of inner bags (partition wall part), and in a discharging channel etc., and also in order to reduce decrease of effect of the reaction components. A viscosity of contents is preferably no less than 100 cp, and more preferably no less than 1000 cp. An effect controlling movement of reaction components caused by fluidity may not be obtained by a viscosity of less than 100 cp.

As states of contents, there may be mentioned: homogeneous system where active ingredients etc. are dissolved in a solvent; heterogeneous system where oily components and aqueous components are separated; oil in water type or water in oil type emulsion system where oily components and aqueous components are emulsified; and dispersal system where solid contents, such as powders, are dispersed in solvents. These states are not especially limited. The contents with few specific gravity differences and contents (solvent) that are mutually dissolved or mixed easily are preferable, in order for reaction components in each content to react easily after or during discharging and to easily obtain demonstrated effects.

A charging percentage of the contents is preferably 5:1 through 1:5, and more preferably 4:1 through 1:4 in a capacity ratio, in order to facilitate adjustment of discharged amount of each contents, and in order for reaction components to react easily, and further to easily demonstrate the effects.

Figure 2:
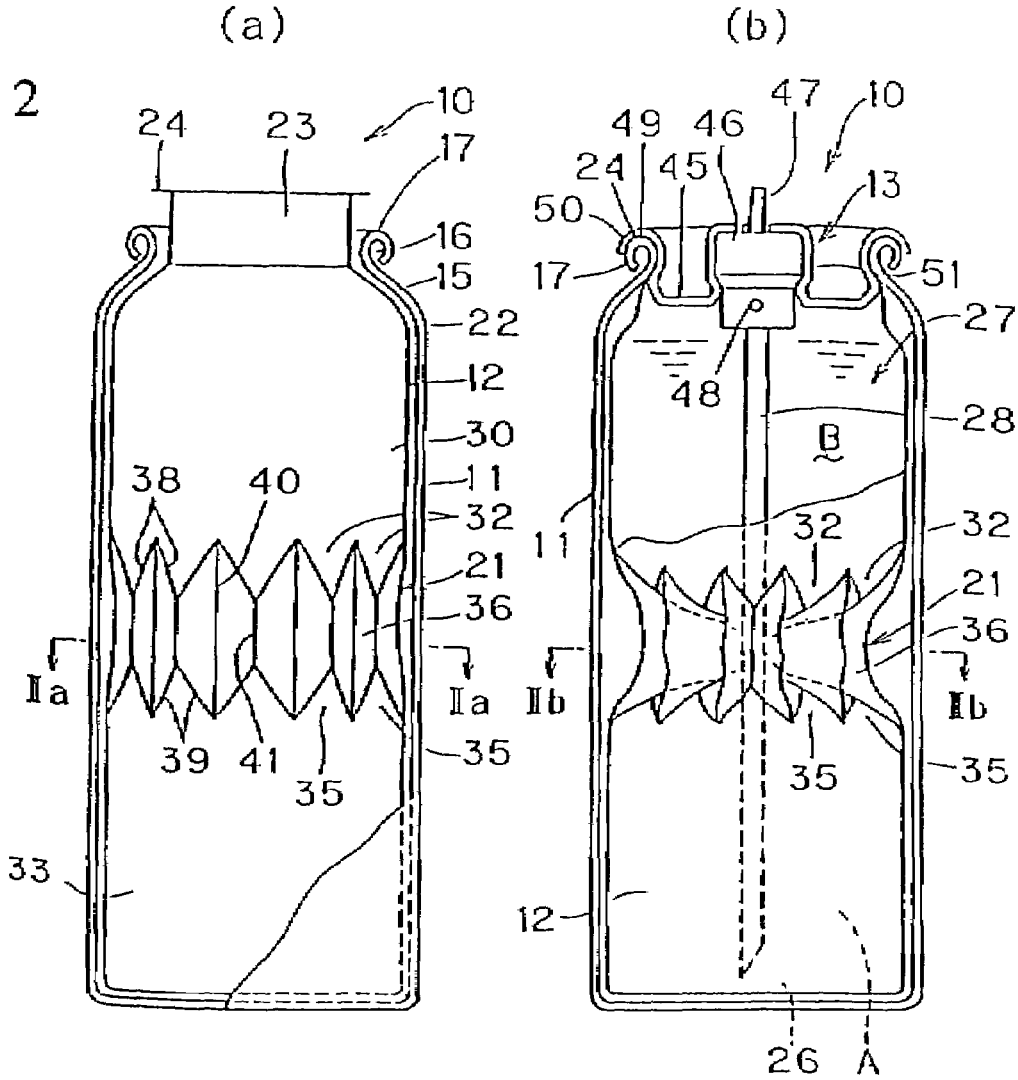
FIG. 2*a* and FIG. 2*b* are partially sectional front view of the other embodiment of the container showing the state before charging and after charging respectively.
FIG. 2*c* and FIG. 2*d* are cross sectional view of IIa-IIa line of FIG. 1*a* and cross sectional view of IIb-IIb line of FIG. 1*b*.
Figure 2:
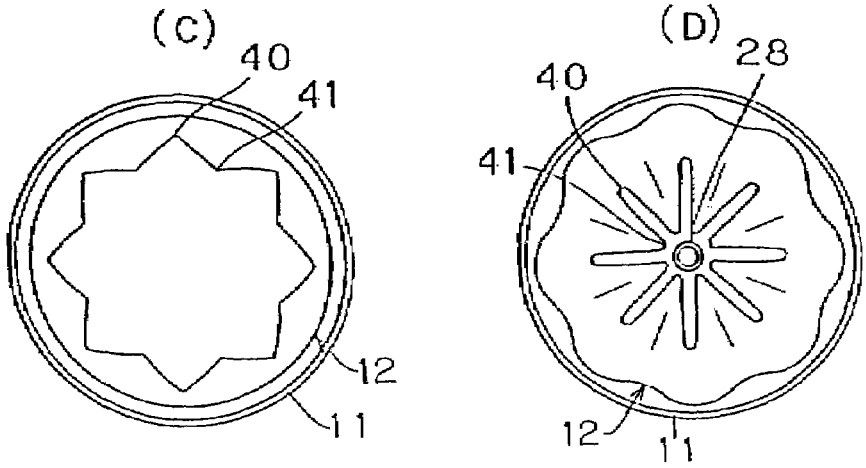

In a double-structured aerosol product in FIG. 2 constituted as mentioned above, the inner bag is always pressurized by pressurizing agents charged in a space between the inner bag 12 and the container 11, such as compressed gases, liquefied gases, and mixed gases of compressed gases and liquefied gases. Accordingly, internal pressure is generated in the inner bag 12. As for the compressed gases, nitrogen gas, carbon dioxide gas, nitrous suboxide gas, compressed air, and mixed gases thereof, etc. may be mentioned. As the liquefied gases, LP gas, dimethyl ether and frons, and mixed gases thereof, etc. may be mentioned. Furthermore pressure regulation components, such as pentane, may be used if needed. When the charging member is in operation in this state and the valve 13 opens, a pressure in the housing 46 becomes almost same as external atmospheric pressure. When a valve (for example, FIG. 3*a*) for mixing within the housings 46 is used, a first content A enters into the housing 46 from the lower chamber 26 of the inner bag 12 through the dip tube 28. Simultaneously, a second content B similarly enters into the housing 46 through the communication hole 48 from the upper chamber 27 of the inner bag 12. And while both are mixed within the housing 46 or both maintain a layer state, they are discharged outside from the discharging orifice of the discharging member etc.

When the contents A and B are discharged, a pressure in the lower chamber 26 is almost equal to a pressure in the upper chamber 27. Accordingly, a problem that only of one of the two contents many discharged to leave another content remained, or a problem that different discharging amounts between each of the contents fail to make active ingredients react at a predetermined mixing ratio, and does not fully demonstrate a target effect, that is, problems caused by unequal pressurizing will hardly occur. Besides, in an embodiment shown in FIG. 2, since the center section 21 of inner bag 12 is thinner than an upper tube (upper chamber), and furthermore the communication hole 48 is in communication with an upper part of the upper chamber 27, the upper chamber 27 is crushed upward sequentially from the center section 21 when remainder of the second content B in the upper chamber 27 decreases. Similarly, since the center section 21 of the inner bag 12 is thinner than a lower tube (lower chamber), and the first content A in the lower chamber 26 is sequentially discharged from an opening of a lower end of the dip tube 28, the lower chamber 26 is crushed downward sequentially from the center section 21. This lessens a possibility that contents A and B may remain in the inner bag 12. Further, as consumption advances, isolation of each content A and B further proceeds, and thereby a state where contents A and B are separated is still more established, leading to excellent preservation of the both contents.

As examples particularly desirable as combinations of the contents charged in the container of the above-mentioned present invention, two liquid reaction type hair dyes and two liquid reaction type exoergic formulation may be mentioned.

Two liquid reaction type hair dye comprises a first agent including oxidation dyes, and a second agent including oxidizing agents.

As the above-mentioned first agent, there may be mentioned agents blended with solvents (purified water, lower alcohols, such as ethanol, alcoholic aqueous solution, etc.) including: oxidation dyes, that are oxidized with oxidising agents included in the second agent mentioned later to give coloring, and that dye hair into desired color tones (for example, paraphenylene diamine, N,N-dimethyl paraphenylene diamine, para-amino phenol, etc.), and alkaline agents (for example, ammonia, alkanol amines, etc.) in order to adjust pH of the first agent to a range of 6 through 12 and to stabilize the oxidation dyes and to improve hair dyeing effect.

Besides, in the first agent, in order to adjust colors of hair after treated, there may be blended: acid dyes (for example, Amaranthus, tartrazine, fast green, brilliant blue FCF, orange II, resorcin brown, alizurol purple, naphthol blue black, etc.); direct dyes (for example, 4-nitro-o-phenylenediamine, 2-amino-4-nitrophenol, etc.); other auxiliary components (for example, resorcin, paramethyl aminophenol, tannic acid, benzyl alcohol, N-methylpyrrolidone, etc.)

As the second agents, there may be mentioned agents blended with solvents (purified water, ethanol, alcoholic aqueous solution, etc.) including: oxidising agents for oxidizing oxidation dyes and demonstrating effect (for example, hydrogen peroxide and oxidizing enzyme (for example, laccase, peroxytase, uritaze, catalase, tyrosinase, etc.)); stabilizers (for example, EDTA, tannic acid, parabens, etc.); pH regulators (for example, phosphoric acids, citric acid, lactic acid, tartaric acid, etc.) etc.

Moreover, to both of the first agent and second agent, in addition to the above-mentioned components: active ingredients (for example, treatment agents, moisturizers, UV absorbents, amino acids, vitamins, extracts, preservatives, perfumes, etc.) may be blended in order to demonstrate effects other than the hair dyeing effects; and there may be blended surface active agents (for example, non-ion based surface active agents, silicone based surface active agents, etc.); viscosity control agents (for example, cellulose type thickeners, carboxy vinyl polymesr, xanthan gums, etc.); oily components (for example, silicone oils, ester oils, hydrocarbons, fats and oils, higher alcohols, fatty acids, wases, etc.); and foaming agents (for example, LP gas, isopentane, etc.) etc. in response to discharging shape or feeling of use.

Next, two liquid reaction type exoergic formulation comprises a first agent including exothermic components, and a second agent including water.

As the above-mentioned first agent, oily formulations in which exothermic components generating heat that dissolve in water or hydrate with water (for example, magnesium chloride, zeolite, etc.) are dispersed in oily bases (for example, hydrocarbon such as liquid paraffin and liquid oil such as ester oils and silicone oils) may be used.

Besides, surface active agents for dispersing exothermic components (for example, non-ion based surface active agents etc.); foaming components (for example, carbonates, such as sodium hydrogencarbonate and sodium carbonate); and thickeners (for example, palmitic acid dextrin etc.) etc. may be blended in the first agent.

As the second agents, water formulation including water, such as water, cream (water in oil type emulsions), and aqueous gels, etc. may be mentioned. In order to maintain the exothermic effect, agents having hydrophilic surface active agents dispersed in the oily bases as a second agent may be used. When carbonate is included as a foaming component in the first agent, it is preferable that acids (for example, citric acid etc.) for decomposing the carbonate and generating carbon dioxide gas may be blended.

Moreover, active ingredients (for example, treatment agents, moisturizers, UV absorbents, amino acids, vitamins, extracts, preservatives, detergents, perfumes, etc.) for demonstrating effects other than the exothermic effect; and foaming agents (for example, LP gas, isopentane, etc.) etc. may be blended in both of the first agent and second agent with or without the above-mentioned component.

Aerosol containers 60 in FIG. 10*a* and FIG. 10*b* have small diameters of a body (for example, 10-40 mm), and they may be used in the case where miniaturization of product is required, or where a small net weight is required because consumption in a short period is necessary due to poor stability of the contents. In the container 11 of the aerosol container, a top end is extended upwards, and depressed groove 61 projecting inward in a radial direction is formed in a partly lower part of the top end. In addition, a mounting cup 45 of a valve is divided into an attaching part 63 holding a housing 46 and a cover 64 for attaching the attaching part in a container 11. Attaching part 63 has a flange 65 engaging with a top end of the container 11 via a packing 62, and a lower end periphery is engaged with an upper part of a projection formed in an inner surface side of the depressed groove 61. Moreover, the cover 64 has a cylindrical form with a bottom, and a vicinity of a perimeter of the lower end is crimped to the depressed groove 61. That is, the curved flange 50 of the mounting cup 45 of the valve 13 is crimped to the bead 17 provided in a top end of the container 11 in FIG. 2, but in case of the aerosol container 60 in FIG. 10*a*, it is crimped to the depressed groove 61, and they are different from each other in this point. Moreover, a top end of an inner bag 12 cylindrically extends upward so that it may intervene between the top end of the container 11, and an attaching part 63.

In addition, an annular groove 65*a* engaging with a projection on an inner surface of the depressed groove 61 of the container 11 is formed near the top end of an inner bag 12. Furthermore, clear pleat lines as in FIG. 2*a* is not provided in a center section 21 of the inner bag 12, but triangle-shaped crevices are arranged so that they may become a starting point of folding in a part of a downward truncated cone 66*a* and an upward truncated cone 66*b*. Neither folding lines nor cornice are provided in a cylindrical part 66*c* between both of the truncated cones 66*a* and 66*b*. However, when the inner bag 12 is vertically compressed, buckling will arise in the cylindrical part 66*c*, and the inner bag 12 will be folded, and closed, if only a starting point of folding is provided. Other parts, for example, a shape of whole portion including the center section 21 of the inner bag 12, and materials and a shape of the container 11 are substantially same as in the double-structured aerosol container 10 in FIG. 2.

Also in the double-structured aerosol container 60, in a same manner as in FIG. 2, after a first content A is charged into a lower chamber 26 of the inner bag 12, a top end an opening of the inner bag 12 is pressed to close the center section 21, a second content B is charged into an upper chamber 27, then compressed gas etc. is charged between the inner bag 12 and the container 11, and subsequently a valve is fixed, resulting in a double-structured aerosol product of inner bag type (refer to FIG. 10*b*). And those charging process is easily performed. The double-structured aerosol product thus obtained may be used almost in a same way as the double-structured aerosol product using the aerosol container of FIG. 2, and they may discharge the first content A and second content B in a state mixed together or in a layered state.

Figure 10:
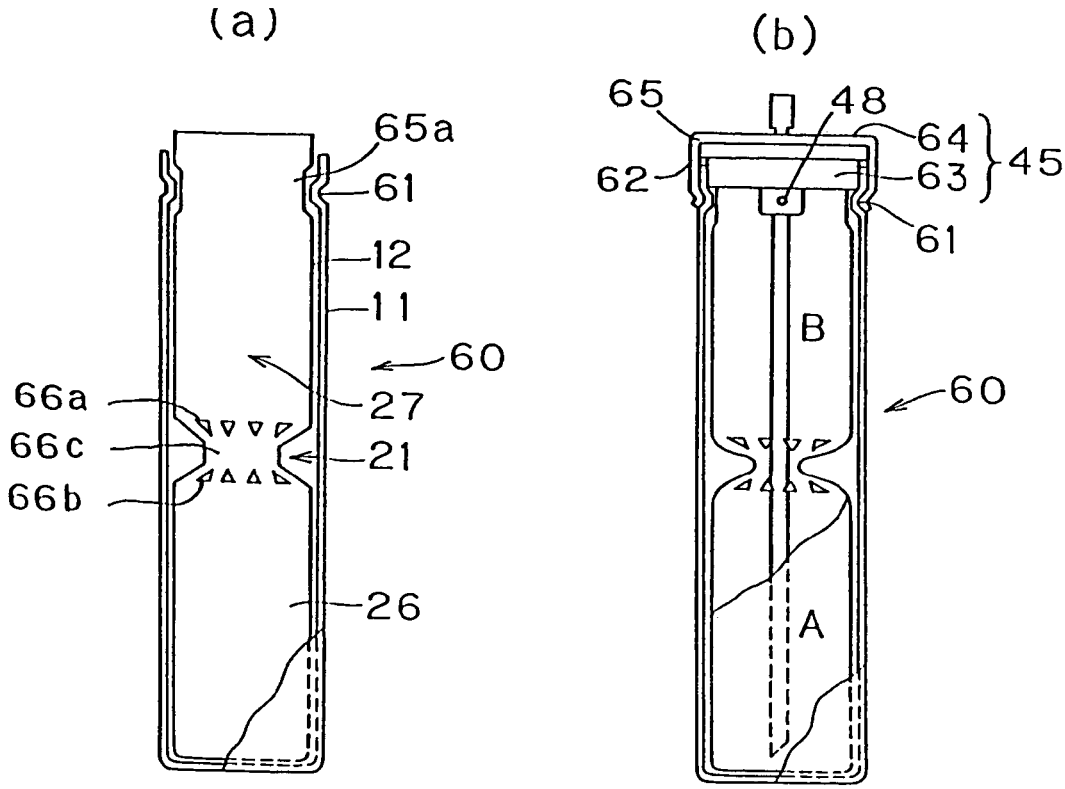
FIG. 10*a* and FIG. 10*b* are a front partially sectional view of another embodiment of the container showing the state of before and after charging respectively.
Figure 11:
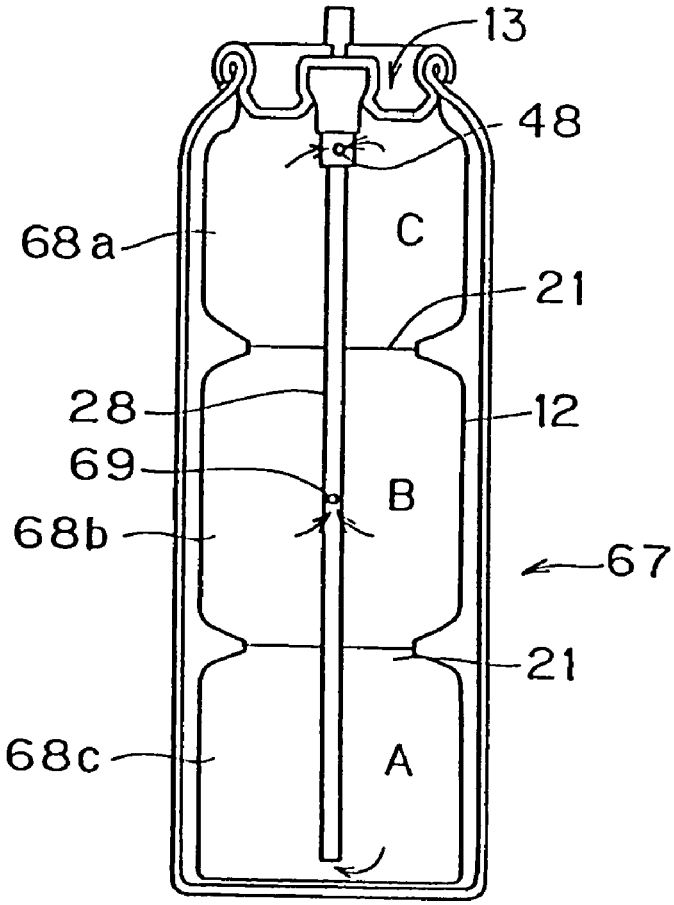
FIG. 11 is a front cross sectional view of yet other embodiment of the container.

In an aerosol container 67 shown in FIG. 11, two openable and closable center sections 21 are provided in the inner bag 12, and thereby, three of upper, middle, and lower chambers 68*a*, 68*b*, and 98*c* are obtained. And a through-hole 69 in communication with a middle chamber 68*b* is formed in a middle part of a dip tube 28. In addition, the through-hole 69 is preferably formed in the middle of the upper and lower direction of the middle chamber 68*b*. Other parts are substantially same as in aerosol products in FIG. 10*b*.

In the container, when a valve 13 is operated, a first content Ain the lower chamber 68*c* enters into a dip tube 28 from a lower end of the dip tube 28, a second contents B in a middle chamber 68*b* enters into the dip tube 28 from the through-hole 69, then both of the first and second contents proceed together, and enter in a housing 46, and a third content C in a upper chamber 68*a* enters in the housing 46 through the communication hole 48 in the housing 46. Thereby, three kinds of contents A, B, and C are discharged out in a mixed state, or in a layered state. The container is substantially same as the aerosol container 60 of FIG. 10*b* in other points, and substantially same operational advantage may be demonstrated. In addition, there may be provided two dip tubes, that is, a dip tube 28 communicating the lower chamber 68*c* with the housing 46, and a short dip tube communicating the middle chamber 68*b* with the housing 46. In that case, two kinds of contents B and C will not mixed together within the dip tube.

Figure 12:
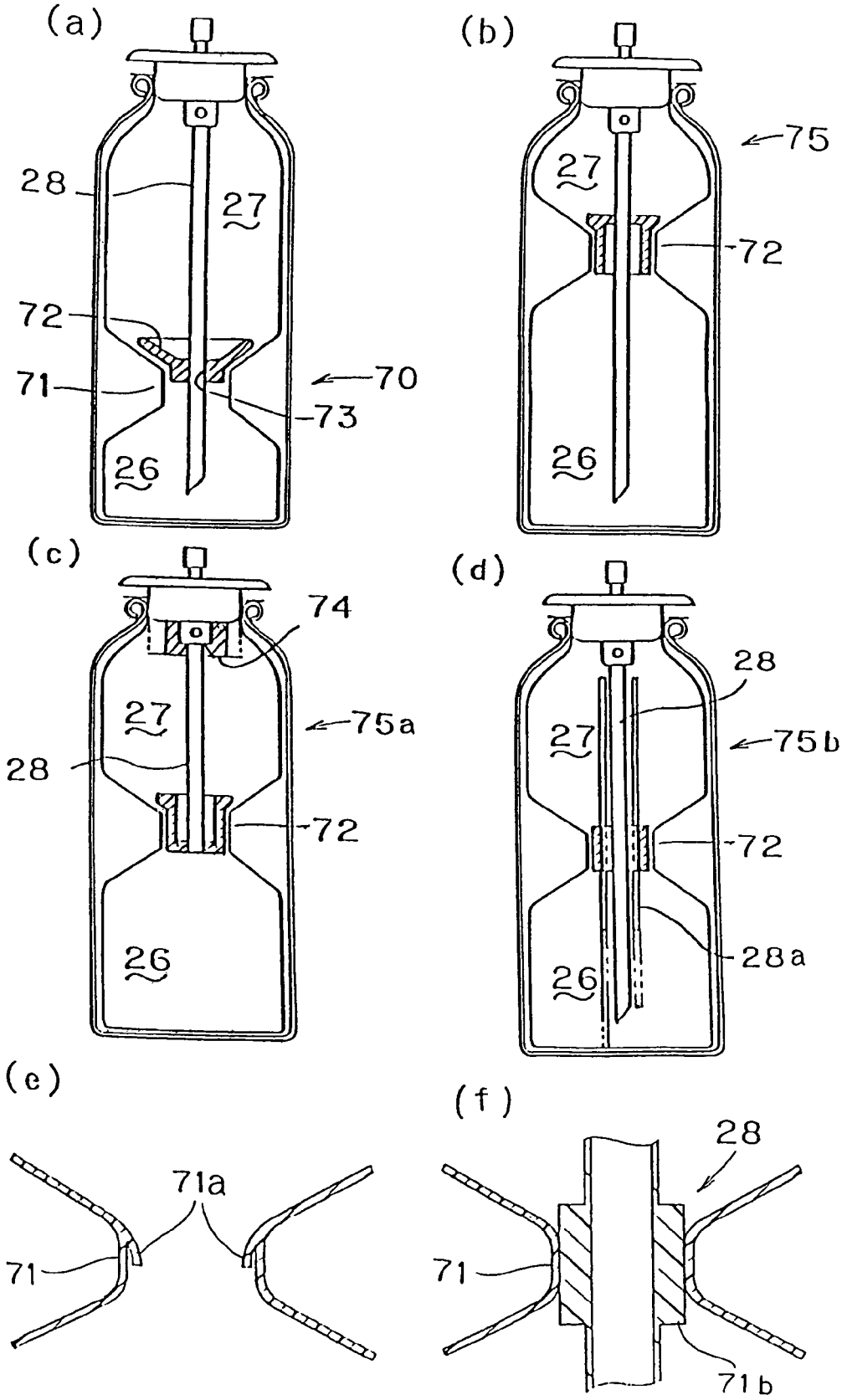
FIG. 12*a*, FIG. 12*b*, FIG. 12*c*, and FIG. 12*d* are a front cross sectional view of still other embodiment of the container.
FIG. 12*e* is side sectional view of the relevant part of the inner bag of the above container.
FIG. 12*f* is a front sectional view of the relevant part of the other embodiment of the inner bag used in the container.

In an aerosol container 70 in FIG. 12*a*, upper and lower chambers in an inner bag 12 has a different volume from each other, the upper chamber 27 has a larger volume than the lower chamber 26, and a volume ratio is about 4:1. Volumes of each chamber may be arbitrarily set based on volumes of contents to be charged, and on a ratio of desirable discharging amount. However, a volume ratio of upper and lower chambers is preferably 5:1 through 1:5 in consideration of ease of adjustment of a discharging amount ratio based on a length and a hole size of the channel or the passage. Moreover, in a middle part of the inner bag 12, a constriction part 71 smaller than a opening of the container 11 is provided. And a partitioning member 72 closely engaged with the constriction part 71 from upper side is attached in a perimeter of the dip tube 28. Thereby, the constriction part 71 may be closed by the partitioning member 72 without opening and closing action of the constriction part 71 itself. In this configuration, if the dip tube 28 is inserted and the constriction part 71 is closed by the partitioning member 72 after charging of the first contents A to the lower chamber 26 of the inner bag 12, the lower chamber 26 and the upper chamber 27 will be isolated. Subsequently, if the second content B is charged in the upper chamber 27, the first content A and the second content B will not be mixed. Therefore, this configuration also enables high-speed charging of the second content B, and provides a high working efficiency. In this embodiment, although the constriction part is narrowed in a tapered shape, it may have a valleys-and-peaks shape. A tapered shape, however, may realize easier insertion of the partitioning member. Moreover, in this aerosol container 70, the constriction part may be thicker than other parts of the inner bags, which further strengthens engaging between the partitioning member and the constriction part, and does not easily cause omission. Furthermore, preferably, vertical grooves (not shown) are preferably provided in a periphery surface of a chamber of the inner bag so that the inner bag may easily shrink, which may efficiently shrink the inner bag and may reduce a residual quantity of the contents after use.

In addition, a configuration may also be employable that the partitioning member 72 is constituted by elastic members, such as sponge and rubber materials, a through-hole 73 for letting the dip tube 28 pass is formed in a center portion being openable and closable, and isolation is always realized by elasticity of the elastic members. In that case, after charging of the first content A, only the partitioning member 72 is put into the inner bag 12, and then the constriction part 71 is closed, subsequently, the dip tube 28 is put into the inner bag 12, after charging of the second content B into the upper chamber 27, and then may be inserted into the through-hole 73 of the partitioning member 72. And in this case, since the valve 13 equipped with the dip tube 28 may be crimped to the container 11 after the charging of the contents, almost same operations as usual may be done, and a high working efficiency may be realized. Moreover, the constriction part 71 is set smaller than an opening of the container 11 in order to make insertion of the partitioning member 72 from the opening easier, and a size of the constriction part 71 is not particularly limited, when the partitioning member 72 is constituted with flexible materials, such as sponge. Further, an O-ring may be provided inside of the constriction part, or outside of the partitioning member. This will increase sealing state between the upper and lower chambers, and preferably further prevents mixing of the contents in the upper and lower chambers within the inner bag. In addition, some elastomer may be arranged from exterior toward inside of the constriction part. Furthermore, a step or a level difference may also be arranged at the constriction part and the partitioning member. Thereby, the constriction part and the partitioning member are clipped and fitted in. Also in this case, sealing state between the upper and lower chamber increases, and a same function as in the above-mentioned embodiment may be demonstrated. Especially, when a thickness of constriction part is increased, separation of the clip fitting is hard to occur, which is preferable.

An aerosol container 75 in FIG. 12*b*, upper and lower chambers of the inner bag have different volumes from in FIG. 12*a*, and a lower chamber has a larger volume than an upper chamber. Moreover, except for a partitioning member 72 being provided with a shape of a stopper body that fits in deeply in a constriction part 71, this container has a same configuration as in the aerosol container 70 in FIG. 12*a*. This has a high sealing property between a lower chamber 26 and an upper chamber 27. In other points, same operational advantage will substantially be demonstrated as in the aerosol container 70 in FIG. 12*a*.

An aerosol container 75*a* in FIG. 12*c* has a dip tube 28 having a length reaching to a partitioning member 72, and an engaging member 74 for making insertion of the dip tube 28 to a valve easier. The engaging member 74 is attached to the housing, and it has a cylindrical form, and a lower opening where the dip tube is to be inserted has a form currently opened downward in a tapered shape. When a valve is put on the container opening in manufacturing process of the aerosol product, this guides a tip of the dip tube to a loading slot of the engaging member 74, and ease the insertion of the dip tube to the valve. Also, the partitioning member and the dip tube may be highly adhered with a sealing material beforehand. As shown in an imaginary line shows, the engaging member 74 may be engaged with the inner bag, which may thoroughly isolate contents in the upper chamber from the valve. This configuration may be preferably used, when the contents in the upper chamber has a high corrosion behavior over the mounting cup.

Although in the aerosol container 70 in FIG. 12*a*, the aerosol container 75 in FIG. 12*b*, and the aerosol container 75*a* in FIG. 12*c*, the dip tube 28 is directly inserted in the partitioning member 72, the partitioning member 72 and a lower end of the housing 46 of the valve may be closely connected, by a tube 28*a* having a larger thickness than the dip tube 28, as in an aerosol container of 12*d* in FIG. 75*b*, and then the dip tube 28 may be inserted into it. In this case, whole of the partitioning member 72 and the tube 28*a*, or a tube 28*a* itself having a thick part whose lower end is fitted into the constriction part 71 makes a substantial partitioning member. Thus, use of the thick tube 28*a* arranges the top end near an opening of the inner bag 12, and thus makes insertion of the dip tube 28 easier. Moreover, the thick tube 28*a* may be extended to a vicinity of a bottom of the inner bag, as shown in imaginary line. A top end of the tube 28*a* may be attached in periphery of a lower end of a valve housing. In that case, in accordance with the communication hole 48 provided in a side wall of the housing 46, a cut is provided in the tube 28*a* near a top end of the tube 28*a*.

Besides, as shown in FIG. 12*f*, a configuration may also be employable that a thick part 71*b* is provided in the dip tube 28 itself, the thick part is inserted in the constriction part 71, and thereby upper and lower chambers are mutually isolated. In this case, the dip tube 28 itself serves as a partitioning member. Also, in any case of FIG. 12*a* through FIG. 12*d*, it is preferable that a lip-seal 71*a*, as shown in FIG. 12*e*, is prepared in the constriction part 71. A still more advanced sealing property may be realized between upper and lower chambers in these cases. In addition, the lip-seal 71*a* may be prepared in the partitioning member 72 side. In FIG. 12*c*, same lip-seal 71*a* may be prepared in the tube 28 or in the engaging member 74, and thereby sealing property between the engaging member 74 and the tube 28 may be improved.

Figure 13:
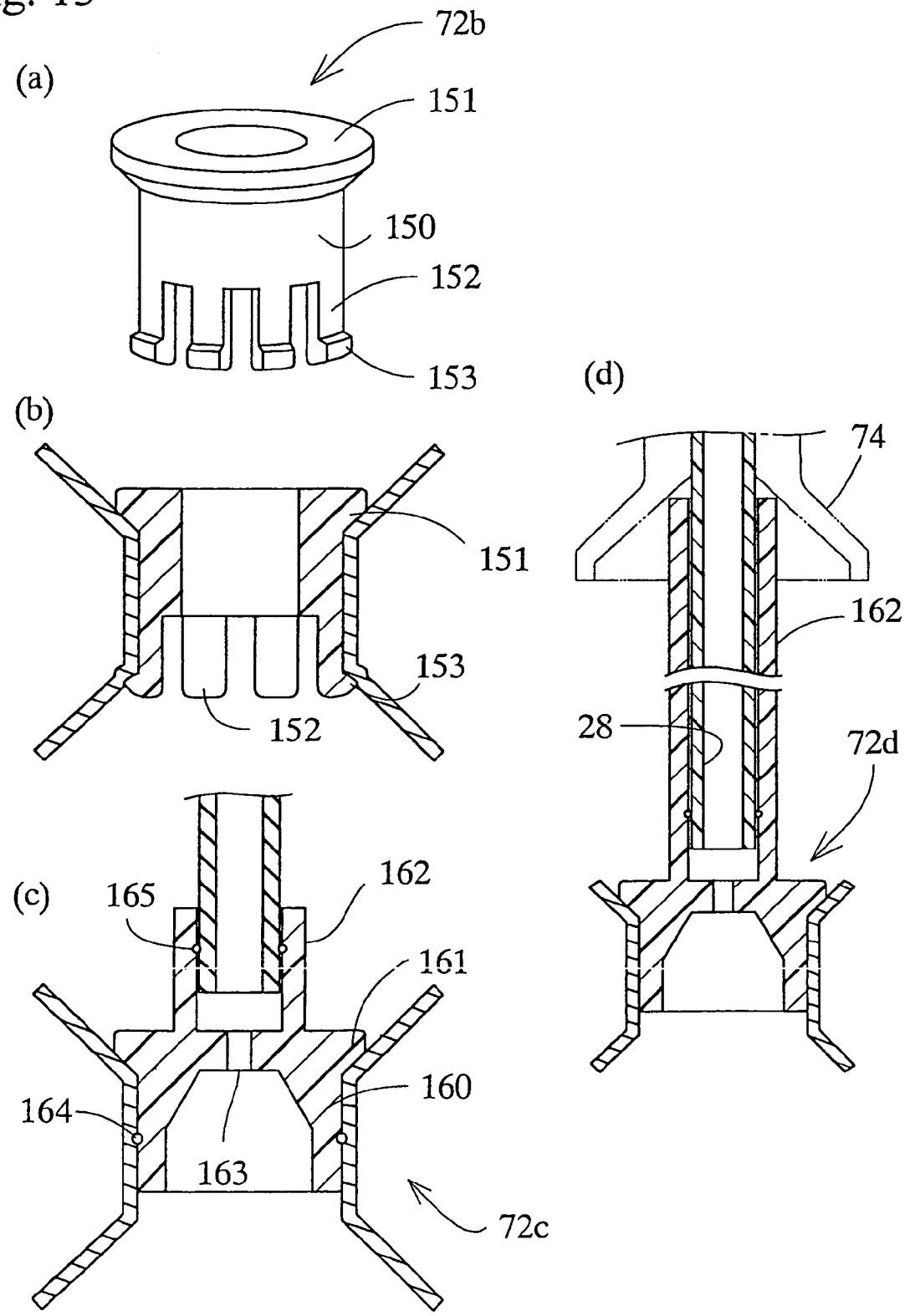
FIG. 13*a* is a perspective view of the first embodiment of the partitioning member used in the container.
FIG. 13*b* is a front cross sectional view thereof.
FIG. 13*c* and FIG. 13*d* are a front sectional view of the other embodiment of the partitioning member used in the container.

Additionally, partitioning members 72*b*, and 72*c* as shown in FIG. 13*a* and FIG. 13*c* may also be used. A partitioning member 72*b* in FIG. 13*a* comprises a cylindrical body 150; a flange part 151 currently formed in an upper part of the body in a tapered shape; and legs 152 that are cylindrically located in a line on a lower side face of the body at a predetermined spacing, and that has hook parts 153 projecting outside in a radial direction at the end. The legs 152 are located in a line cylindrically, so it has elasticity in a radial direction, and thereby, clip fitting of the leg 152 is realized to a lower part of the constriction part of the inner bag. Therefore, the fixing of the partitioning member 72*b* is supported by the constriction part, legs 152, and the flange part 151. That is, in a state of the dip tube is inserted, a lower chamber of the inner bag will be thoroughly sealed except for a channel of the dip tube when the partitioning member 72*b* is made to fit in. As an inner bag to be engaged to such partitioning member 72*b*, a flange for enabling engaging with a hook part of the partitioning member may be provided in a lower part of the constriction part of the inner bag (refer to FIG. 13*b*). Furthermore in the embodiment, a body of the partitioning member 72*b* has a cylindrical form, but it may have a form of tapered truncated cone being thinned downward. In that case, an inner surface of the constriction part of the inner bag is also set so that it may have a tapered form having a same inclination, which makes a small clearance between the constriction part and the partitioning member, and strengthens more sealing state between the upper and lower chambers of the inner bag.

The partitioning member 72*c* of FIG. 13*c* comprises a cylindrical body 160 having a bottom; a flange part 161 formed in an upper part of the body in tapered shape; and a cylindrical engaging member 162 projecting from a top face of the body and fitting in freely slidable state with a lower end of the dip tube. Further, a communication hole 163 in communication with an inside of the engaging member 162 is provided in a center of a top face of the body. The body has an O-ring 164 in a center of a periphery surface, and an inner surface is closed in a tapered shape toward the communication hole 163. This O-ring 164 seals an area between the constriction part of the inner bag, and the partitioning member 72*c*. Thus, the partitioning member 72C is fixed in an upper direction with the O-ring 164, and is fixed in a downward direction with the O-ring 164 and a flange part 161. Moreover, since an inner surface of the partitioning member is closed in a tapered shape, a flow of the contents becomes smooth and clogging caused by them may be prevented. Although the O-ring is used as a seal between the constriction part and the partitioning member in the embodiment, a projection projected outside on a side face of a periphery of the partitioning member in a radial direction and/or a projection projected inward on an inner surface of the constriction part of the inner bag in a radial direction may be provided. Furthermore, a metal ring may be provided to crimp from outside of the constriction part of the inner bag.

The engaging member 162 fixes a lower end of the dip tube 28, and has an O-ring 165 inside, and this provides sealing while allowing movement in an axial direction between the dip tube and the partitioning member. The dip tube used for this partitioning member 72*c* has a length from a valve to the partitioning member. Furthermore, in this engaging member, the dip tube is equipped with a clearance between a tip of the dip tube and a top face of a body of the partitioning member, so that dip tube will be able to move vertically. Accordingly, the dip tube may not be disconnected even if a force applied to the inner bag deforms the inner bag when contents are charged into the inner bag using this partitioning member 72*c*, and even if an impact is applied to the container when dropped during the transportation or in use in which the inner bag having flexibility expands and contracts up and down. Further, the dip tube is supported and the dropping of the dip tube to the lower chamber will be prevented even when engagement between the dip tube and the valve is weakened, such as in the case where the dip tube is deteriorated by the contents to result in expansion. Furthermore, gas accumulated between the partitioning member and the lower chamber at the time of charging of the contents may be removed by opening the valve.

Moreover, the engaging member 162 may be projected high from the body 160 in a shape of a chimney, like the partitioning member 72*d* shown in FIG. 13*d*. In this engaging member 162 (inside the chimney), the dip tube 28 is freely slidable. The dip tube 28 may be engaged to the engaging member 162, so the position of the valve attached to the top of the dip tube will be set in the position higher than a opening of the container. This will allow easier charging of the contents.

Furthermore, a tip of this engaging member 162 may be directly contacted to a lower part of the valve housing. Thereby, when the valve is fixed, the valve presses the partitioning member 72*d* via the engaging member 162, which will prevent omission of the partitioning member 72*d* from the constriction part. In addition, as shown in imaginary line, same effect as in a case of an aerosol container having an engaging member 74 may be obtained. Also, a tip of an engaging member 162 may be directly inserted into an engaging member 74 without use of a dip tube.

Figure 24:
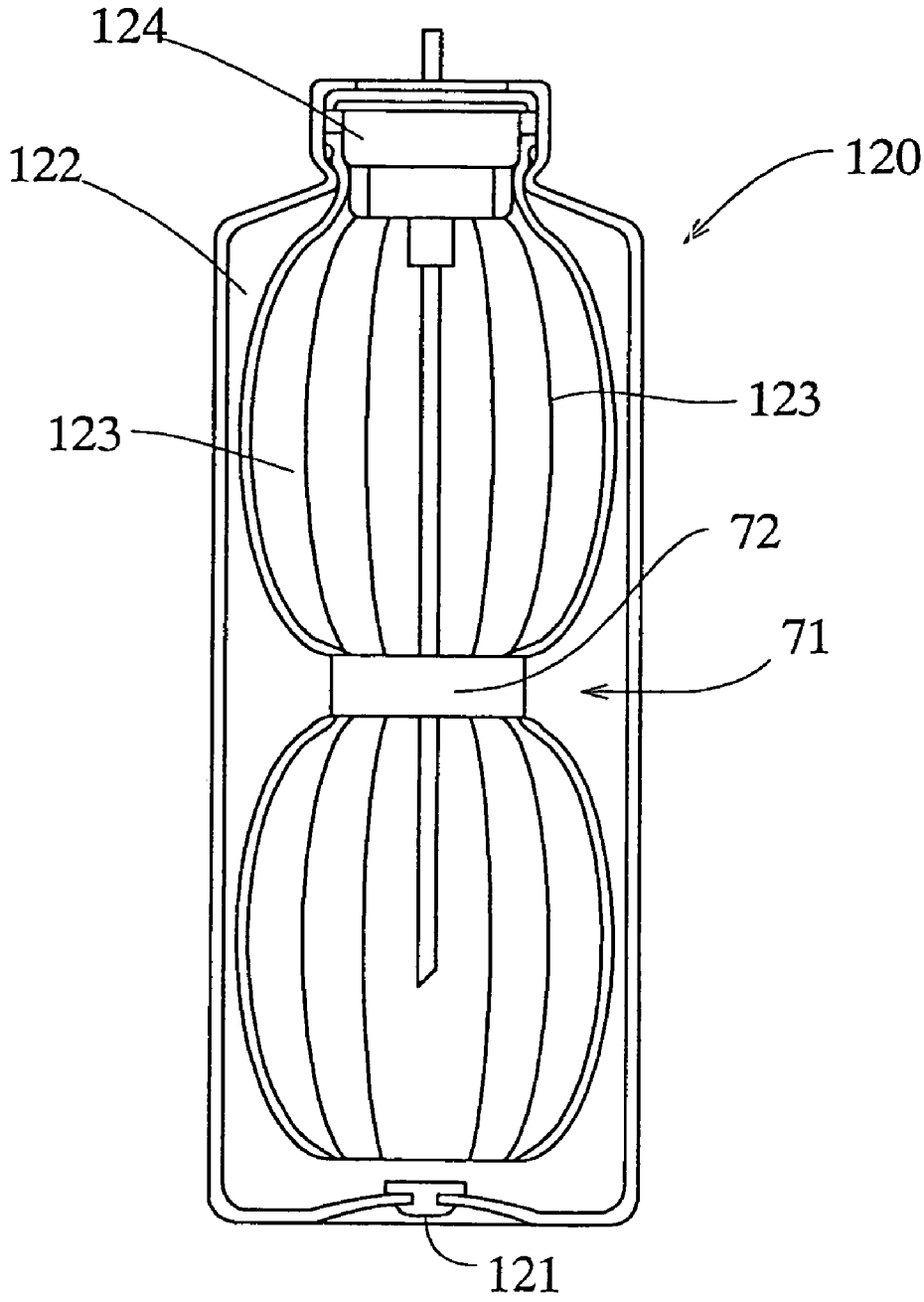
FIG. 24 is a front cross sectional view of yet other embodiment of the container.
Figure 33:
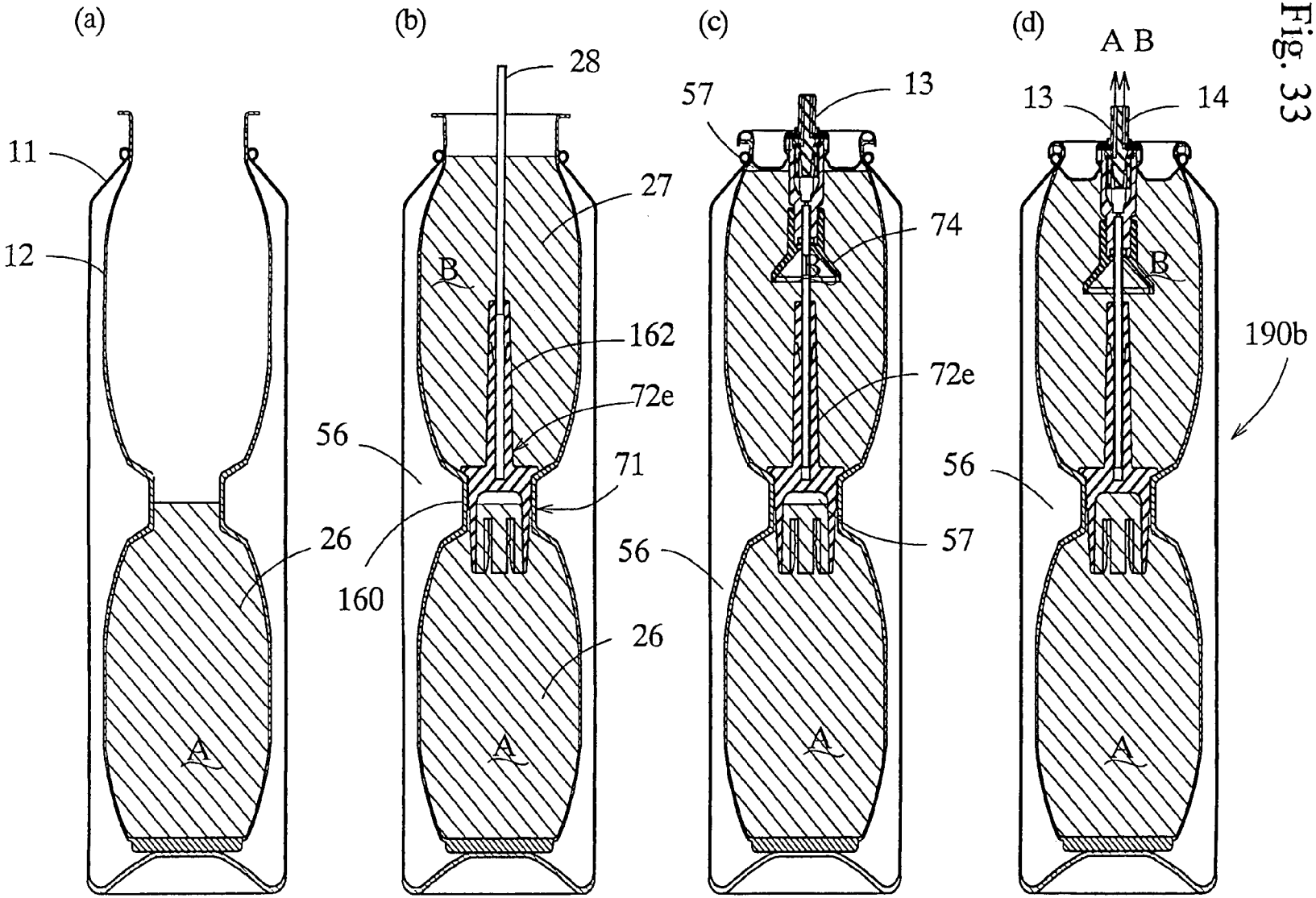
FIG. 33*a* to FIG. 33*d* are a front cross sectional view of the yet other embodiment of the container showing manufacturing method.

Here, FIG. 33 shows a method for manufacturing an aerosol product 190*b* having a partitioning member 72*e* whose engaging member 162 is projected high from a body 160 like a partitioning member of FIG. 13*d*. First, a content A is charged into a lower chamber from an opening of an inner bag 12 inserted in a container 11 (FIG. 33*a*). At this time, an inner bag 12 beforehand charged with a content A may be inserted into a container 11. Subsequently, a partitioning member 72*e* equipped with a dip tube is inserted in a constriction part 71 of the inner bag, and then a content B is charged into an upper chamber 27 (FIG. 33*b*). Here, a lower end (an engaging member 74) of a valve 13 is contacted to a tip of the dip tube 28, the valve 13 is placed, while pushing down the dip tube 28 until a state is realized where under cup charging of a pressurizing agent is enabled (FIG. 33*c*). Furthermore, air in a space 56 between the container 11 and the inner bag 12 is removed by vacuumizing, or gas flushing, etc. Thus, removing of residual air in the space 56 prevent reaction between the contents and residual air, and improve stability of the contents. Subsequently, a pressurizing agent is charged into the space 56 and the valve 13 is fixed. In addition, when a bottom of the container has a gas charging valve 121 as shown in FIG. 24, a pressurizing agent may be charged after fixation of the valve. Finally, a stem 14 is pushed down, the valve 13 is opened wide, and a gas 57 mixed in the upper and lower chambers 27 and 26 at the time of charging of the contents is removed (FIG. 33*c, d*). Thus manufactured aerosol product 190*b* will prevent activated discharge of the contents accompanied by mixing with gas at the time of beginning of use. Moreover, this may control a residual oxygen concentration in the aerosol product no more than 1%, and preferably no more than 0.1%. This prevents reactions of the container and the oxygen, even if the contents have reactivity with the oxygen, realizing stable preservation over a long period of time.

Figure 34:
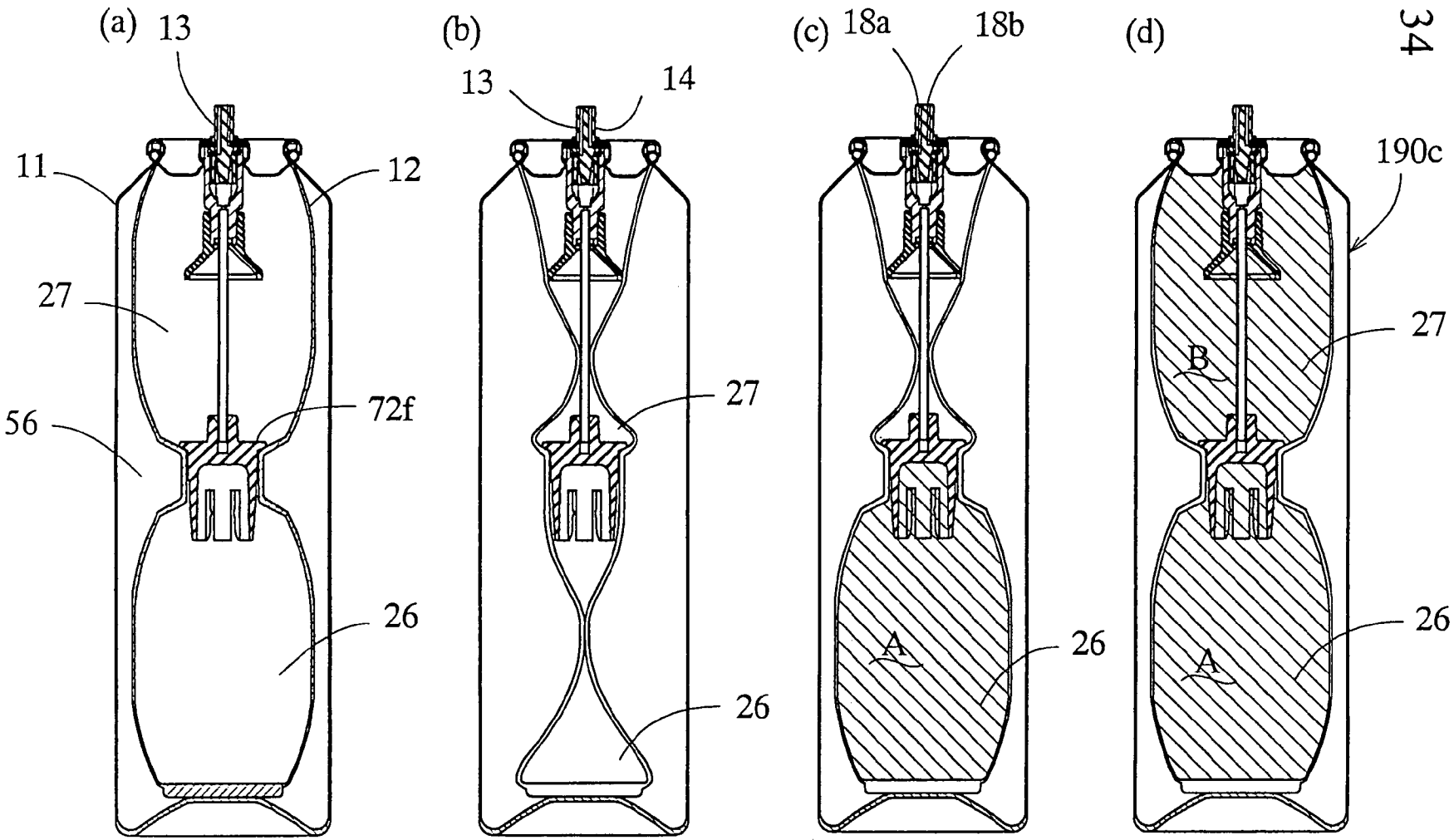
FIG. 34*a* to FIG. 34*d* are a front cross sectional view of yet other embodiment of the container showing manufacturing method.

In addition, FIG. 34 shows other method for manufacturing an aerosol product 190*c* having of partitioning member 72*f*. In the aerosol product 190*c*, there is provided a configuration that enables discharging, avoiding for contents in upper and lower chambers mixed together within a valve 13 like the valve 13*b* shown in FIG. 5. Here, description will be given using a valve 13*b* in FIG. 5. In a method for manufacturing the aerosol product 190*c*, a valve 13*b* is placed without charging of contents, air in a space 56 between a container 11 and an inner bag 12 is removed, a pressurizing agent is charged into a space 56, and then the valve 13*b* is fixed (FIG. 34*a*). Here, a stem 14 is pushed down, the valve 13 is opened, and air in the upper and lower chambers 27 and 26 is removed (FIG. 34*b*). Subsequently, a content A is charged into the lower chamber 26 from one passage 18*a* of the valve 13*b* with the other passage 18*b* of the valve 13*b* closed (FIG. 34*c*). Next, a content B is charged into the upper chamber 27 through the passage 18*b* of the valve 13*b* with the passage 18*a* of the valve closed (FIG. 34*d*). An order of the charging of these contents A and B may be reversed. Such a method for manufacturing an aerosol product 190*c* is preferable, because the contents A and B can be charged without contacting with air. In addition, as described in FIG. 33, when a bottom of the container has a charging valve 121, charging of a pressurizing agent may be performed after fixation of a valve, or may be performed after charging of the contents to each chamber. Moreover, when a valve of a structure having a space between a mounting cup, and a periphery surface of a housing is used, a clearance is formed between a stem rubber and a mounting cup with bending of a stem rubber caused by a pressure power, and then contents may be charged into an upper chamber from a periphery of a stem through the clearance.

Figure 35:
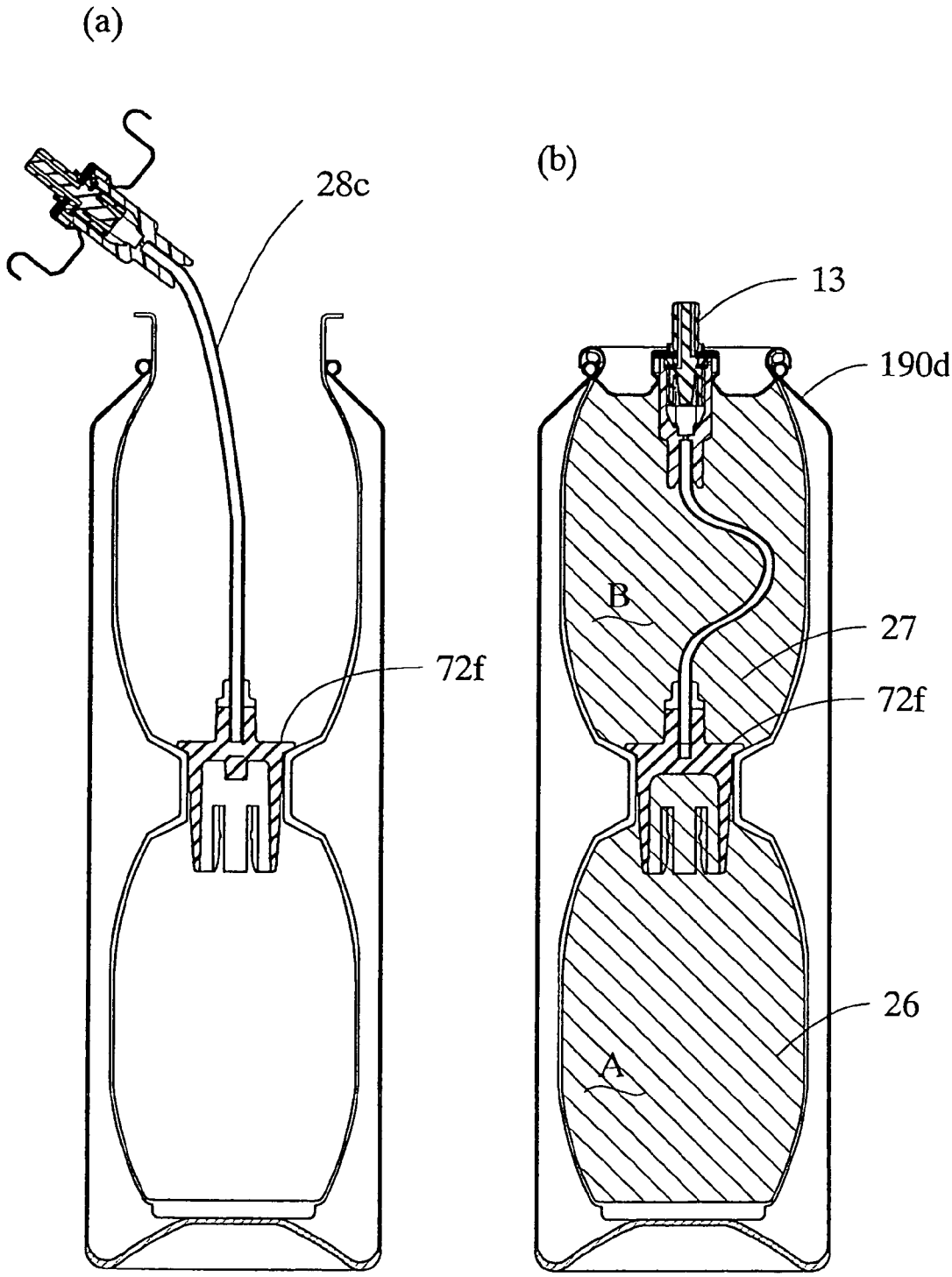
FIG. 35*a* and FIG. 35*b* are a front cross sectional view of yet other embodiment of the container.

FIG. 35 shows an aerosol product 190*d* in which a partitioning member 72*f* and a valve 13 are connected by a tube 28*c* having flexibility. The tube 28*c* having flexibility here has a sufficient length after the valve 13 is fixed, it may bend within an upper chamber 27 like shown in FIG. 35. In the aerosol product 190*d*, a constriction part 71 of an inner bag may be equipped with the partitioning member 72*f* (FIG. 35*a*) in a state where a top end of the tube 28*c* and valve 13, and a lower end of the tube 28*c* and the partitioning member 72*f* are attached, respectively. That is, since a lower end of the valve does not need to be contacted nor engaged to a tip of a dip tube during the placement of the valve, which will make the installation of the valve easier. Furthermore, when contents are charged into an upper chamber, As shown in FIG. 35*a*, the tube is bent and the valve is shifted from an opening of the inner bag, so that the charging of contents becomes easier.

An aerosol container shown in FIG. 14*b*, comprises a container 11*a*; an inner bag 12 that has a constriction part 71 in a body and an expandable cornice 194 provided in a neck part; a partitioning member 72 that has an engaging member 162 equipped with a constriction part 71 of the inner bag, that isolates a lower chamber 26 and an upper chamber 27, and that has a tapered inner surface of a top end; and a discharging member 190*a* equipped with a valve. The aerosol container 190 further comprises an engaging member 74 allowing easier insertion of a dip tube 28 into the lower part of the housing of the valve 13, and other configurations are substantially same as in the aerosol product 75*a* shown in FIG. 12*c*.

A container 11*a* has a same top end as in the container 11 of FIG. 10*a* in which extends upwards and a depressed groove is formed at in some down side to the top end in a radial direction. The container 11*a* is long and slender.

The partitioning member 72 has a through-hole 73 so that the dip tube 28 may be inserted to penetrate through the partitioning member. A lower end of the dip tube 28 passes through the through-hole 73, and is located in the lower chamber 26 after the charging (FIG. 14*b*).

The engaging member 74 comprises cylinder part 197 that closely attached to the periphery of the dip tube engaging part of the lower part of the housing; and tapered part 198 that expands downwardly from the bottom end of the cylinder part to the bottom, and the inner surface of the tapered part forms insertion part 193 having praboloid of revolution. Therefore, the tip of the dip tube equipped beforehand to the partitioning member abuts with the inserting part 193 of the engaging member 74, just only by placing the valve to the opening of the container at the processing of the aerosol product. As a result, the process to attach the dip tube to the valve 13 will be eased.

The discharging member 190*a* has a means to mix the contents discharged from the valve and the inside channel or passage of the discharging member has a configuration of helix mixer. Thus, the contents mixed in the valve will be mixed equally within. As for the discharging member a discharging member shown in the Japanese Unexamined Utility Model Publication No. 64-25357 and Japanese Unexamined Utility Model Publication No. 04-100483 may be used.

Figure 14:
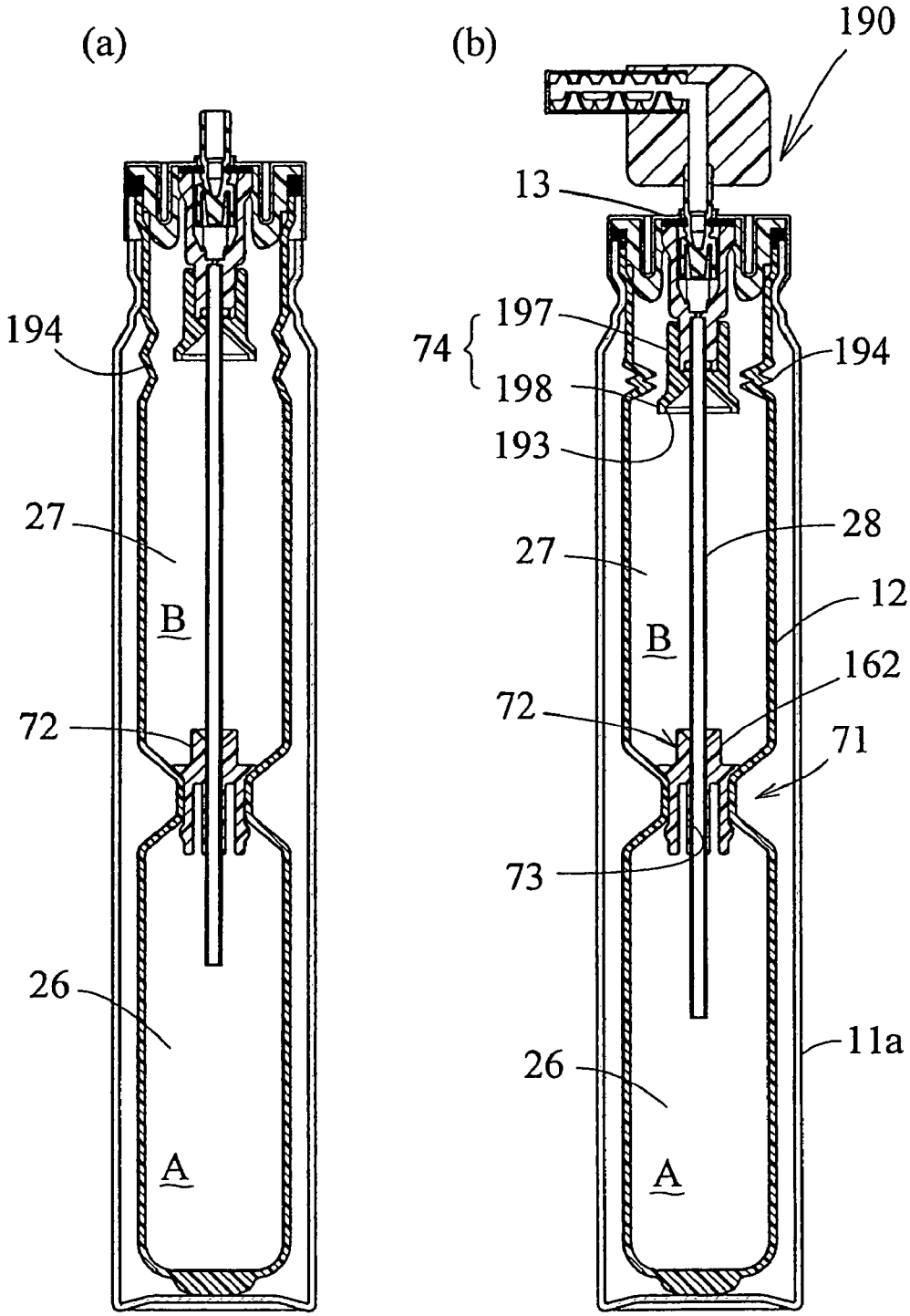
FIG. 14*a* and FIG. 14*b* are a front cross sectional view of the yet other embodiment of the container showing the state of before and after charging respectively.

A method for manufacturing the aerosol product 190*a*, a content A is charged into the lower chamber 26 from the opening of the inner bag 12 inserted into the container 11*a*. Next, the partitioning member 72 equipped with the dip tube 28 is inserted into the constriction part 71, and a content B is charged into the upper chamber 27. Further, the valve 13 equipped with engaging member 74 is attached to the dip tube 28, a compression air or the kind is charged into the space between the container and the inner bag by method of undercup charging (FIG. 14), and a cover of the valve is crimped with the inner bag 12 being pushed inside the container and fixed to the depressed groove of the container. When the valve is fixed, the location of the top of the inner bag lowers compare to the time of charging contents (FIG. 14*b*). The aerosol product is easily manufactured because the inner bag has the cornice part that enables the expansion and contraction of the inner bag 12 in axial direction. In addition, the contents can be charged safely into the upper chamber without inserting into the dip tube, when the partitioning member that can be penetrated by dip tube is used. It enables the top of the dip tube to set higher than the opening of the inner bag.

Figure 15:
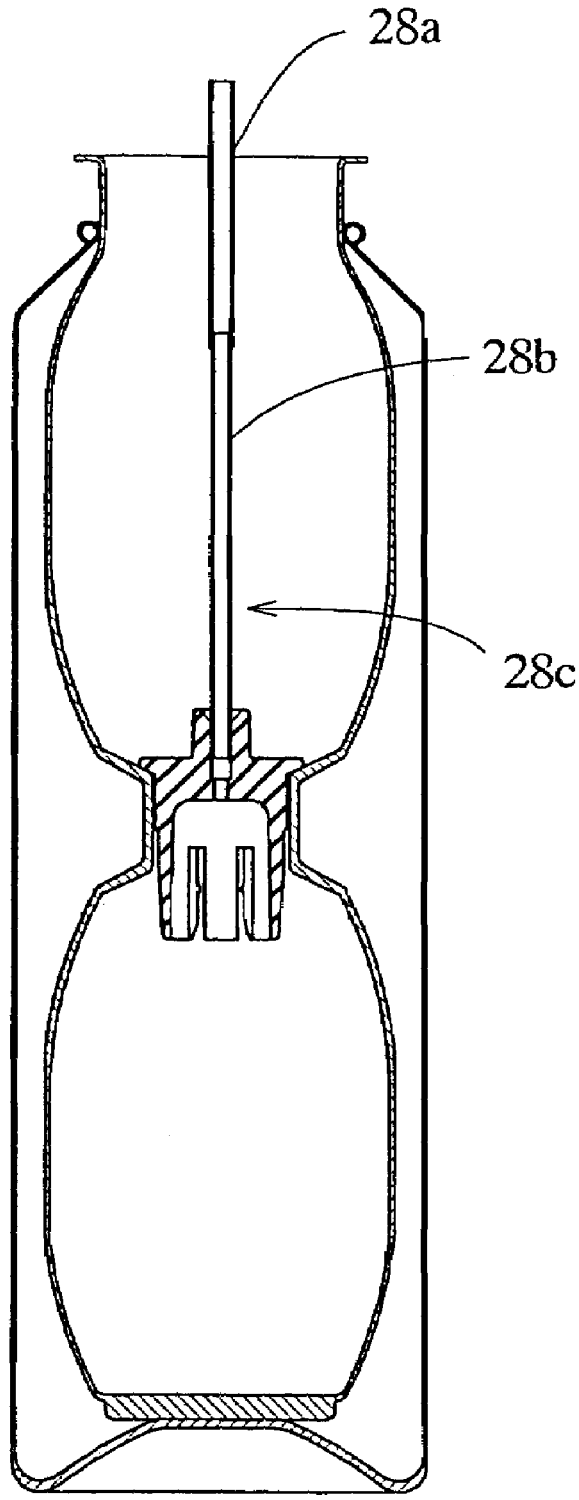
FIG. 15 is a front sectional view of the still other embodiment of the container.

The aerosol container product 180 shown in FIG. 15 is provided with a dip tube 28*c*, and other configuration are substantially same as the aerosol container 1.

The dip tube 28*c* is composed of two tubes 28*a*, 28*b* having different diameter and the thin diameter tube is inserted into in the large diameter tube. The inner diameter of the thick tube 28*a* is made to be practically same as the outer diameter of the thin tube 28*b*, and the thin tube 28*b* is longer than the thick tube 28*a* where the length of the thick tube 28*a* is same as the distance between the dip tube engaging part 55 and the engaging part 162 of the partitioning member 72 in the condition that the valve 13 is crimped.

Figure 16:
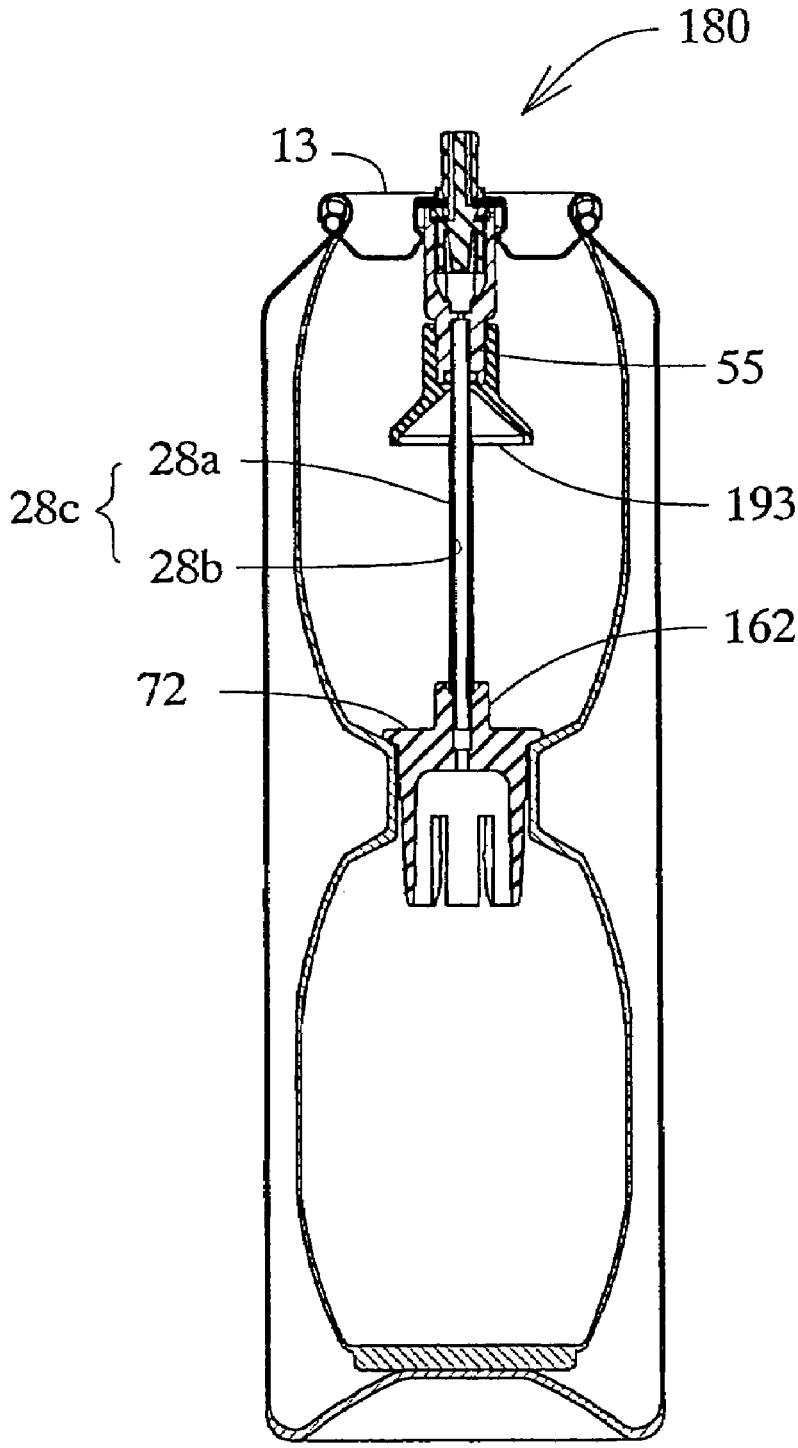
FIG. 16 is a front sectional view of the container of FIG. 15 showing the state before charging the contents.

The manufacturing method of the aerosol product 180, first the content A is charged in the lower chamber, the partitioning member72 equipped with the dip tube 28 is inserted into the constriction part of the inner bag, and the thick dip tube 28*a* is extended so that the upper end protrudes higher than the opening of the inner bag (FIG. 16). The content B is charged, the valve is mounted, the dip tube 28*c* is retracted so that the thin tube 28*b* protrudes from the upper end, and the dip tube engaging part 55 and the dip tube 28*c* (practically the thin dip tube 28*b*) is engaged (FIG. 15). After that, a propellant is charged and the mounting cup is crimped. In this condition, the each ends of the thin tube 28*b* mates with the dip tube engaging part 55 of the valve and the engaging part 162 of the partitioning member 74. The each ends of the thick tube 28*a* mates with inside of the insertion 193 of the partitioning member 74 and the upper end inner surface of the engaging part 162 of the partitioning member 74. Thus the thin tube 28*b* practically serves as a dip tube of the aerosol product. The thick tube 28*a* serves as a guide in assembling and prevents the contact between the content B in the upper chamber and the content A in the thin tube 28*b* to make the content more stable.

In this embodiment, the case that the thin tube is longer than the thick tube is described, however the thick tube may be longer than the thin tube. In this case, when the valve is crimped, the each ends of the thick tube engage with the dip tube engaging part 55 of the valve and the engaging part 162 of the partitioning member, and the thick tube serves practically as a dip tube of the aerosol product.

Figure 17:
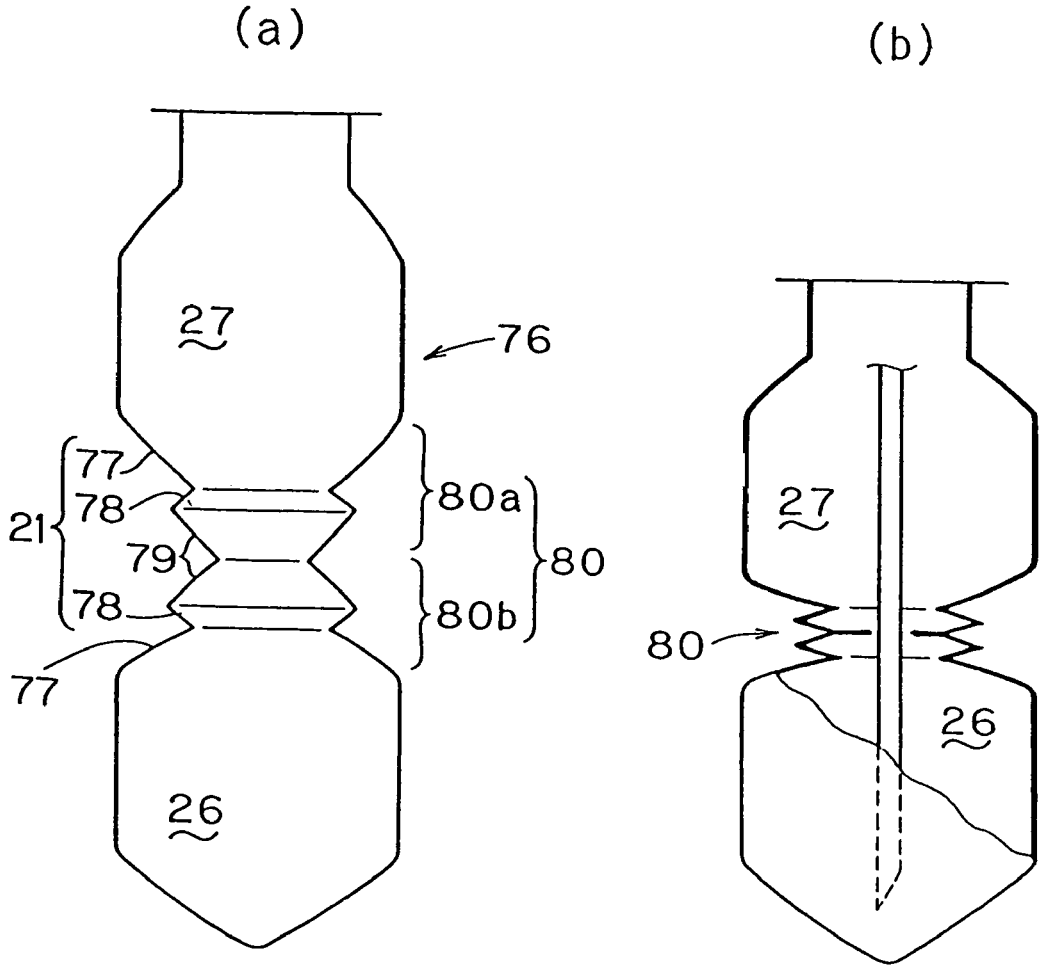
FIG. 17*a* is a front view of the other embodiment of the inner bag showing the state of the inner bag being extended.
FIG. 17*b* is a front partially sectional view of the inner bag showing the state of the inner bag being contracted.

The inner bag 76 shown in FIG. 17*a* has a center part 21 of cornice that can expand and contact in up and down direction. In other words, the first truncated cone 77 closing downward continues to the lower end of the cylindrical wall of the upper chamber 27, the second truncated cone 78 expanding outward and facing downward continues to the lower end of the first truncated cone via the fold line of a valley fold. Further, the third truncated cone 79 closing downward continues to the lower end of the above cone via the fold line of a mountain fold. Similarly, at the upper end of the cylindrical wall of the lower chamber 26, half of the cornice 80*b* is formed which is turned half of the cornice 80*a* composed of the above first, second, and the third truncated cone 77, 78, 79. Thereby forming one cornice 80 as a whole continuing the upper half cornice. The width of the first truncated cone 77 and the third truncated cone 79 is preferable to be wider than that of the second truncated cone 78.

The inner bag 76 composed as above has a wide area of the opening which is surrounded by the fold line 81 of valley fold that continues the upper and lower half of the cornice 80*a* and 80*b*. In other words, the fold line 81 that continues the third truncated cone 79 each other, in the condition extended upward and downward as shown in FIG. 17*a*. When the inner bag is retracted up and down as shown in FIG. 17*b*, the fold line 81 is pushed inside making the surrounded area of the opening small. Accordingly, the same action as the inner bag 12 in FIG. 2 is obtained. In addition, as shown in FIGS. 12*a* and 12*b*, the partitioning member 72 can be simultaneously used. Further, the cornice 80 is not limited to be circular and can be rectangular in cross section.

Figure 18:
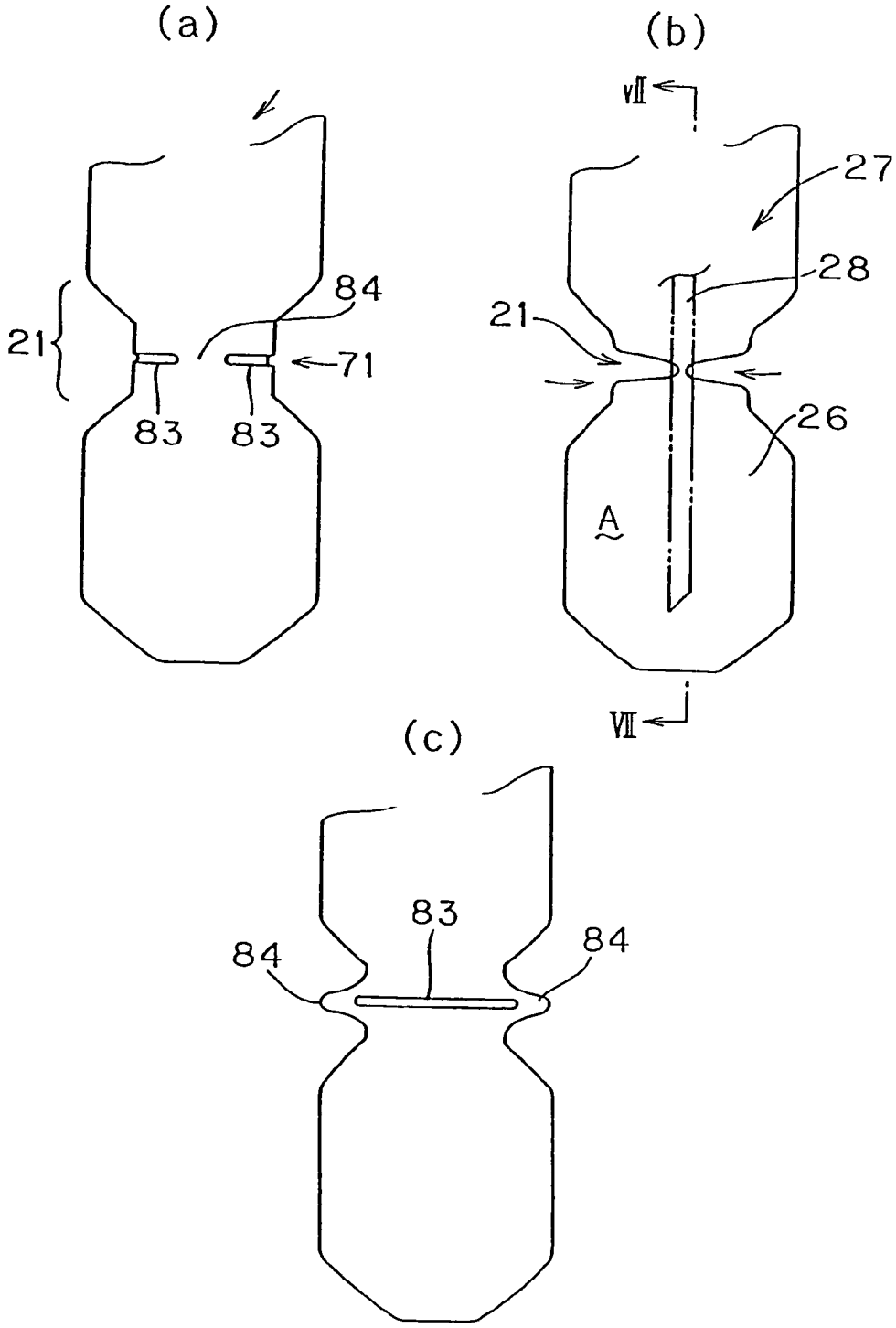
FIG. 18*a* is a front view of the yet other embodiment of the inner bag showing the state of the inner bag being extended.
FIG. 18*b* is a front partially sectional view of the inner bag showing the state of the inner bag being contracted.
FIG. 18*c* is a cross sectional view of VII-VII line of FIG. 18*b*.

The inner bag 82 shown in FIG. 18*a* is provided with a cylindrical constriction part 71 at the center part 21, and at its center a semicircular thin or thick fold line 83 is formed. In this embodiment, the fold line 83 is discontinued at the two facing parts 84 of front side and rear side. When this inner bag 82 is used, the middle of the constriction part 71 is squashed left and right along the fold line 83 after the first content A is charged in the lower chamber 26, as shown in FIG. 18*b*. Thus, the communication between the upper and lower chamber 27,26 is blocked off. In the squashing, the discontinued part 84 of the fold line is less flexible, therefore the squashing begins at this point and goes on along the fold line 83. Resultantly, as shown in FIG. 18*c*, the discontinued part 84 expands in crosswise direction. This squashed condition can be maintained by applying a force in up and down direction. The dip tube 28 can be inserted before the squashing or direct after the squashing, or after that the content B is charged in the upper chamber 27. In the latest case the dip tube can be inserted by unclenching.

It is possible not to provide the constriction part 71 and provide only the fold line 83. However in this case the discontinued part of the fold line 84 protrudes outward (see FIG. 18*c*), causing the possibility to strike the inner surface of the outer container 11. Therefore it is preferable to provide the constriction part 71 to limit the projection within a given range. Further, in both cases that constriction part 71 is provided or not provided, the fold line 83 can be omitted. However, the provision of the fold line 83 brings smooth squashing and stables the condition after squashing.

In the case of FIG. 18*a*, a cylindrical part is provided in the midstream of the constriction part 71, but as the center part shown in FIG. 10, the cross section viewed from front or side of the constriction part can be V-shaped. In this case, its shape after squashing is distinct and stable. The constriction part 71 is usually provided with circumferentially equal intervals, but they can be provided unequally such as decentered in one side. In this case, when an up and down force is applied, a bending moment acts in the constriction parts and the inner bag is squashed naturally by buckling action. The cross section of the constriction part 71 viewed from the top can be made elliptical or rectangular with its dimension short in right and left in FIG. 18*a* and long in right and left in FIG. 18*b*. In this case, it can be smoothly squashed and this shape is stable after the squashing.

Figure 19:
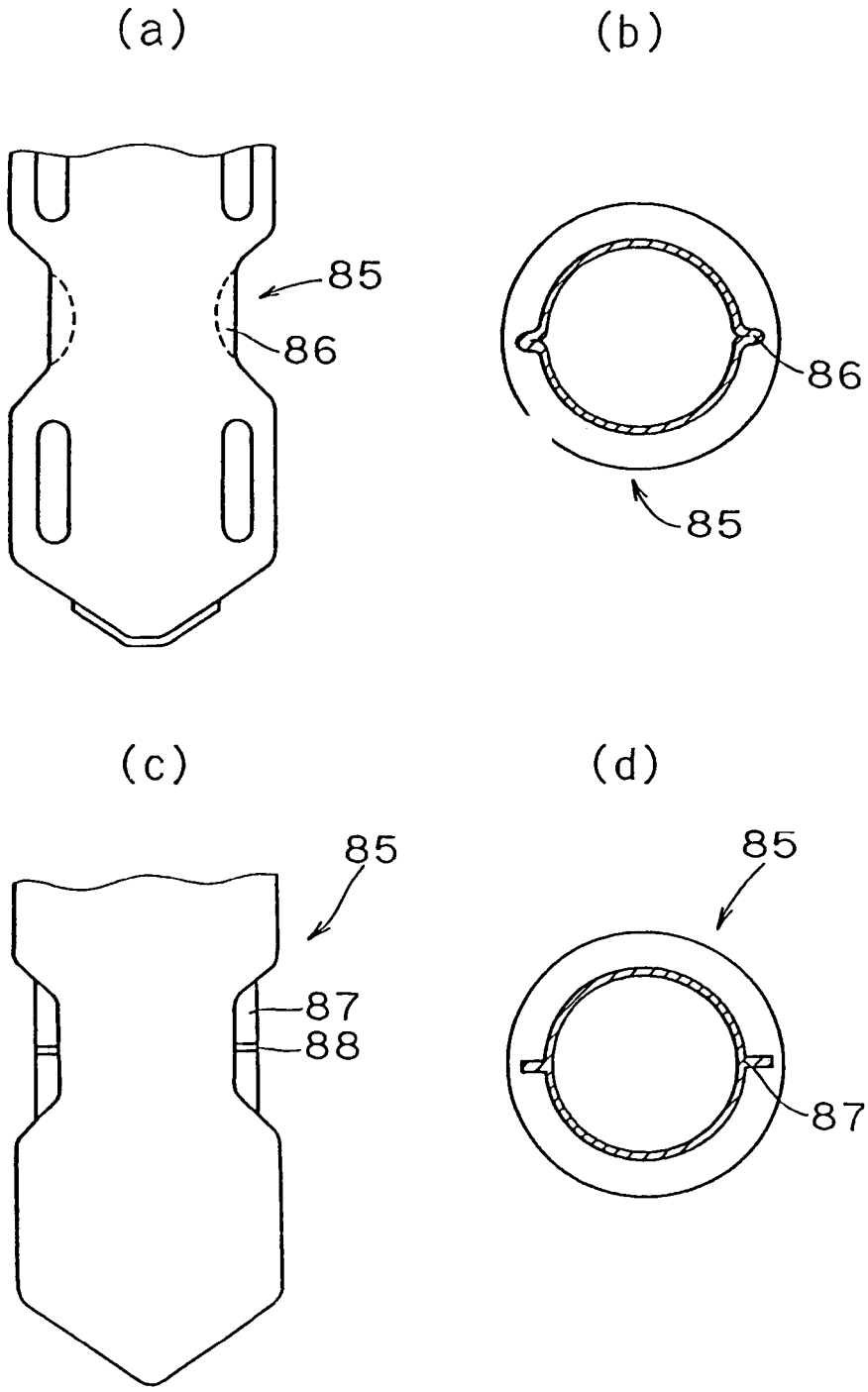
FIG. 19*a* and FIG. 19*b* a front view and a front partially sectional view of the relevant part of the yet other embodiment of the inner bag respectively.
FIG. 19*c* and FIG. 19*d* are 19*b* a front view and a front partially sectional view of the relevant part of the still other embodiment of the inner bag respectively.

Further in FIG. 18*b*, a concave groove can be provided on the one side wall of the squashed portion and a convex brace engaging with the concave groove can be formed on the other side to fit each other. In the case of FIG. 18*a*, the discontinued part 84 of the fold line 83 is provided to make it a starting point of squashing. But for example, as the inner bag 85 shown in FIG. 19*a* and FIG. 19*b*, it is possible to make it a starting point by picking a part 86 of the outside wall and to putting together by heat sealing. It is also possible to fold in and to put together by heat sealing. In any case, because the part 86 (a part of the outside wall) put together becomes a lengthwise rib to determine the direction of fold, it is smoothly folded. It is also possible to form an outward rib having arc cross-section or an inward rib. Further, as shown in FIG. 19*c*, FIG. 19*d*, a platy lengthwise rib 87 in the constriction part of the inner bag 85 is integrally formed and put together after forming. In this case, in the middle point of the lengthwise rib, a hinge 88 for a starting point of folding can be formed.

In any of the above embodiment, after squashing the center part after charging the first content, the squashed portion can be tightly put together by heat sealing, ultrasonic welding, high frequency induction welding, adhering by adhesive leaving the through hole for passing the dip tube. Thus the sealing property between the chambers becomes high. In any of the embodiment described above, number of the chamber is not limited to two and it can be three or more than four.

Figure 20:
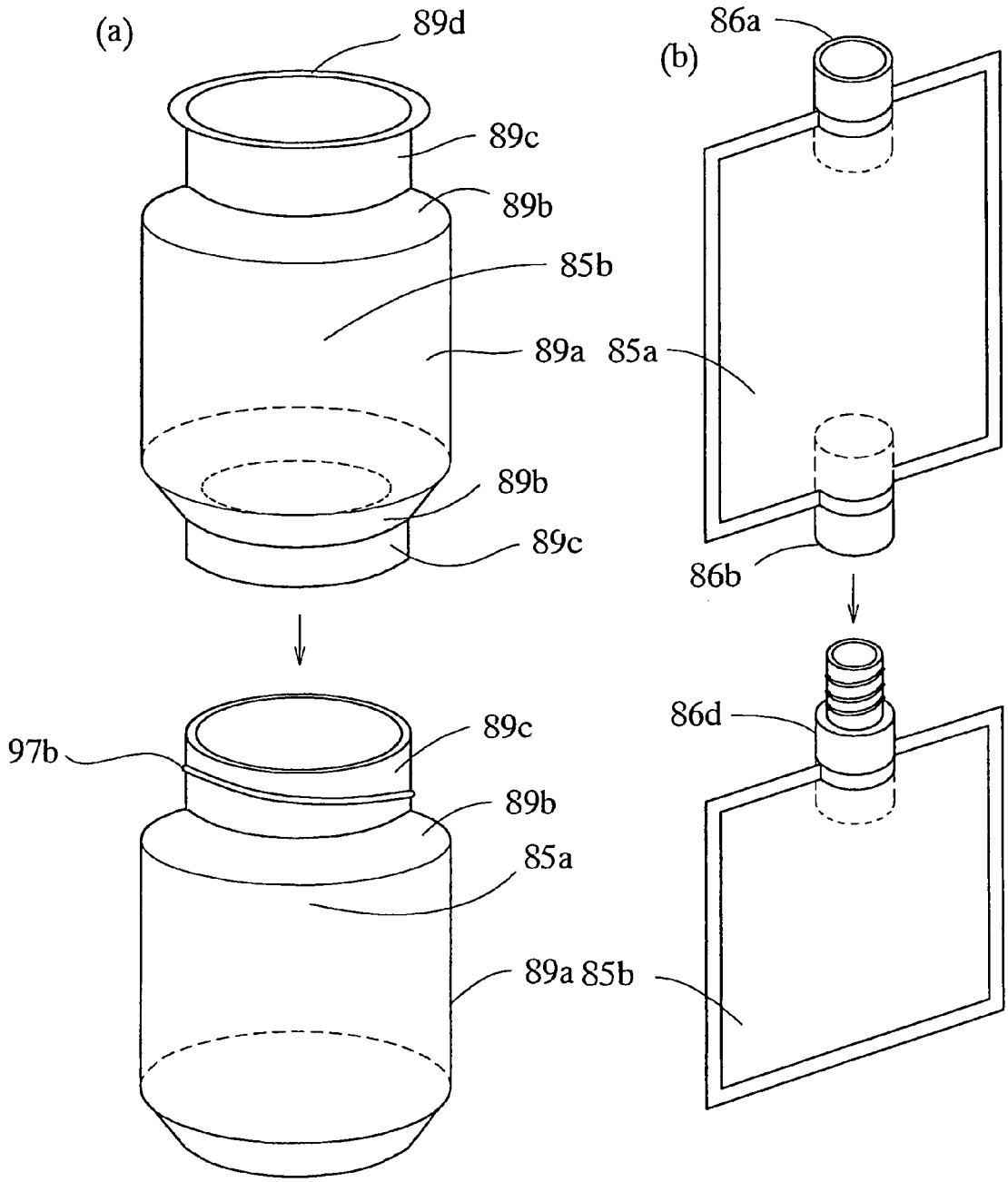
FIG. 20*a* and FIG. 20*b* are a perspective view of the yet other embodiment of the inner bag used in the container respectively.

In the inner bag shown in FIG. 20*a*, the upper and lower chamber is divided into the upper chamber member 85*b* and the lower chamber member 85*a*. The upper chamber member 85*b* is tubular having the body 89*a*; the shoulder part 89*b* extending in tapered shape from the upper and lower end of the body 89*a*; and the neck part 89*c* extending from those ends. Further a flange part 89*d* is formed on the upper end of the upper neck part and a female screw 98*a* is formed on the inside of the lower neck part. The lower chamber member 85*a* is tubular with having the body 89*a*; the shoulder part 89*b* extending in tapered shape from the upper end of the body; and a neck part 89*c* whose diameter is smaller than the body and extending upward from the upper part of the shoulder part, and a male screw 98*b* is formed on the outside surface of the neck part. The female screw 98*a* of the under neck part of the upper chamber member 85*b* and the male screw 98*b* of the neck part of the lower chamber member 85*a* can be connected and this screwing forms substantially one inner bag 85. Thus the connected point of the inner bag 85 corresponds to the constriction part. When the inner bag 85 is used as a container of this invention, the above described partitioning member can be used as a partitioning, but it is possible to use a thin film (not shown) such as aluminum foil or synthetic resin as a sealing at the contact face of the upper and the lower chamber member or opening of the under shoulder part of the upper chamber member. And furthermore, the upper chamber member 85*b* can be formed of cylindrical shape with bottom. Then, the contents are charged in the each chamber, and the upper and the lower chamber is connected to each other. After inserted into the outer container, the film is ripped or broken by the dip tube 28 at the time when the valve is mounted on the outer container to obtain the container of this invention. As a connecting means, screws are used here, but it is not limited to this. The diameter of the upper and lower openings can be made different so as to fit in. Further, fitting in of tapered surface into each other can be used. As such dip tube 28, the edge of the tube is preferable to be sharp so that it can break the film etc. easily. Without use of films, sealing of the upper and the lower chamber can be done using a dip tube 28 having practically the same outer diameter as the inner diameter of the connecting part.

The inner bag 85*d*, as shown in FIG. 20*b*, is made of metal such as aluminum. The inner bag 85*a* is composed of the upper and the lower chamber member 85*a* and 85*b* like the inner bag 85 of FIG. 20*a*. The upper and lower chamber members are formed by gluing aluminum sheet or laminated sheets of resin sheet and aluminum sheet together. The upper chamber member 85*a* is formed by tucking a cylindrical upper neck part 86*a* and a cylindrical lower neck part 86*b* with female screw with two aluminum sheets, and by gluing the edges together. The lower chamber member 85*b* is formed by tucking the cylindrical neck part 86*d* having male screws with aluminum sheets, and by gluing together. The inner bag 85*d* is formed by screwing in the under neck part 86*b* of the upper chamber member and the neck part 86*d* of the lower chamber member 85*b*.

As a charging method of the dispenser of this invention using this inner bag, the bottom is formed by affixing a thin film in the inside surface of the tapered under shoulder 89*b* of the upper chamber member 85*b*, the contents are charged in the upper and lower chamber through separate lines, and these chamber members are connected to be inserted into the outer container. Next, the valve with a dip tube is fitted on the upper neck part of the upper chamber member to break the film, a propellant is charged and the valve is fixed. Otherwise, the contents are charged into the lower chamber member 85*a* and the film is covered, the upper chamber member 85*b* is connected, the content is charged in the upper chamber member, the charged inner bag is inserted into the outer container, and the valve is inserted to charge the propellant. This method allows higher production speed. Further, long term stable storage of the contents may be achieved, because the material of the inner bag suitable for the contents can be used.

In the case that the film is not used and the upper and the lower chamber member are sealed by a dip tube having practically the same outer diameter as the inner diameter of the connecting part, the content is charged into the lower chamber member, the upper chamber member is connected, the dip tube is inserted, the content is charged into the upper chamber member, and then the propellant is charged. In this case, the contents can be charged in the order of the lower chamber member and the upper chamber member after the upper and the lower chamber member are connected.

Further, the film and the dip tube having the same outer diameter as the inner diameter of the connecting part may be used to enhance the sealing effect.

Figure 21:
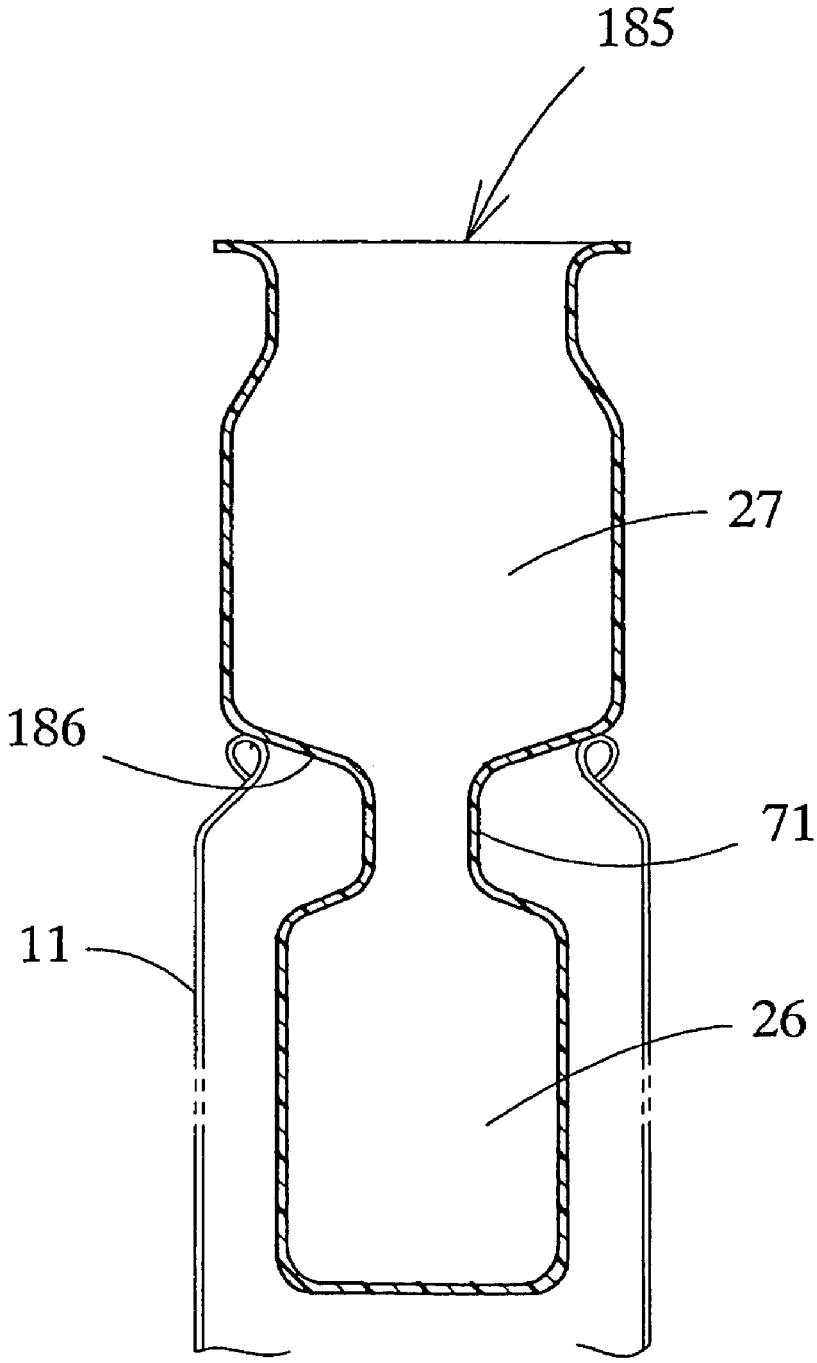
FIG. 21 is a front cross sectional view of yet other embodiment of the inner bag used in the container.

The inner bag of FIG. 21 has the constriction part 71 dividing the inner bag into the upper and the lower chamber in the vicinity of its center. The inner diameter of the upper chamber 27 is larger than the inner diameter of the lower chamber 26 and the diameter of the opening of the outer container, and the inner diameter of the lower chamber 26 is smaller than the diameter of the opening of the outer container. The charging method of the container product using this inner bag 185, first the content A is charged into the lower chamber 26, the lower chamber 26 of the inner bag 185 is inserted into the outer container 11 where the shoulder part 186 composed of the upper chamber 27 and the constriction part 71 is hooked on the opening of the outer container 11 shown by the imaginary line. Then, the partitioning 72 equipped with the dip tube is inserted into the constriction part 72, the inner bag 185 is vacuumize from the opening to deflate the upper chamber 27, and the inner bag 185 is inserted into the outer container 11. After that, the content B and the propellant is charged with conventional methods. This charging method allows lower oxygen density in the inner bag and the long term stable storage of the contents, because the contents are less exposed to oxygen after charging. Thereby enabling long term stable storage of the dispenser (aerosol products).

Figure 22:
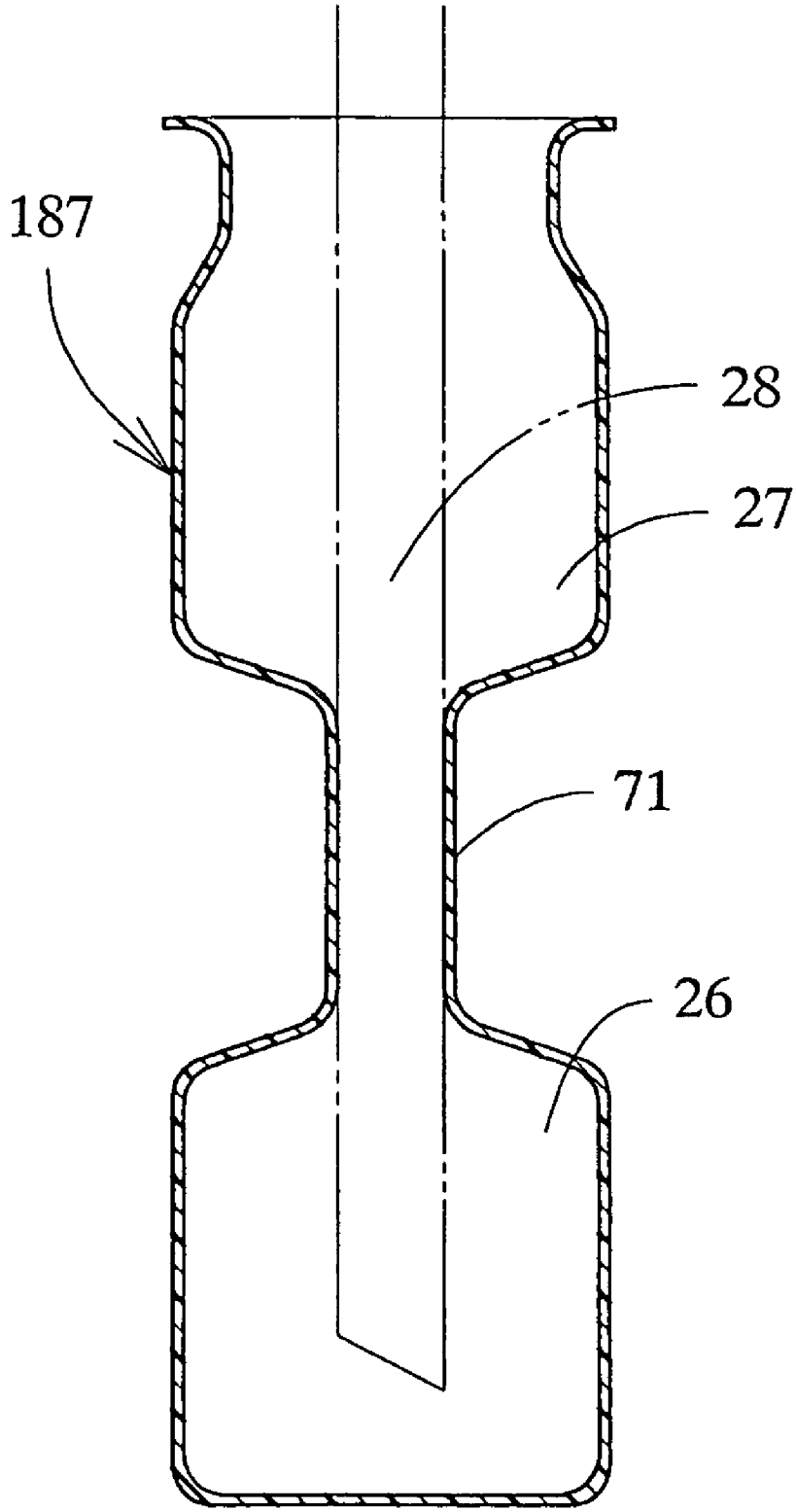
FIG. 22 is a front cross sectional view of yet other embodiment of the inner bag used for the container.

In the inner bag 187 of FIG. 22, the constriction part 71 is formed in slender shape in the vicinity of the center, and divide the inner bag into the upper and the lower chamber 27, 26. The diameter of the constriction part 71 is practically same as the outer diameter of the dip tube 28. The insertion of the dip tube 28 isolates the upper and lower chamber except for the path of the dip tube 28. The slender constriction part prevents the contact of the content A and the content B, and adjustment of thinness and length of the constriction parts enables to obtain desired stability. The charging method of this container product using the inner bag 187 is described as follows. At first, the content A is charged in the lower chamber 26, the dip tube 28 is inserted into the constriction part 71, and the content B is charged in the upper chamber 27. A lip can be provided with the constriction part 71 to secure the sealing property.

Figure 23:
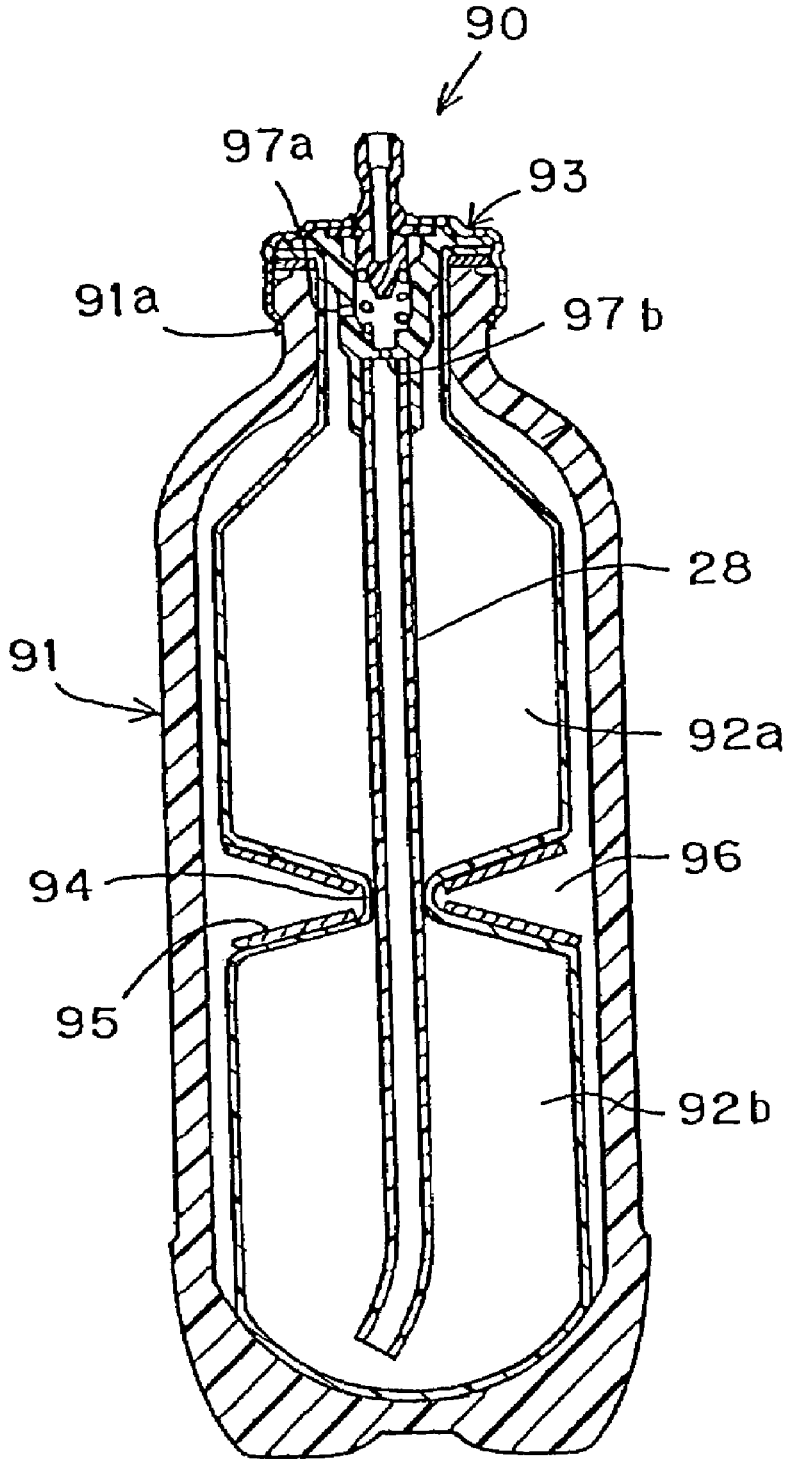
FIG. 23 is a front cross sectional view of yet other embodiment of the container.

The aerosol container 90 of FIG. 23 is provided with an outer container 91 made of transparent or translucent rigid synthetic resin or pressure-resistant glass, the inner bag 92 having the upper and the lower chamber 92*a*, 92*b* inserted into the container 91, and the valve 93 fixed on the opening of the outer container.

The outer container 91 has a cylindrical body with bottom, the shoulder part extending in tapered shape from the upper end of the body, and the neck part continuing from the shoulder part. Under the end of the above neck part, a concave groove 91*a* is formed continuing from the upper end of the shoulder part. The outer container 91 is manufactured by conventional blow molding method, a parison made of polyethylene terephthalate or synthetic resin of polyethylene terephthalate etc is inflated using air pressure, the inflated parison is closely contacted to a metal mold, and the hollow body is obtained by cooling down. Further the shape of the container disclosed in Japanese Unexamined Patent Publication No. 2000-327053 may be used. By making the outer container transparent or translucent, it is possible to view the inside content to check the accurate remaining amount and the condition of the upper and lower chambers. Especially for the aerosol products filled with the contents, which reacts when the contents of upper and the lower chamber are mixed with each other. Further providing a scale on the outer container is preferable because it enables the accurate check of the remaining amount and the condition of the contents. In this embodiment, the remaining amount of the content can be checked by external view because the outer container is transparent or translucent. In other cases where the outer container is not transparent, a thread or a string is preferable to be connected in the middle stream of up and down direction of the product. In this case, it is possible to check the remaining amount of the contents by the inclination of the product when another end of the thread is tucked to hang the product.

The inner bag 92 described above is practically same as the inner bag 187 of FIG. 22. It is provided with the constriction part 94 which is smaller than the opening of the outer container 91. The constriction part 94 divides the inner bag into the upper and the lower chamber by inserting the dip tube. However, in the periphery of the constriction part 94 between the upper chamber 92*a* and the lower chamber 92*b* is provided with a gas absorbent 95 disclosed in Japanese Unexamined Patent Publication No. 09-104487 formed in sheets or contained in a gas permeable bag. Such a gas absorbent 95 is particularly preferable when the contents charged in the chamber are the first agent of hair dye containing stabilizer such as ammonia etc. or the second agent of hair dye containing oxidizer such as hydrogen peroxide. When oxygen generated by dissolution of hydrogen peroxide or ammonia gas generated from ammonia pass through the inner bag 92 and out in the space between the inner bag and the outer container 91, the oxygen and the ammonia gas is absorbed. Therefore, rise of the inside pressure of the outer container can be prevented. Further, deterioration of the contents and corrosion due to the generated gas can be prevented. The gas absorbent 95 can be coated inside of the inner bag 92. In this case, the gas stored inside of the inner bag without passing through the inner bag can be absorbed. However, it is more effective to coat outside. In the case of coating inside, the surface of the gas absorbent will be covered by liquid, therefore contact area of the gas with the gas absorbent decreases and the gas absorbing action will be disturbed. In addition, the gas absorbent can be provided on the shoulder part or on the periphery of the one side of the chamber. And it can also be provided on the whole outer surface of the inner bag 92 or on the inside of the outer container 91. Furthermore, the gas absorbent sacked in a gas-permeable bag can be accommodated in the outer container. Gas absorbing sheets can be used as an intermediate layer of the inner bag described in the Japanese Utility Model No.1993-34780. Furthermore, a safety valve or mechanism to release the gas outside when the inner pressure of the outer container reaches a constant pressure can be provided. As such a mechanism, the fitting structure of a cap member disclosed in the Japanese Unexamined Patent Publication No. 7-104381 or the shape of the mouth part or mounting cup disclosed in the Japanese Unexamined Patent Publication No.8-149382 may be used. In this case, when the gas exceeding the amount absorbable by the as absorbent is generated, or when the gas absorbent does not absorb the given amount of the gas, blasting off of the valve due to the abnormal rise of the pressure in the outer container may be prevented. As described above, a check valve can be provided in the inner bag disclosed in Japanese Unexamined Patent Publication No.8-133359. This check valve allows the stored gas that does not pass through the inner bag to flow from inside of the inner bag to outside, thereby prevent the expansion of the inner bag and burst of the inner bag due to the expansion.

The valve 93 is provided with a cylindrical housing having a projection radially-outwardly protruding at the upper end; and a mounting cup fixing the housing with clipping the projection in between the opening of the outer container, covering the opening of the outer container 91, and the crimping the concave groove 91*a* to make the outer container airtight. The other compositions are practically same as the valve 13 in FIG. 2*b*. Inside of the housing and the upper chamber 92*a* are communicated through the communicating hole 97*b* formed in side wall of the housing, and inside of the housing and the lower chamber are communicated through the dip tube 28 intervened by the communicating hole 97*b* of the lower end of the housing. The diameter of the dip tube 28 is slightly larger than the small constriction part 94 of the inner bag 92, thereby enabling the blocking of the lower from the upper chamber of the inner bag by inserting the dip tube 28 into the constriction part 94. The length of the dip tube 28 is not restricted, but it is preferable to be so long as to reach the bottom of the aerosol container 90 so that the path is secured when the inner bag 92 is crinkled according to decrease of the contents. The strength of the constriction part 94 can be made stronger than the other portion and the length of the dip tube 28 can be made so long that the lower end is located around the constriction part. In this case, the configuration of the inner bag 92 is preferable to crinkle in the order from the bottom to the constriction part along with the decreasing of the contents in the lower chamber 92*b*. In this embodiment, a lip seal same as the lip seal 71*a* shown in FIG. 12*e* can be also provided in the constriction part 94 making stronger sealing between the upper and the lower chamber. The other compositions are same as the aerosol container 75*a* shown in FIG. 12*c* obtaining the same action.

In the embodiments disclosed above, a space 96 shown in FIG. 23 is provided between the upper and the lower chamber except for the continued portion engaging with the partitioning. More specifically, there are contents inclined to pass through the synthetic resin sheets composing the inner bag, and these contents may pass through the inner bag to react with other contents and deteriorate the contents in the case that only synthetic resin sheets compart the contents as the partitioning. However, in the container described above, the contents may pass through the sheets composing the bag, but the space 96 prevents the contents to pass to the other chamber where the other contents are charged. Because the contents cannot contact directly to the inner bag (other chamber) in which the other contents are charged. Further, the simultaneous use of the above described gas absorbent enhances the effect of preventing the permeation. Use of a partitioning having high barrierhood to gas is preferable.

The aerosol container 120 of FIG. 24 has a charging valve 121 to charge the propellant at the bottom of the outer container and an inner bag 122 (Japanese Unexamined Patent Publication No. 2000-24557) hung with clipping between the opening of the container body with the valve and formed so the lower end of the inner bag does not contact to the bottom of the container body. The inner bag 122 is divided into the upper and the lower chamber by the constriction part 71 at the center, and the constriction part 71 is provided with the same partitioning member 72 shown in FIG. 12*b*. Further, the inner bag 122 is provided with a fold line 123 formed along axial direction and is composed so as to be folded and crinkled along the fold line according to discharge amount of the contents. In this aerosol container 120, each content is charged into the upper and the lower chamber of the inner bag 122 and the valve 124 is fixed. After that, the propellant is charged from the charging valve 121 to obtain the aerosol products. As well, in this embodiment, the valve is been fixed by replicating or folding the upper end of the opening of the container body inside (Japanese Unexamined Patent Publication No. 2000-628790).

Figure 25:
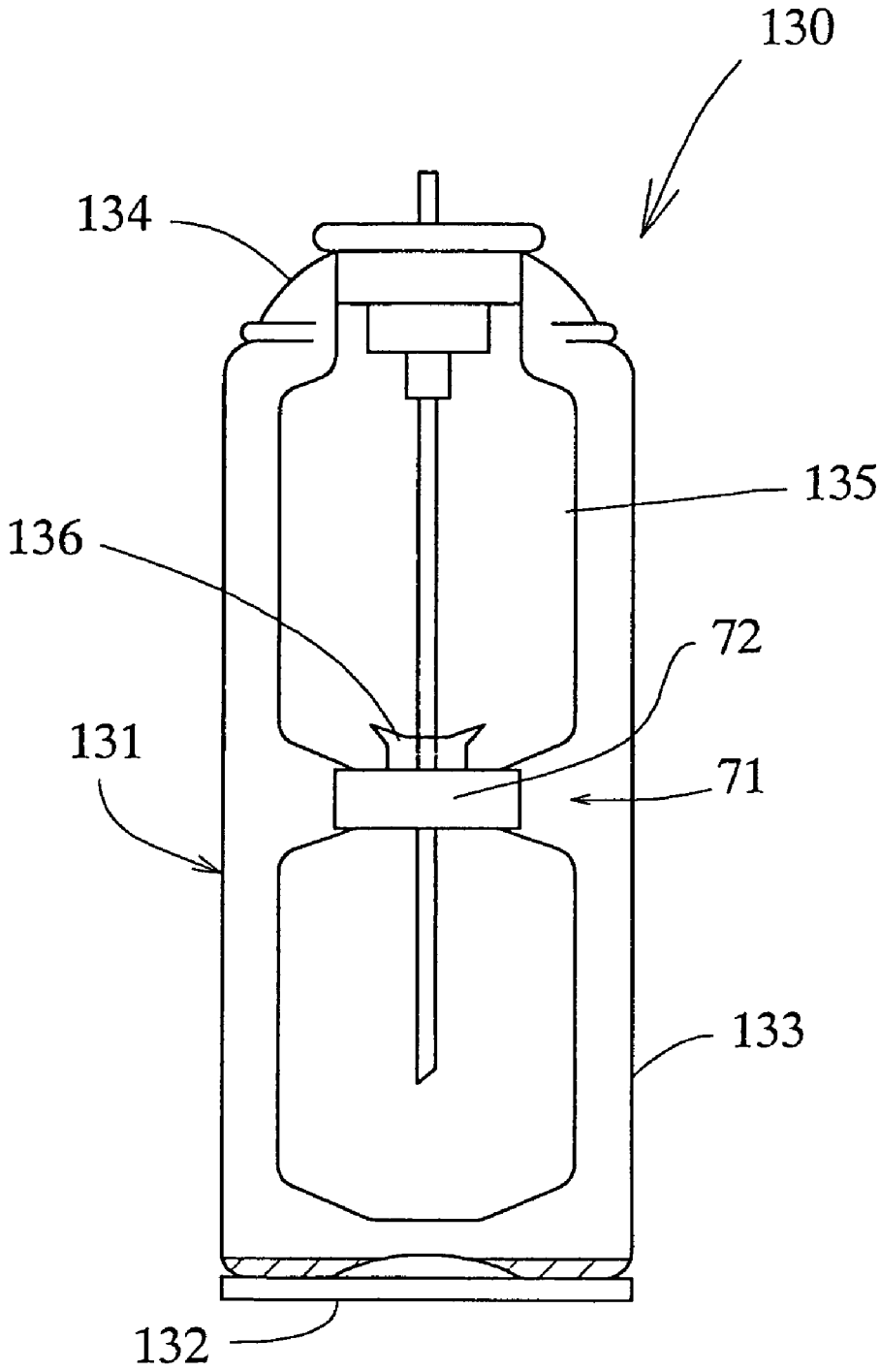
FIG. 25 is a front cross sectional view of yet other embodiment of the container.

The aerosol container 130 of FIG. 25 has container body 131 composed of the bottom 132, the body 133, and the head 134, and is formed in three pieces can by double wind up. The inner bag 135 is composed so as to be suspended or hung at the opening of the container body. The aerosol container 130 has the container body 131 which is formed by winding them doubly to form three pieces can, and has the inner bag 135 composed so as to be suspended at the opening of the container body. The inner bag 135 has the constriction part 71 at its center, and the partitioning member 72 equipped with the dip tube 28 is engaged to the constriction part. Further, on the partitioning member 72, the dip tube 28 is inserted, and a cylindrical gas-purging member 136 having plural sharp blades outward in radial direction is provided. The gas-purging member 136 is jointed up with the center part of the partitioning member 72 by inserting together with the dip tube 28. this gas-purging member 136 breaks the inner bag by deflation of the inner bag, when almost all the contents are discharged and the inner space of the outer container and the inner space of the inner bag communicates. After all the contents are discharged, further opening of the valve allows the propellant in the space of the outer container to naturally exhaust outside. Therefore, it is not necessary to take particular measures such as discharging gas by punching a hole in the outer container after use. This aerosol product is safe and preferable for the recycling. The gas-purging member 136 can be integrally molded with the partitioning member 72 using synthetic resin. The gas-purging member, shown in FIG. 1,5 of Japanese Unexamined Patent Publication No. 1997-267876, the gas-vent structure shown in FIGS. 1, 3, 4, 5, 6, 7, and 8 disclosed by Japanese Unexamined Patent Publication No. 1998-310111, the gas-vent tool shown in FIG. 1, 3, 4, 6, 7, 8, 9, 10, 11, and 12 disclosed by Japanese Application Laid Open No. 1999-171268 can be used as the aerosol product of this invention.

Figure 26:
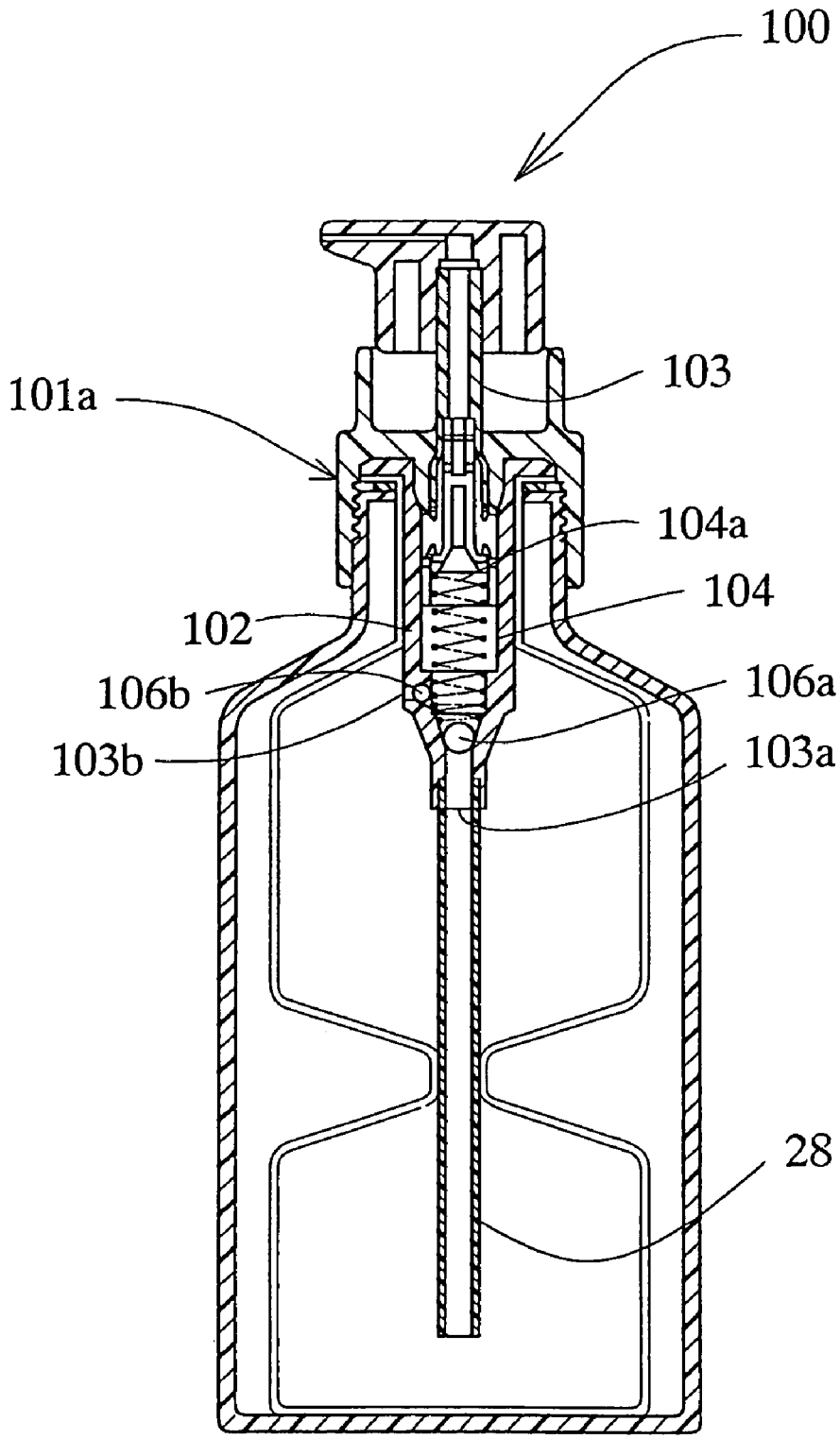
FIG. 26 is a front cross sectional view of yet other embodiment of the container.

In the embodiment described above, aerosol products in which the inside pressure of the container is increased by a propellant such as compressed gas. The container 100 shown in FIG. 26 employs pumping mechanism 101 as a means for pressurizing the inner bag. The valve 101*a* provided with this pumping mechanism 101 is composed of a housing 102, a stem 103 accommodated in the housing, a spring 104*a* always energizing the stem upward always, a piston 104 accommodated in the housing and serving as a check valve, communicating holes 103*a*, 103*b* provided at the lower end of the housing 102, and check valves 106*a*, 106*b* for closing the communicating holes 103*a*, 103*b*. These check valves 106*a*, 106*b* are same as the check valve 51*a* shown in FIG. 3*a*, and are composed so that the communicating holes 103*a*, 103*b* are closed with balls energized by springs toward the communicating holes 103*a*, 103*b*. The stem 103 and the piton 104 are conventional and publicly known, and a push button is mounted on the upper end of the stem 103. The dip tube 28 is attached to the communicating hole 103*a*, thus communicate communicates hole with the lower chamber.

Other components such as the inner bag and the outer container are same as those shown in FIG. 2 or FIG. 23 etc, By pushing down the push button, the piston 104 comes down and an amount for a single usage of the contents is discharged into the housing 102 by the action of the check valve. After that, the push button goes up by the spring 104 through the stem 103. In this going up, the first and the second piston not shown in the figure also goes up to updraw the contents into the housing 102 for next discharge through the lower end check valve 106*a*, 106*b*. The use of the container having such pumping mechanism enables to use two different contents leaving no residue in the inner bag.

Figure 27:
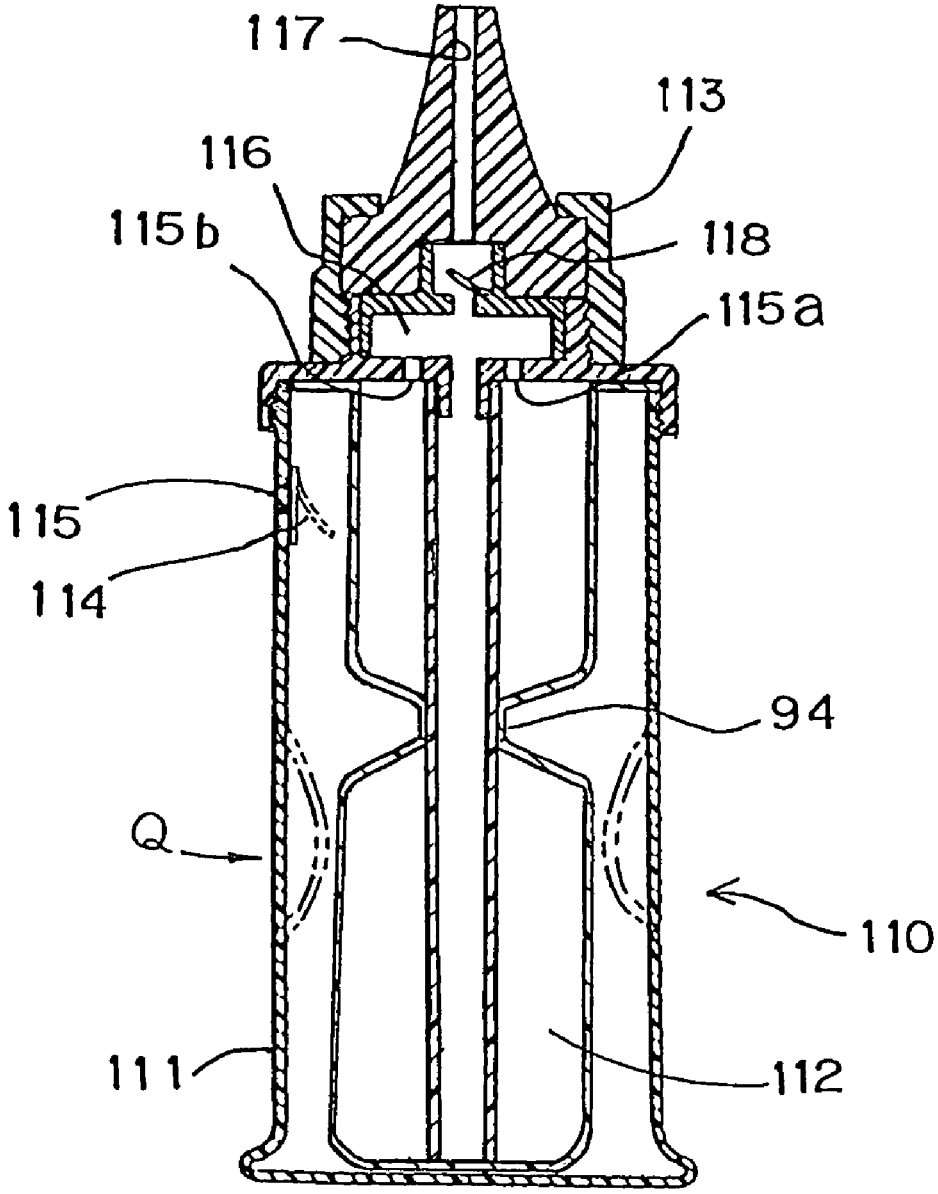
FIG. 27 is a front cross sectional view of yet other embodiment of the container.

FIG. 27 shows an embodiment of a squeeze bottle type container pushing out the contents directly. The container 110 is provided with a flexible outer container 111, the inner bag 112 having the upper and lower chamber, and a cap 113 mounted on the opening of the outer container. In this container 110, the container body 111 composes the pump, and it is composed so that deformation due to the local force is recovered by the elasticity. In a part of the outer container 110, a hole 115 communicating with outside air is formed, and the check valve 114 is provided inside of the hole 115.

The inner bag 112 is same as that of aerosol container 90 of FIG. 23 and is divided into the upper and the lower chamber. The cap 113 is about chevron and made of synthetic resin having the communicating hole 115*a*, 115*b* in its hem. The center of the communicating hole 115*b* communicates with the lower chamber through the dip tube 28, and the other communicating hole 115*a* directly communicates with the upper chamber. And the upper part of these communicating hole 115*a*, 115*b* communicates with a spout 117 through a housing mixing chamber 116. When the cap 113 is fixed on the outer container and an external force Q is applied so as to crush in a part of the container body 112, an uniform force is applied to the whole inner bag 112, the contents enter into the housing mixing chamber 116 through each communicating hole 115*a*, 115*b* from the upper and the lower chamber and mixed thereupon and discharged through the spout 117. In the top surface of the housing mixing chamber 116, the check valve 118 is provided to prevent the draw in of the air from the spout 117. In addition, it is preferable to provide a check valve in the communicating hole 115*a*, 115*b* at an inlet of the housing mixing chamber 116. In this case, the contents mixed in the housing mixing chamber 116 is prevented to flow backward. The length of the dip tube 28 can be as long as to reach the constriction part or the lower end of the container body.

Figure 28:
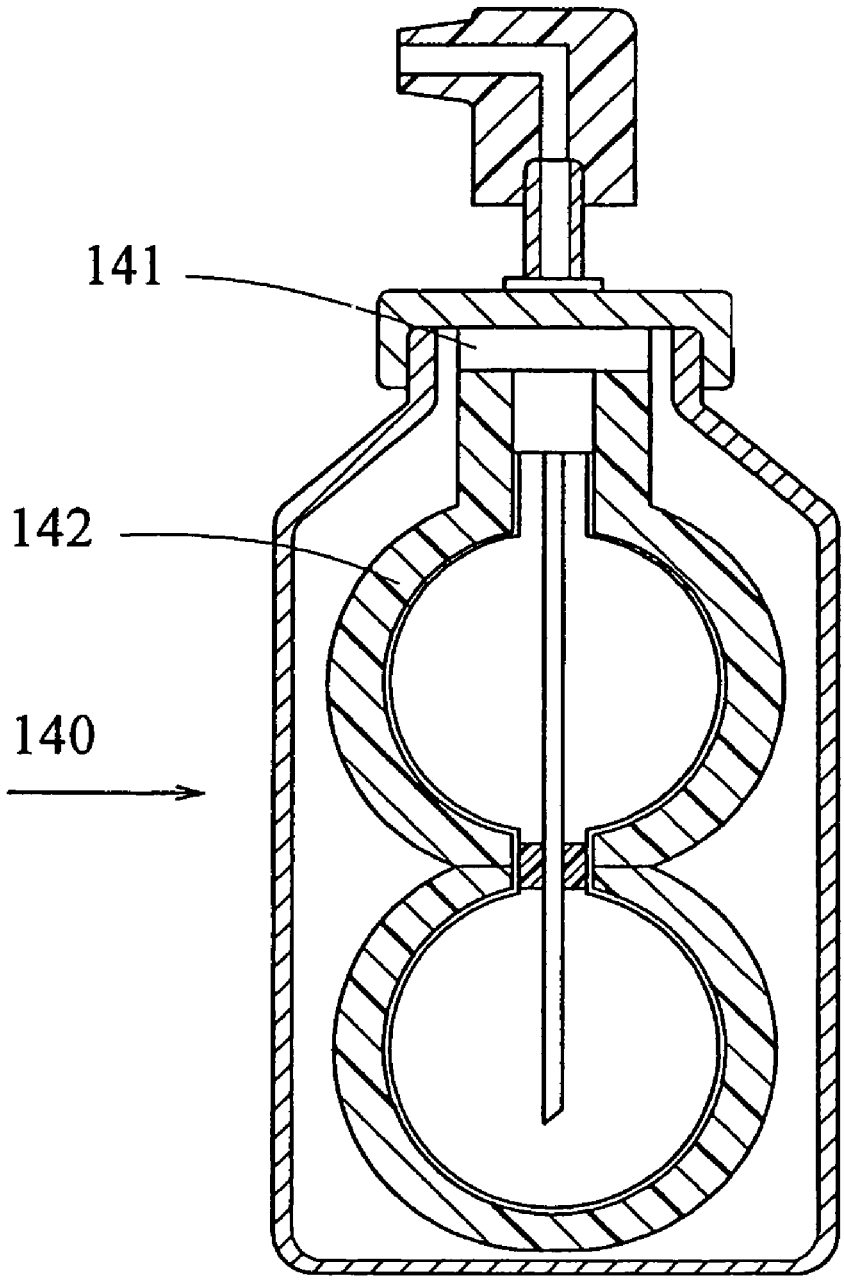
FIG. 28 is a front cross sectional view of yet other embodiment of the container.

FIG. 28 shows the embodiment of the container 140 which pushes out the contents by the elasticity of the inner bag itself. The container 140 is composed of the valve 141, the inner bag 142 made of elastic material such as synthetic rubber or silicone rubber, the body that accommodate the inner bag and engaged with the valve 141 at its opening, and the cap which fixes them. The inside layer of the inner bag is laminated by a protection layer to prevent erosion. The inside surface of the inner bag 142 sticks to each other leaving no space in the natural state (elastic energy being zero). The inner bag is inflated by charging in the contents (elastic energy being stored). Therefore, release of the valve makes discharge of almost whole contents. The valve is securely fitted to the opening of the inner bag to enclose the contents. The valve 141 is conventional and publicly known. The outer container of this container 140 is not necessary when the valve and the inner bag are tightly sealed. In this case, the inner bag serves as the outer container and the pressuring means. In this case the opening of the inner bag 142 can be tightly fastened using metal wires. On the other hand, elastic rubber belts may be wound around the perimeter of the upper and lower chamber of the flexible inner bag.

Figure 29:
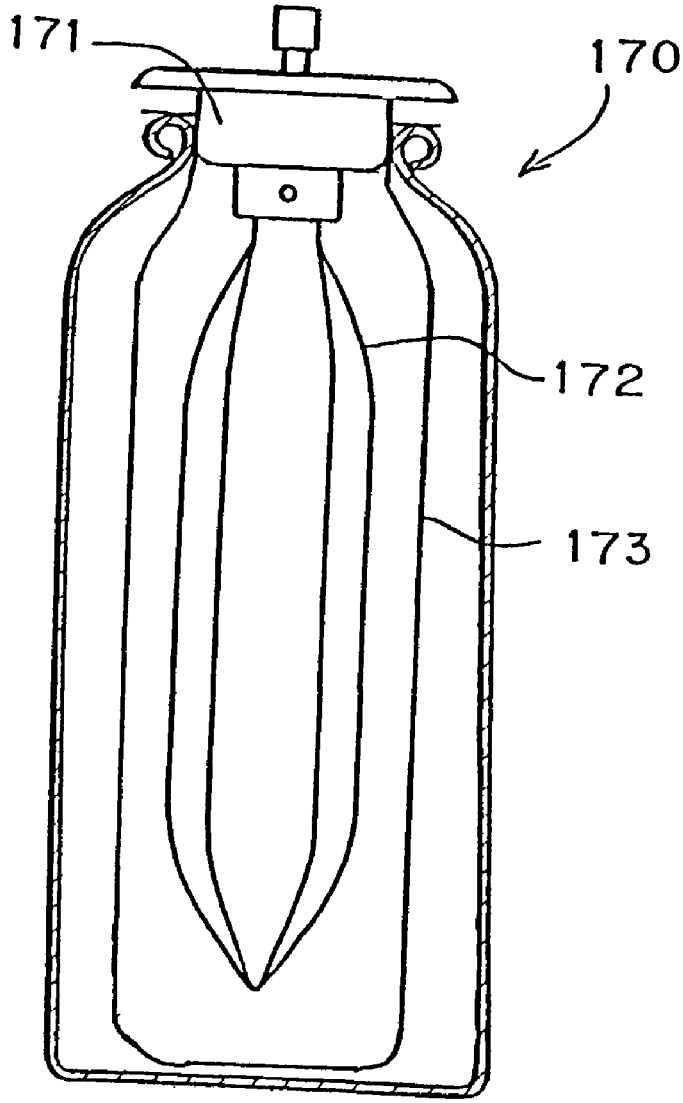
FIG. 29 is a front cross sectional view of yet other embodiment of the container.

The aerosol container 170 of FIG. 29 has the valve 171, the inner inner bag 172 of which upper end is connected to the valve, the outer inner bag 173 to accommodate the doubled inner bag, where the outer inner bag 173 corresponds to the inner bag of this invention and the doubled inner bag 172 corresponds to the partitioning comparting the outer inner bag 173. However, the partitioning member described above does not transmit the pressure between the upper and the lower chamber, the inner inner bag 172 transmits the pressure between the upper and the lower chamber. As the valve, that of valve 13*b*, 13*c* or 13*d* shown in FIG. 3~FIG. 7 is used. These valves have the communicating hole 48*a* at their lower end and have the communicating hole 48*b* at their upper side end. The inner inner bag 172 is mounted so as to cover the housing and not to close the communicating hole 48*b*, and communicates with the valve through the communicating hole 48*a*. The outer inner bag 173 communicates with the valve through the communicating hole 48*b*. Then the opening of the valve allows contents of the outer and the inner inner bag to flow into the valve. In order to make the seal between the inner inner bag 172 and the valve, sealing means such as O-rings can be used between the inner inner bag 172 and the valve. The production method of this aerosol product is described bellow. The contents of the doubled inner bag 172 and the outer inner bag 173 accommodated in the outer container are charged by separate lines, the inner inner bag 172 is fixed to the valve, and then the valve is inserted into the outer inner bag 173. The propellant is charged, and the valve is fixed. The inner bag can be previously fixed to the valve and contents can be charged from the valve.

Figure 30:
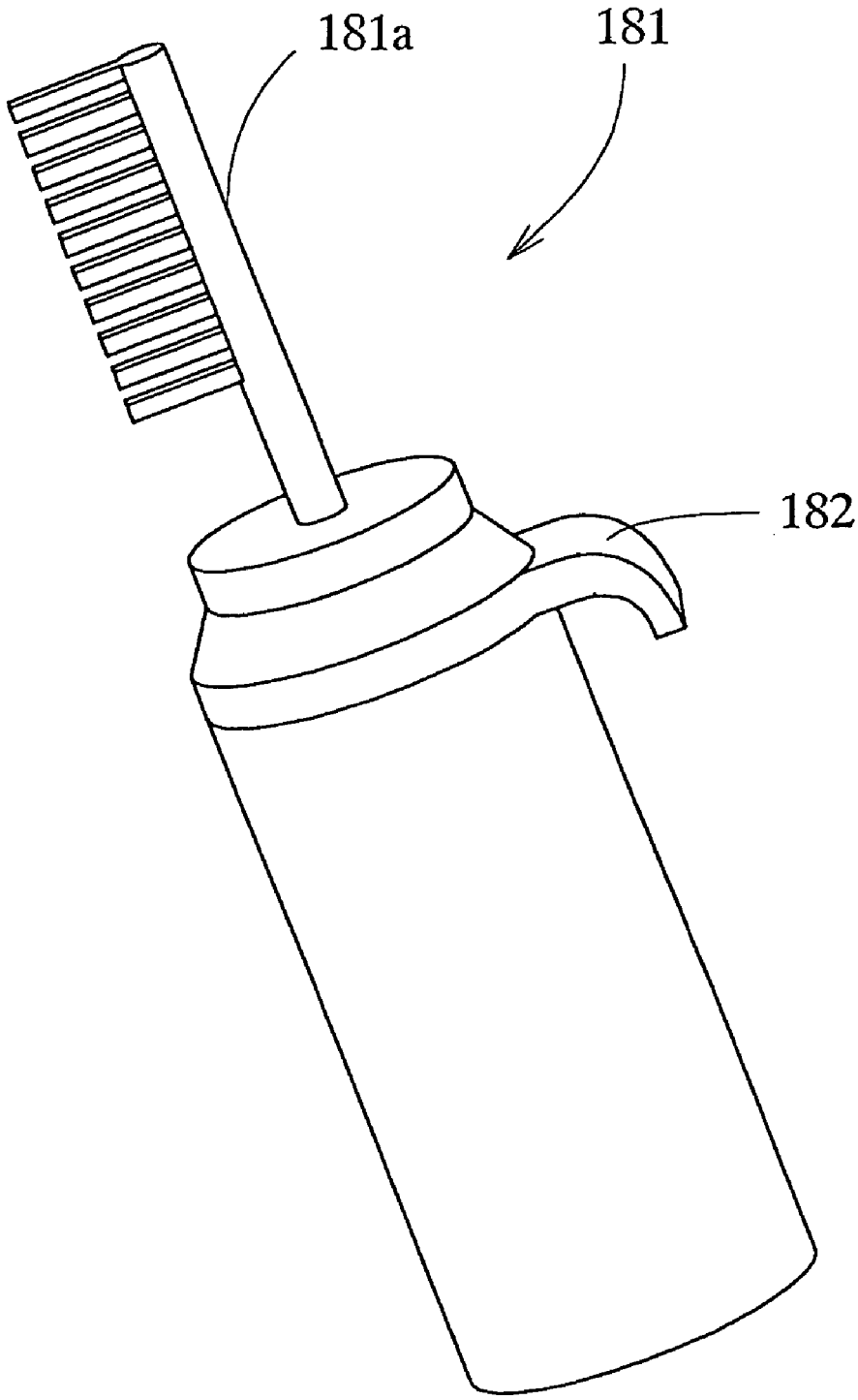
FIG. 30 is a perspective view of yet other embodiment of the container.

As described above, in the case that the outer container is not transparent, it is preferable to provide a means to check the residual amount of the contents. As a means for checking the amount of the residual, for example, like the container 181 shown in FIG. 30, a comb-shaped discharging member 181*a* is provided. A catch 182 is provided on the shoulder part of the container 181. As other structures of the container, any one of the embodiments described above can be used. When the container 181 is hanged by picking up the catch with fingers, bars, or threads, the container 181 inclines according to the amount of the contents left in the inner bag. Previous description of the relation between the inclination and the remaining amount of the contents is written on the outside surface of the container or in the instruction book attached separately enables to confirm the remaining amount of contents in the container 18 easily.

Figure 31:
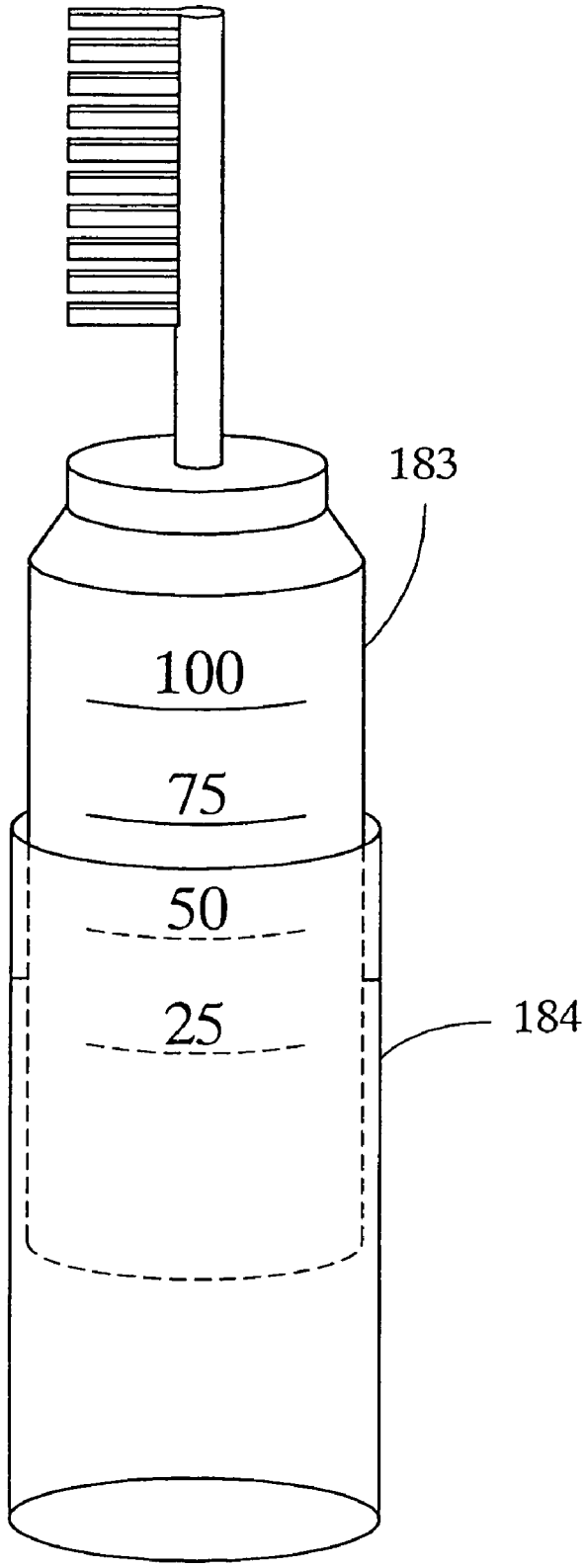
FIG. 31 is a perspective view of yet other embodiment of the container.

Further, the container 183 shown in FIG. 31 has a cylindrical container cover 184 with bottom that can accommodate the container 183 and has a scale on the periphery surface. The other configurations are substantially same as the container 181 without the catch of FIG. 30.

The confirmation method of the residual amount in the container 183, a liquid such as water is charged into the container cover 184, and the container 183 is floated in the container cover 184. The level (height) of the container 183 differs according to the buoyancy of the container. And the buoyancy differs according to the residual amount of the container 183. So, the residual amount of the container 183 may be confirmed by previously recording the relationship between the level of the container and the residual amount on the periphery surface or in the attached documentation. For example, the container 183 equipped with the scale that shows the relationship between the protrusions height of the container 183 from the container cover 184 and the residual amount may be mentioned. Such as, the container 183 equipped with the scale written 100 on the periphery surface 5 cm below the upper end of the container 183 maybe used to the container in which the upper end of the container 183 protrudes 5 cm above the top of the container cover 184 when the container 183 with residual amount 100% is inserted into the container cover 184 with water charged.

Figure 32:
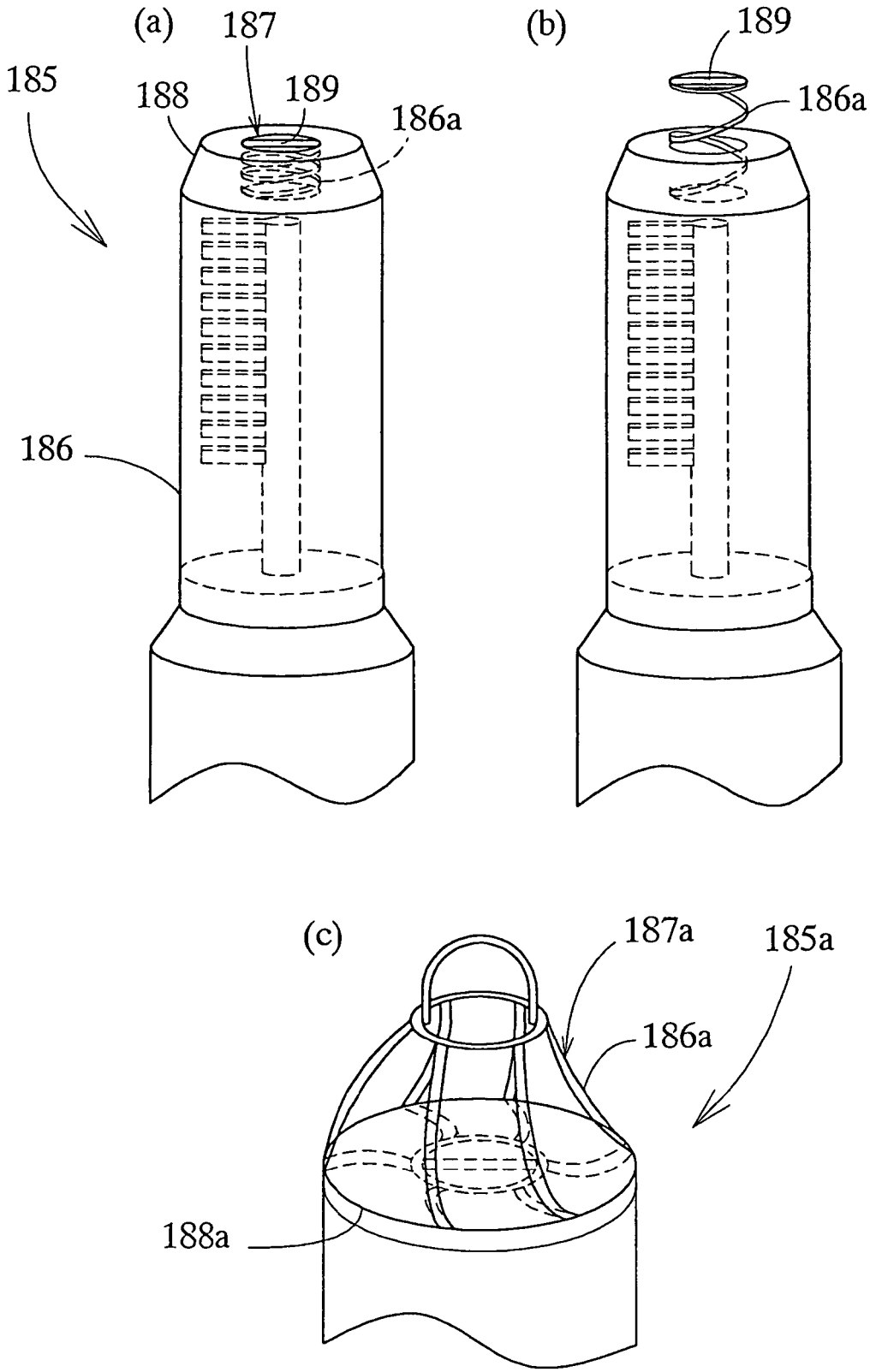
FIG. 32*a* is a perspective view of the embodiment of the spring balance scale used in the container.
FIG. 32*b* is a perspective view of the spring balance scale showing the used state.
FIG. 32*c* is a perspective view of the other embodiment of the spring balance scale used in the container.

Further like shown in FIG. 32*a*, a dispenser with cover member 185 that covers the container 185 and spring balance scale 187 having spring at the top of the cover member 185 may be used. In the cover member 185, a cabinet 188 that accommodate the spring balance scale 187 and the knob 189 formed at the top of the spring balance scale are provided. The other configuration is substantially same as the container 181 of FIG. 30. The spring of the spring balance scale extends when the container 185 is suspended by the nipping the knob 189. Therefore the residual amount of the container may be confirmed by previously recording the relationship between the extension amount of the spring and the weight of the container on the scale of the spring balance scale or in the attached documentation. In this embodiment the dispenser with the spring balance scale was disclosed, but this is not limited and may be substituted by balance scale using elasticity such as rubber balance scale.

A container 185*a* shown in FIG. 32*c* is provided with a spring balance scale 187*a* with a spring 186*a* attached to the bottom of the container and has a cabinet 188*a* that accommodate the spring balance scale 187*a*. The other configuration is substantially same as the container 185 of FIG. 32*a*.

A dispenser having a means to check the remaining amount of the contents can confirm the residual amount of the container even if the container body is not transparent or translucent. Thus the problem of not obtaining the desired effect or finish, due to the running down of the contents during the use can be solved.

Figure 36:
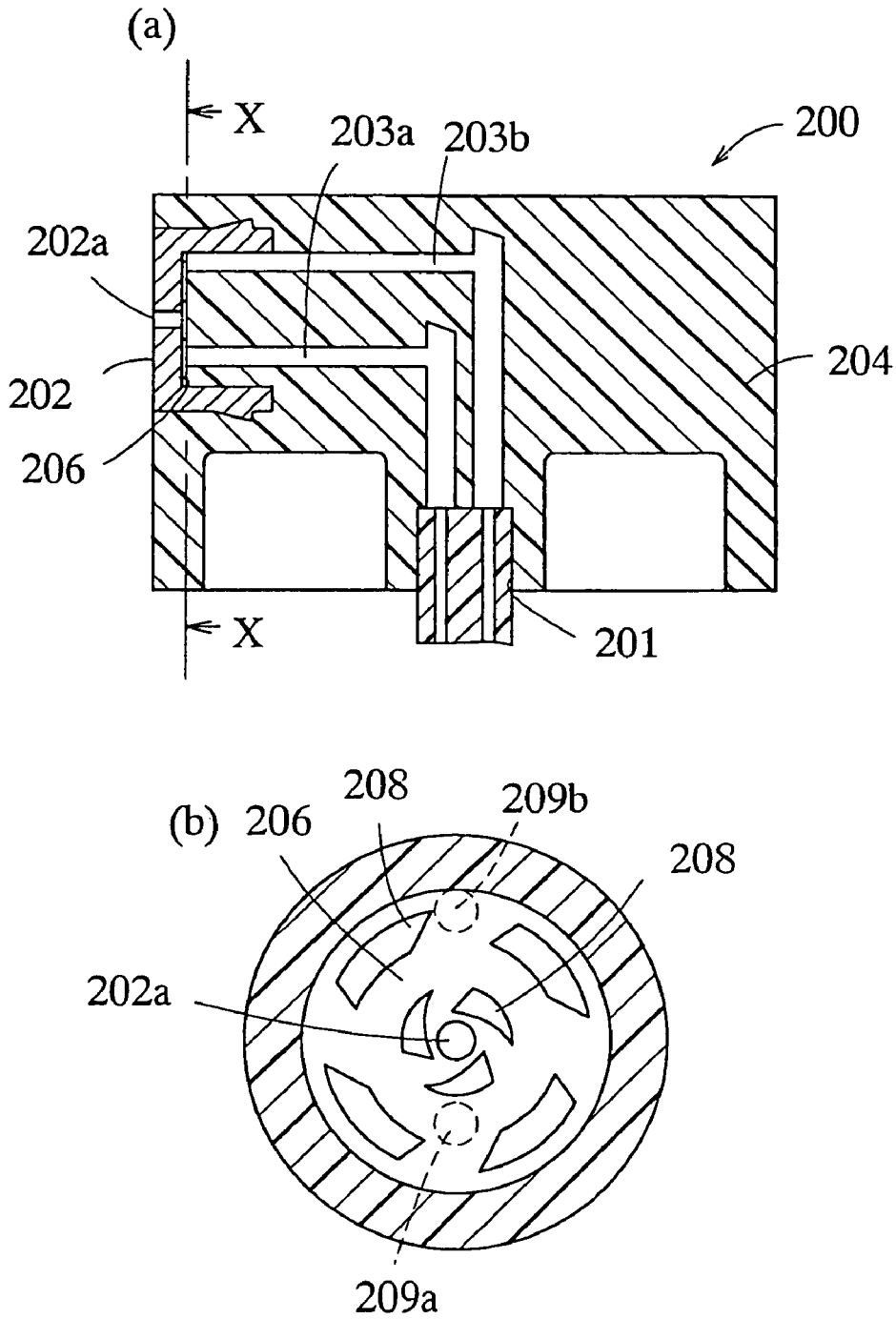
FIG. 36*a* is a front cross sectional view of the discharging member used in the container.
FIG. 36*b* is a enlarged sectional view of X-X line of the nozzle of the discharging member.

A discharging member that can be used to the aerosol product of the present invention is disclosed in FIG. 36*a*. This discharging member 200 is preferably used in the aerosol product that comprises the valve 13*b* of FIG. 5*b* that dispense the contents of the upper and lower chamber without mixing each other. The discharging member 200 is cylindrical and has a stem engaging 201 that engage with the stem 14; a nozzle 202 that simultaneously dispense the contents A, B supplied from the stem; passages 203*a*, 203*b* of the discharging member that communicate the stem engaging 201 and the nozzle 202 and where the contents A, B flows.

The nozzle 202 is cylindrical having bottom and is provided with the injection hole 202*a* at the center of the bottom, and engages with a discharging member body 204. Further, whorled projection 208 that whorl from the edge to the center is formed at the inner side 206 of the bottom, and is formed on the engaging surface between the discharging member body 204 and the nozzle 202. Further, an opening of the passage 203*a*, 203*b* belong to the edge of the inner side 206 of the bottom when the nozzle is engaged with the discharging member body 204 like shown in dotted line (FIG. 36*b*).

Therefore, the contents A, B that are dispensed from the passage 18*a*, 18*b* of the valve reach the inner side of the bottom 206 through passage 203*a*, 203*b* of the discharging member. As a result, the contents form the volute due to the projection 208 and are mixed at the inner side 206 of the bottom. And the mixed contents discharge from the injection hole 202.

The discharging member 200 is best suiting for the contents with low viscosity, with liquid form, that discharged in the state of mist, and that reacts when the two liquid are contacted or mixed. Therefore the mixture of the effect is large, and the effects can be obtained simultaneously at the time of discharging. For example, by using the contents that carry out neutralization and thickening at the time of mixture, the mixed content starts increasing the viscosity at the injection hole, discharges in rough misty state, and becomes gel state (gelatinous) at the adhesion surface thus prevent the drop off. Further, when the contents that dissolute and carry out exothermic reaction or endothermic reaction by mixing the contents are used, the discharged contents are injected with form of mist in warm or cold state.

Figure 37:
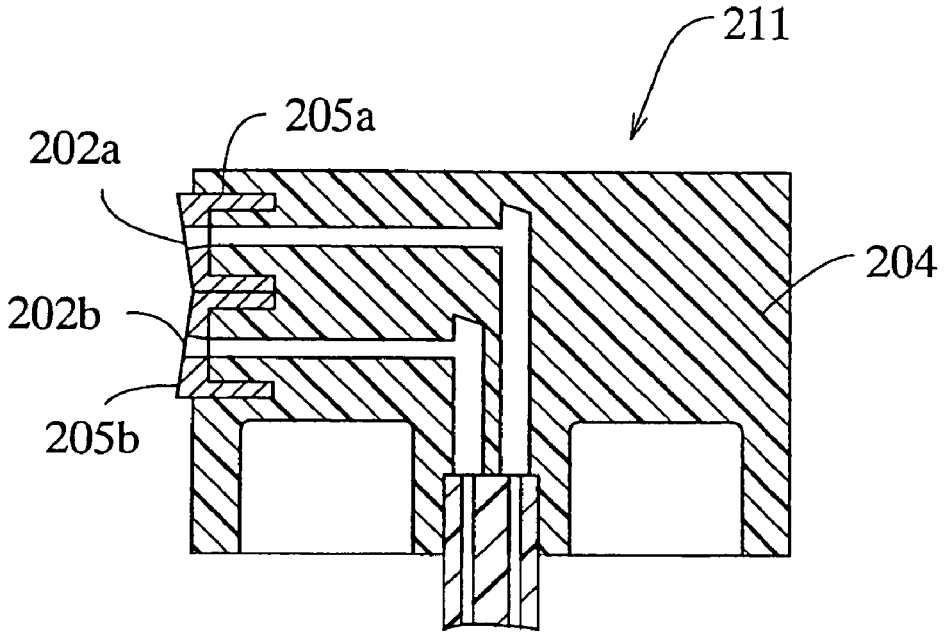
FIG. 37 is a front cross sectional view of the other embodiment of discharging member used in the container.

The other type of discharging member for the aerosol product for this invention is disclosed in FIG. 37. Like the discharging member of FIG. 36, this discharging member is preferably used in the aerosol product that comprises the valve in which the contents of the upper and lower chamber are dispensed without being mixed with each other. The discharging member 211 is provided with two nozzle 205*a*, 205*b* having injecting hole 202*a*, 202*b* respectively and a discharging member body 204. These two injecting holes 202*a*, 202*b* have injecting angle that crosses with each other. Therefore the contents that are discharged or injected using the discharging member 211 are mixed with each other at the space near the injecting holes. Thus the contents starts reacting when the contents are at the space between injection hole and the target, or when the contents adhere at the target, and user may obtain the effect soon after the injection.

The nozzle 205*a*, 205*b* are engaged with the discharging member body 204 in the above disclosed embodiment, but it may be integrally formed.

Figure 38:
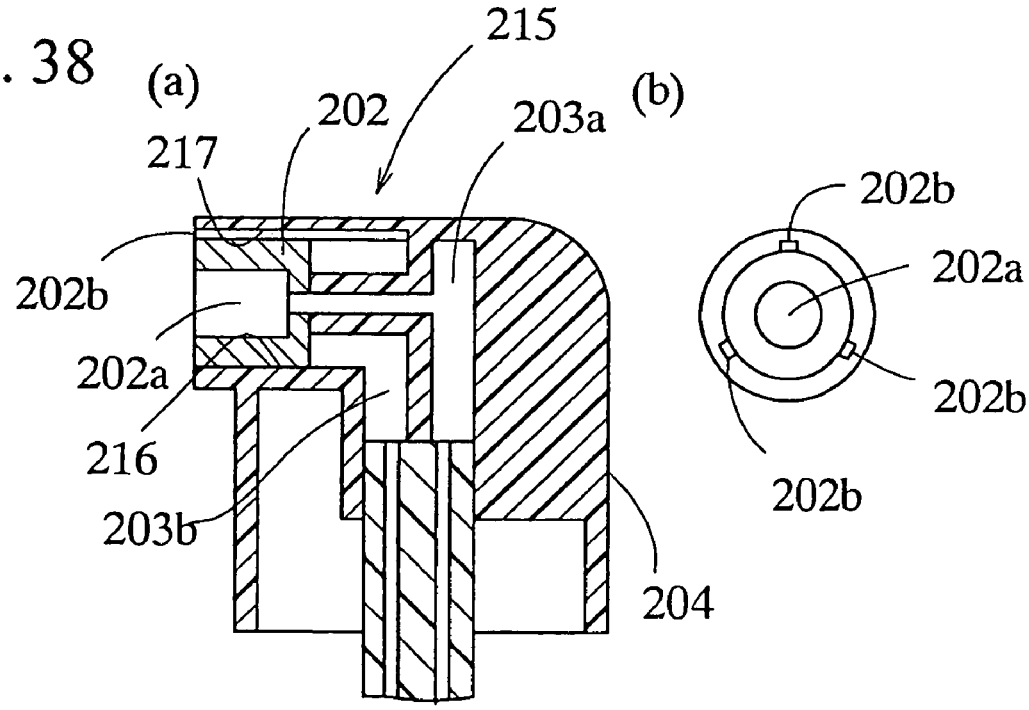
FIG. 38*a* is a front cross sectional view of the other embodiment of discharging member used in the container.
FIG. 38*b* is a side view of the nozzle of the discharging member.

The other discharging member is disclosed in FIG. 38. Like the discharging member 211 of FIG. 37, this discharging member discharge or independently inject the contents that are separately supplied. The discharging member 215 is provided with a discharging member body 204 that independently flows the contents A, B supplied separately from the valve through passage 203*a*, 203*b* of the discharging member; and a nozzle 202 inserting into a nozzle loading slot 216 of the discharging member body. The discharging member 215 has central injecting hole 202*a* and three outer injecting hole 202*b* formed on outer periphery of the central injecting hole 202*a* at even intervals. The central injecting hole 202*a* is circular and formed at the center of the nozzle, and is communicated with passage 203*a* of the discharging member. The groove 217 is formed at the inner surface of the nozzle loading slot 216 in axial direction and the groove 217 is communicated with passage 203*b* of the discharging member. The slit between the groove 217 and the nozzle 202 forms the outer injecting holes 202*b*. The number of the outer injecting holes are not limited and maybe formed within from 2 to 10 holes. Thus, the discharged contents discharged from the discharging member 215 forms a stripe. The contents with high viscosity are preferable for aerosol product with the discharging member 215. Therefore, the contents discharged with stripe may be mixed by other force such as by hand. Further, for the contents A and B, the gel state (gelatinous) content and the mousse state content maybe used. And by connecting the container of the present invention with the discharging member 215, so as to make the gel state content injects from injecting hole 202*a* through passage 203*a* of the discharging member and the mousse state content injects from injecting hole 202*b* through passage 203*b* of the discharging member, the discharging contents of the gel state contents wrapped by the mousse state contents may be obtained.

Figure 39:
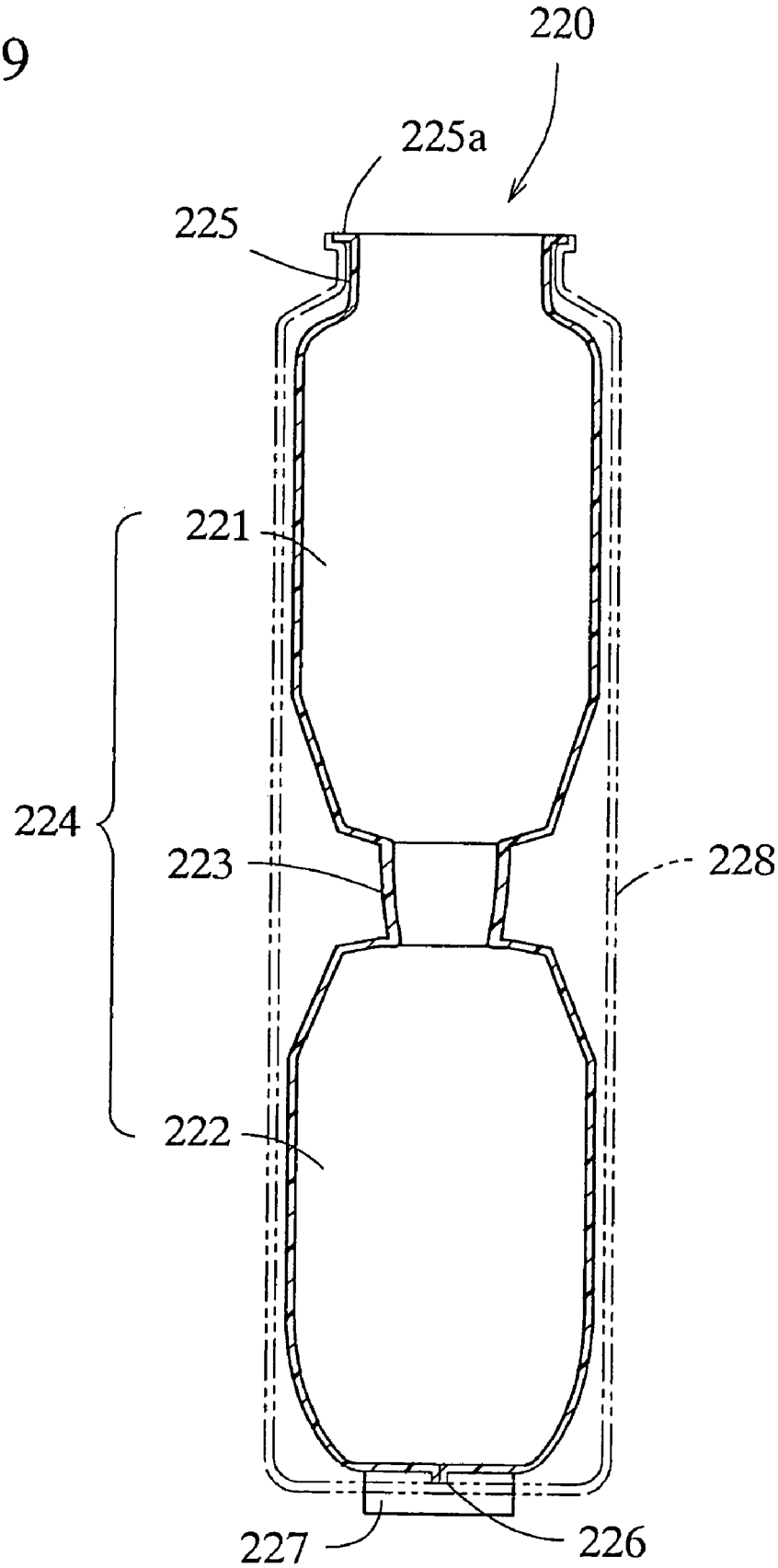
FIG. 39 is a front cross sectional view of the yet other embodiment of the inner bag used in the container.

Here, the preferable figure of the inner bag to charge two kinds of the contents are disclosed in FIG. 39.

The inner bag 220 is cylindrical with bottom and has body 224 having an upper chamber 221, lower chamber 222, and constriction part 223 between the upper and lower chambers; neck part 225 formed on the top of the body in which the flange 225*a* is formed on the upper end; and a bottom part 226 that closes the lower end of the body.

The constriction part has a diameter smaller than the body and the upper chamber 221 and the lower chamber 222 are formed in tapered shape toward the constriction part. Therefore the residual of the contents may be minimized, because the upper and the lower chamber 221, 222 deflates easy along with the discharging of the content. Further, the lower part of the lower chamber 222 is tapered toward the bottom 226 as the bottom area may decrease. This will ease the insertion of the inner bag into container body.

Further, thickness of the constriction part is formed thicker than the other part of the inner bag. This will increase the strength of the constriction part. So, when the partitioning member is inserted into the constriction part, the constriction part will closely engage with the partitioning member and avoid the omission of the partitioning member from constriction part.

The inner bag 220 is manufactured by blow forming method using the tubular synthetic resin and the bottom is formed by pasting the inside surface of the tube. So the continuous production can be achieved, thus increase the working efficiency. However, when the contents generate a gas or include gas, the gas may percolate through the joint surface of the bottom. Either a resin sheet may be adhered or a gas absorbent coat 227 made of gas absorbent may be equipped under the bottom 226 for preventing the percolation of the gas. Especially when the gas is an alkalinity gas such as ammonia gas or an oxidizing gas such as oxygen gas, the corrosion of the metal container body may be prevented due to the percolated gas. Further as shown in imaginary line, a cylindrical gas absorbent bag that is accommodated in the container body and accommodate whole inner bag 220 may be attached between the container body and the valve.

In the inner bag mentioned above, because plural of different contents are charged, the inner bag must be stable against all contents. The word "stable" means in the above is that the dispenser as a whole is stable and that the inner bag is anticorrosion against the contents and prevents the percolation of the gas generated from the contents such as decomposition.

In such an inner bag, for example, materials stable against the contents charged in each chamber laminated on the each chamber respectively maybe mentioned. More, the material stable against the content charged in one of the chamber is laminated as a film on the outer surface or the inner surface of the other chamber of the inner bag made of material stable against the content charged in the other chamber maybe used. Further, the inner bag that is provided with the upper chamber member 85*a* and the lower chamber member 85*b*, like the inner bag 85 of FIG. 20*a*, and the each chamber members are formed with the material that is stable against the contents that are to be charged maybe used.

Figure 40:
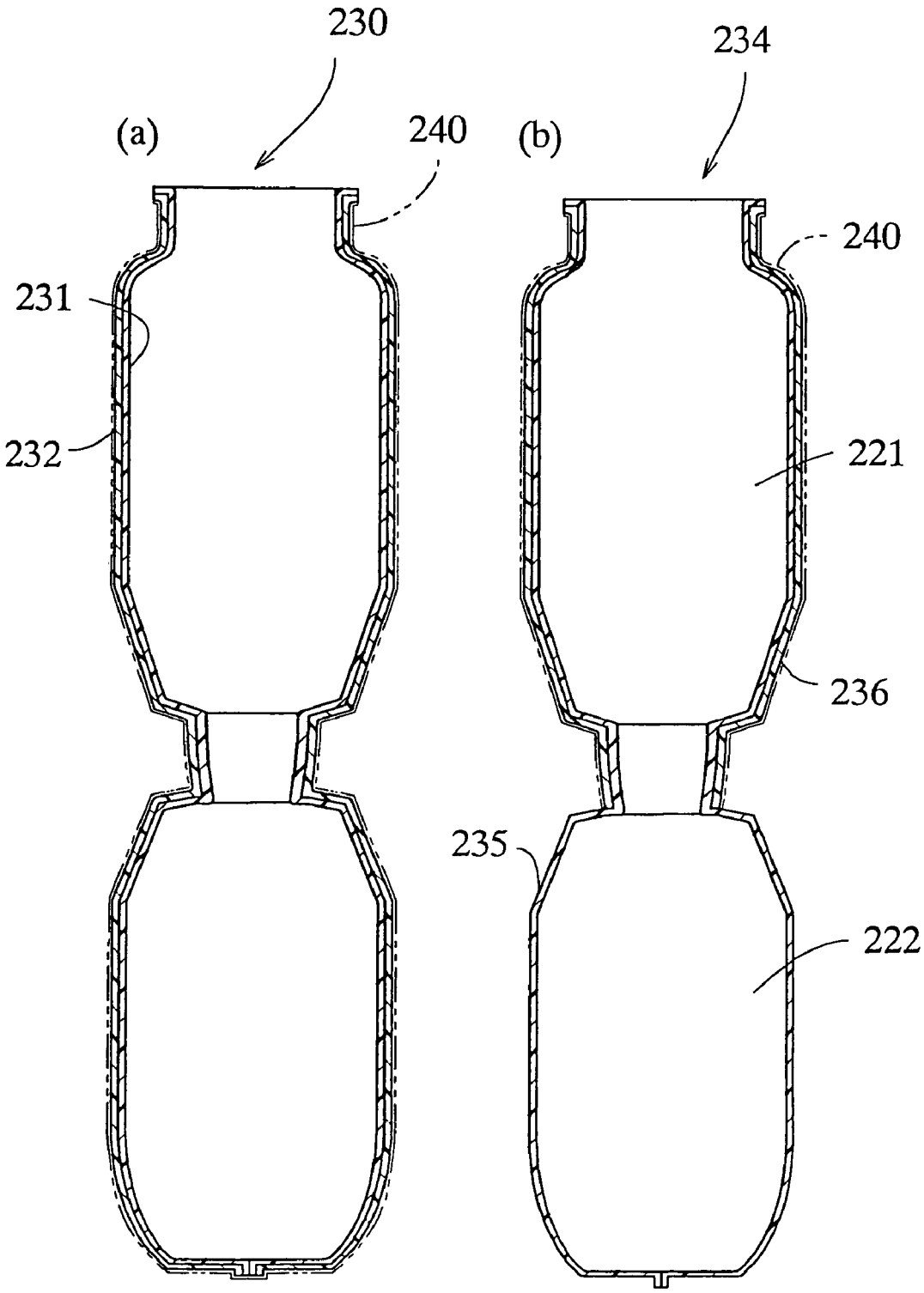
FIG. 40*a* and FIG. 40*b* are a front cross sectional view of the yet other embodiment of the inner bag used in the container.

For example, the two layer structure inner bag 230, shown in FIG. 40*a*, may be used in the aerosol product comprising the inner bag having the upper and lower chamber, and the upper chamber is charged with alkalinity contents and the lower chamber is charged with oxidizing contents. The inner bag 230 is provided with the inner layer 231 (alkali proof layer) made of high alkali proof material, and the outer layer 232 (acid proof layer) made of high acid proof material laminated on outside surface of the inner layer. The material of the inner and outer layer may be reversed. This structure will prevent the inner bag from blasting due to the corrosion of the inner bag against the contents. Further, the corrosion of the container body due to the percolation of the acid component or the alkaline component may be prevented. Also deterioration of the content due to the percolation of the contents of the other chamber may be prevented.

The inner bag 234 of FIG. 40*b* may be used. The inner bag 234 has a film 236 made of high alkali proof material laminated on the outer surface of the upper chamber 221 of the inner bag body 235 in which is made of high acid proof material. The film 226 is laminated on the outer surface of the lower chamber 222, when the alkaline content is charged into the lower chamber. The film may be laminated during the manufacturing process of the inner bag or the film may be covered to the inner bag by pasting or by heat contraction.

As the material with high acid proof, polyester such as polyethylene terephthalate, polylefins such as polythene and polypropylene, and polyvinylidene chloride may be mentioned. As the material with high alkali proof, polyamide such as Nylon 6 and MXD-6, polyphenylen sulfides may be mentioned.

Further, gas barrier layer 240 may be laminated on the chamber that contains contents generates gas like shown in imaginary line on the chamber of the inner bag 230, 234. For example, as the material suitable to prevent the percolation of the ammonia gas generated from the alkaline liquid containing ammonia or oxygen gas generated from the acid liquid containing hydrogen peroxide, ethylene-vinylalcohol copolymers and polyvinylidence chlorides may be mentioned. The gas barrier maybe formed by providing gas barrier layer between the acid proof layer and the alkali proof layer to form three layer structure, or by providing the gas barrier layer on the both side of the laminated layer of the acid proof layer and alkali proof layer to form four layer structure, or by providing the gas barrier layer on both side of the three structure layer of the above to form five layer structure. Further, silica or aluminum may be distributed on the otter surface of the inner bag by deposition to further improve the quality of the gas barrier. Especially, when the silica is distributed the resistance against the acid and the alkaline also improves.

Therefore, the inner bag with gas barrier can prevent the percolation of the ammonia with time and prevent the degradation of the ammonia concentration. As a result, the degradation and decomposition of the component that is composed with the ammonia and is stabilized by the ammonia may be prevented. Further, the degradation and decomposition of the contents that are charged in other chamber may be prevented.

The dispenser of this invention maybe used as aerosol product that discharge hair dye, enzyme hair dye, hair dress agent or setting agent for hair, hair growth agent or hair restorers, reduction of inflammation pain killer, anti-heat flushes, coolants, pack agents, cleansing agents, shaving foams, moisturizers, antipersipirants, vitamin preparations, emollients and etc.

EXAMPLES

The dispenser of this invention is described with the examples. Table 1 and Table 2 show contents of the first agent and the second agent charged in the upper and the lower chamber used for the examples respectively.

Example 1

Two-liquid reaction type hair dyes agent shown in Table 1 and Table 2 were used as contents. The contents were charged in a container 75*a* shown in FIG. 12*c* and a dispenser product for hair dye was obtained. The aluminum was used for the container body and PE (polyethylene)/EvOH (polyethylene-vinyl alcohol copolymer)/PE was used for the inner bag. As a manufacturing process, the first agent (gelatinous dye agent), shown in Table 1, was charged into the lower chamber 26 of the inner bag, the partitioning member 72*b* shown in FIG. 13*a* and the dip tube 28 was inserted into the constriction part of the inner bag to isolate the lower chamber 26 from the upper chamber 27. And then, the second agent (gelatinous oxidizing agent), shown in Table 2, was charged into the upper chamber 27. After that, the valve was mounted so as to charge nitrogen gas as a propellant through the gap between the opening of the container and the opening of the inner bag, and the valve was fixed to the bead part of the container by crimping. The structure shown in FIG. 3*d* was used as a valve.

TABLE 1

| The first agent | weight (%) |
|---|---|
| Para phenylenediamine | 1.0% |
| Resorcin | 0.5% |
| Meta-phenylenediamine | 0.2% |
| Para-aminophenol | 0.5% |
| Propylene glycol | 5.0% |
| Cetyl alcohol | 2.0% |
| Polyoxyethylene (20) cetyl ether | 2.0% |
| Hydroxyethyl cellulose | small amount |
| Aroma chemical | small amount |
| 28% ammonia water (Fixing the agent into pH 10.0) | adequate quantity |
| Purified water | rest |
| Total | 100% |

TABLE 2

| The second agent | Weight (%) |
|---|---|
| 35% hydrogen peroxide solution | 15% |
| Cetyl alcohol | 2.0% |
| Propylene glycol | 3.0% |
| Methyl polysiloxane | 0.5% |
| Polyoxyethylene (20) cetyl ether | 2.0% |
| Hydroxyethyl cellulose | small amount |
| Edetic acid | 0.2% |
| Purified water | rest |
| Total | 100.0 |

Example 2

Two-liquid reaction type hair dyes agent shown in Table 1 and Table 2 were used as contents, the contents were charged in a container 60 shown in FIG. 10, and a dispenser product for hair dye was obtained. The aluminum was used for the container body and PE/EvOH/PE was used for the inner bag. The first agent was charged, then the partitioning member 72*b* and dip tube 28 were inserted into the constriction part of the inner bag 12 of FIG. 13*a* to isolate the lower chamber from the upper chamber using the same process as example 1. The second agent was charged, the valve was mounted, and the nitrogen gas was charged as a propellant from the gap between the container 11 and the inner bag 12, the valve was fixed by caulking the mounting cup 45 to the concave groove 61. The valve shown in FIG. 3*b* was used as the valve.

Example 3

Two-liquid reaction type hair dyes agent shown in Table 1 and Table 2 were used as contents, the contents were charged in a container 90 shown in FIG. 23, and a dispenser product for hair dye was obtained. The transparent polyethylene terephthalate was used for the container body and three layer sheet PE/EvOH/PE was used for the inner bag. The first agent, the second agent, and the propellant (nitrogen gas) were charged using the same process as the example 1 and example 2. The cylindrical housing having projection protruding in radial direction at the upper end was inserted between the opening of the container and the mounting cup covering the opening of the container. The valve 93 was fixed by caulking the mounting cup to the concave groove 91*a*. The gas absorbent was provided between the upper chamber and the lower chamber of the inner bag.

Example 4

Two-liquid reaction type hair dyes agent shown in Table 1 and Table 2 were used as contents, the contents were charged in a container 190*b* shown in FIG. 33*b*, and a dispenser product for hair dye was obtained. The aluminum was used for the container body and PE/NY (nylon)/PE was used for the inner bag. As a manufacturing process, the second agent, shown in Table 2, was charged into the lower chamber 26 of the inner bag, the partitioning member 72*e* and dip tube 28 were inserted into the constriction part of the inner bag of FIG. 33 to isolate the lower chamber from the upper chamber. Then the first agent, shown in Table 1, was charged into the upper chamber 27 of the inner bag. The valve was mounted, the nitrogen gas was charged as a propellant through the gap between the opening of the container body and the opening of the inner bag, the valve was crimped to the bead part of the container body. The structure of the valve shown in FIG. 7 was used as the valve.

Example 5

Two-liquid reaction type exothermic foaming agent shown in Table 3 and Table 4 were used as contents, the contents were charged in a container 190*a* shown in FIG. 1, and a dispenser product for cleansing was obtained. The aluminum was used for the container body and PE/EvOH/PE was used for the inner bag.

50 grams of the first agent (paste form exothermic foaming agent), shown in Table 3, was charged into the lower chamber 26 of the container, the partitioning member 72 equipped with the dip tube 28 was engaged to the constriction part 71 of the inner bag shown in FIG. 1 to isolate the lower chamber from the upper chamber. In this state the upper end of the dip tube 28 is located at a position higher than the opening of the inner bag. Then, 50 gram of the second agent (gelatinous hydrophilic agent), shown in Table 4, was charged into the upper chamber 27. The valve 13 having the structure of the valve of FIG. 6 was placed so as to contact the engaging member 74 to the top of the dip tube 28, and the dip tube 28 was engaged to the dip tube engaging member 55. Further, the valve was pushed downward to have dip tube 28 slides with the partitioning member 72, and the mounting cup of the valve 13 was tentatively fixed to the opening of the inner bag. The nitrogen gas was charged as a propellant through the gap getween the opening of the container body and the opening of the inner bag, the valve was crimped to the bead part of the container body. The inner pressure of the container was 0.8 Pa.

TABLE 3

| The first agent | Weight(%) |
|---|---|
| Liquid paraffin | 52.0 |
| Diglycerine monooleate | 2.0 |
| Sorbitan sesquioleate | 2.0 |
| Silicic acid anhydride | 4.0 |
| Sodium hydrogen carbonate | 10.0 |
| Citric acid | 10.0 |
| Anhydrous magnesium chloride | 20.0 |
| Total | 100.0 |

TABLE 4

| The second agent | Weight(%) |
|---|---|
| Concentrated glycerin | 73.0 |
| Polyethylene glycol | 4.0 |
| Carboxy vinyl polymer | 3.0 |
| Purified water | 20.0 |
| Total | 100.0 |

The obtained dispenser product was operated to dispense the contents. The sodium hydrogen carbonate and the citric acid dispersed in the first agent were dissolved in the water contained in the second agent when the contents were mixed with finger, and generate carbon dioxide gas due to the decomposition of the sodium hydrogen carbonate. Further, the anhydrous magnesium chloride dispersed in the first agent was dissolved in the water contained in the second agent, and generated heat. These reactions shaped the dispensed substance into mild and warm foam. When this formed substance was applied to a make up skin, the form prompted the make to float and gave the heat to the skin, and thus enabled to remove the make up easily.

Example 6

Two-liquid reaction type exothermic agent shown in Table 5 and Table 6 were used as contents, the contents were charged in a container 190 shown in FIG. 14, and a dispenser product for hair waxing was obtained. The aluminum was used for the container body ha and PE/EvOH/PE was used for the inner bag.

20 gram of the first agent (paste form exothermic agent), shown in Table 5, was charged into the lower chamber 26 of the container, the partitioning member 72 equipped with the dip tube 28 was engaged to the constriction part of the inner bag 12 shown in FIG. 14 to isolate the lower chamber from the upper chamber. In this state the upper end of the dip tube 28 is located at a position higher than the opening of the inner bag 12. Then, 20 gram of the second agent (gelatinous hydrophilic agent), shown in Table 6, was charged into the upper chamber 27. The valve 13 having the structure of the valve of FIG. 5 was placed so as to contact the engaging member 74 to the top of the dip tube, and the dip tube 28 was engaged to the dip tube engaging member 55. Further, the valve 13 was pushed downward to have dip tube 28 slides with the partitioning member 72, and the mounting cup of the valve 13 was tentatively fixed to the opening of the inner bag 12. The nitrogen gas was charged as a propellant through the gap of the opening of the container body 11*a* and the opening of the inner bag 12, the valve was crimped to the bead part of the container body. The inner pressure of the container was 0.8 Pa.

TABLE 5

| The first agent | Weight(%) |
|---|---|
| POE (21) lauryl ether | 56.0 |
| Liquid paraffin | 14.0 |
| Oleyl alcohol | 6.0 |
| Olive oil | 4.0 |
| Anhydrous magnesium chloride | 20.0 |
| Total | 100.0 |

TABLE 6

| The second agent | Weight(%) |
|---|---|
| Glycerin | 6.0 |
| Xanthine gum | 4.0 |
| Methyl parahydroxybenzoate | 0.2 |
| Purified water | 89.8 |
| Total | 100.0 |

The obtained dispenser product was operated to dispense the contents. The anhydrous magnesium chloride dispersed in the first agent was dissolved in the water in the second agent to generate heat when the contents were mixed by finger. When this dispensed substance was applied to hair, the hair became supple and catered to needs of easy styling.

Example 7

Two-liquid reaction type foaming agent shown in Table 7 and Table 8 were used as contents, the contents were charged in a container 190*a* shown in FIG. 1, and a dispenser product for hair growth was obtained. The aluminum was used for the container body 11 and PE/EvOH/PE was used for the inner bag 12.

The first agent (paste form foaming agent), shown in Table 7, was charged into the lower chamber 26 of the container, the partitioning member 72 equipped with the dip tube 28 was engaged to the constriction part 71 of the inner bag shown in FIG. 1 to isolate the lower chamber from the upper chamber. In this state the upper end of the dip tube 28 is located at a position higher than the opening of the inner bag 12. Then, the second agent (gelatinous hydrophilic agent), shown in Table 8, was charged into the upper chamber 27. The valve 13 having the structure of the valve of FIG. 6 was placed so as to contact the engaging member 74 to the top of the dip tube, and the dip tube 28 was engaged to the dip tube engaging member 55. Further, the valve 13 was pushed downward to have dip tube 28 slides with the partitioning member 72, and the mounting cup of the valve 13 was tentatively fixed to the opening of the inner bag 12. The nitrogen gas was charged as a propellant through the gap between the opening of the container body 11*a* and the opening of the inner bag 12, the valve was crimped to the bead part of the container body. The inner pressure of the container is 0.8 Pa.

TABLE 7

| The first agent | Weight(%) |
|---|---|
| Diglycerine monooleate | 1.0 |
| Sorbitan sesquioleate | 1.0 |
| Silicic acid anhydride | 5.0 |
| Liquid paraffin | 67.8 |
| Sodium hydrogen carbonate | 25.2 |
| Total | 100.0 |

TABLE 8

| The second agent | Weight(%) |
|---|---|
| Sialid extract | 3.0 |
| Extract of ginseng | 2.0 |
| Citric acid | 28.8 |
| Hydroxypropylcellulose | 1.0 |
| 70% ethanol water solution | 65.2 |
| Total | 100.0 |

The obtained dispenser product was operated to dispense the contents. The sodium hydrogen carbonate dispersed in the first agent was dissolved in the water in the second agent when the contents were mixed with the finger and decomposed through reaction on citric acid to generate carbon dioxide gas. The dispensed substance was frothed into foam by the generated carbon dioxide gas. When this dispensed substance was applied to head, the facilitative effect in the blood circulation due to the generated carbon dioxide gas was obtained. And since it was being formed, the active ingredient was effectively given to the head due to its resistivity against falling in drops from the head.

Example 8

Two-liquid reaction type exothermic agent shown in Table 9 and Table 10 were used as contents, the contents were charged in a container shown in FIG. 33, and a dispenser product for hand cream was obtained. The aluminum was used for the container body 11 and PE/EvOH/PE was used for the inner bag 12.

50 gram of the first agent (paste form oil based agent), shown in Table 9, was charged into the lower chamber of the container, the partitioning member 72*e* equipped with the dip tube was engaged to the constriction part of the inner bag shown in FIG. 33 to isolate the lower chamber from the upper chamber. In this state the upper end of the dip tube is located at a position higher than the opening of the inner bag. Then, 50 gram of the second agent (oil-based creamy agent), shown in Table 10, was charged into the upper chamber. The valve having the structure of the valve of FIG. 5 was placed so as to contact the engaging member to the top of the dip tube, and the dip tube was engaged to the dip tube engaging member. Further, the valve was pushed downward to have dip tube slides with the partitioning member, and the mounting cup of the valve was tentatively fixed to the opening of the inner bag. The nitrogen gas was charged as a propellant through the gap of the opening of the container body 11*a* and the opening of the inner bag 12, the valve was crimped to the bead part of the container body. Further, the stem of the valve was pushed downward to have the air in both chamber evacuated. The inner pressure of the container was 0.7 Pa.

TABLE 9

| The first agent | Weight(%) |
|---|---|
| Liquid paraffin | 65.8 |
| Triolein acid POE (20) sorbitan | 5.0 |
| Dextrin palmitate | 4.0 |
| Anhydrous magnesium chloride | 25.0 |
| Red palm olein | 0.2 |
| Total | 100.0 |

TABLE 10

| The second agent | Weight(%) |
|---|---|
| Stearic acid | 7.0 |
| Cetyl alcohol | 2.0 |
| Self-emulsifiable glyceryl monostearate | 1.0 |
| N-acyl-L-monosodium glutaminate | 1.0 |
| Sodium hydrate (1% aq) | 8.4 |
| Sorbital liquid | 3.0 |
| Concentrated glycerin | 3.0 |
| Methyl parahydroxybenzonate | 0.2 |
| Propyl parahydroxybenzonate | 0.1 |
| Gardenia coloring matter | 0.1 |
| Octenyl succinic acid amylum maydis ester aluminum | 10.0 |
| Purified water | 64.2 |
| Total | 100.0 |

The obtained dispenser product was operated to dispense the contents. The anhydrous magnesium chloride dispersed in the first agent was dissolved in the water in the second agent to generate heat when the contents were mixed on the palm. When this dispensed substance was applied to hand, it gave warm feeling to the hand and the cream was well spread.

Example 9

Two-liquid reaction type exothermic agent shown in Table 11 and Table 12 were used as contents, the contents were charged in a container shown in FIG. 33, and a dispenser product for hair pack was obtained. The aluminum was used for the container body 11 and PE/EvOH/PE was used for the inner bag.

In addition, 50 gram of the first agent (paste form water based agent), shown in Table 11, was charged into the lower chamber of the container, and 50 gram of the second agent (paste form oil based agent), shown in Table 12, was charged into the upper chamber of the container. Other manufacturing processes were same with the example 8.

TABLE 11

| The first agent | Weight(%) |
|---|---|
| Jojoba oil | 16.0 |
| Sucrose tetra isostearate | 4.0 |
| POE (7) oleyl ether | 20.0 |
| Behentrimonium methosulfate, Auaternium-33, Cetyl alcohol | 1.6 |
| Aroma chemical | 0.3 |
| Methyl parahydroxybenzonate | 0.1 |
| Octenyl succinic acid amylum maydis ester aluminum | 20.0 |
| Purified water | 38.0 |
| Total | 100.0 |

TABLE 12

| The second agent | Weight(%) |
|---|---|
| Liquid paraffin | 65.8 |
| Triolein acid POE (20) sorbitan | 5.0 |
| Dextrin palmitate | 4.0 |
| Anhydrous magnesium chloride | 25.0 |
| Red palm olein | 02. |
| Total | 100.0 |

The obtained dispenser product was operated to dispense the contents. The anhydrous magnesium chloride dispersed in the first agent was dissolved in the water in the second agent to generate heat when the contents were mixed on the palm. When this dispensed substance was applied to hair, it made hair more ductile by ingredients for conditioning and by thermal effect.

Example 10

Two-liquid type agent shown in Table 13 and Table 14 were used as contents, the contents were charged in a container shown in FIG. 33, and a dispenser product for hair pack was obtained. The aluminum was used for the container body 11 and PE/EvOH/PE was used for the inner bag 12.

In addition, 50 gram of the first agent (oil based creamy agent), shown in Table 13, was charged into the lower chamber of the container, and 50 gram of the second agent (water based creamy agent), shown in Table 14, was charged into the upper chamber of the container. Other manufacturing processes were same with the example 8.

TABLE 13

| The first agent | Weight(%) |
|---|---|
| Stearic acid | 7.0 |
| Cetyl alcohol | 2.0 |
| Self-emulsifiable glyceryl monostearate | 1.0 |
| N-acyl-L-monosodium glutaminate | 1.0 |
| Sodium hydrate (1% aq) | 8.4 |
| Sorbitol liquid | 3.0 |
| Concentrate glycerin | 3.0 |
| Methyl parahydroxybenzonate | 0.2 |
| Propyl parahydroxybenzonate | 0.1 |
| Gafdenia coloring matter | 0.1 |
| Octenyl succinic acid amylum maydis ester aluminum | 10.0 |
| Purified water | 64.2 |
| Total | 100.0 |

TABLE 14

| The second agent | Weight(%) |
|---|---|
| PEG-20 sorbitan cocoate | 5.0 |
| Octenyl succinic acid amylum maydis ester aluminum | 10.0 |
| SALCARE SC96 | 18.0 |
| Dextrin palmitate | 4.0 |
| Redpalm olein | 0.2 |
| Liquid paraffin | 62.8 |
| Total | 100.0 |

The obtained dispenser product was operated to dispense the contents. The viscosity of the creamy first agent and the second agent was increased when the contents were mixed on the palm, and it became wax like. When this dispensed substance was applied to hair, it enabled styling of the hair.

Example 11

Two-liquid reaction type alterant agent shown in Table 15 and Table 16 were used as contents, the contents were charged in a container shown in FIG. 33, and a dispenser product for gelatinous alterant was obtained. The aluminum was used for the container body and PE/EvOH/PE was used for the inner bag.

In addition, 50 gram of the first agent (gelatinous acidic water based agent), shown in Table 15, was charged into the lower chamber of the container, and 50 gram of the second agent (gelatinous alkaline oil-based agent), shown in Table 16, was charged into the upper chamber of the container. Other manufacturing processes were same with the example 8.

TABLE 15

| The first agent | Weight(%) |
|---|---|
| Mallow blue | 4.3 |
| 99% ethanol | 32.7 |
| Purified water | 49.0 |
| STRUCTURE PLUS | 10.0 |
| Lactic acid | 2.0 |
| SALCARE SC96 | 2.0 |
| Total | 100.0 |

TABLE 16

| The second agent | Weight(%) |
|---|---|
| Liquid paraffin | 60.22 |
| Sorbitan Trioleat POE (20) | 3.53 |
| Dextrin palmitate | 4.25 |
| SALCARE SC96 | 6.8 |
| Red palm olein | 0.2 |
| Triethanolamine | 15.0 |
| Zeolite | 10.0 |
| Total | 100.0 |

The obtained dispenser product was operated to dispense the contents. When the contents were mixed on the palm, the blue gel (first agent) and the pink gel (second agent) changed their color into green.

Example 12

Two-liquid reaction type exothermic agent shown in Table 17 and Table 18 were used as contents, the contents were charged in a container shown in FIG. 33, and a dispenser product for cleansing was obtained. The aluminum was used for the container body and PE/EvOH/PE was used for the inner bag.

In addition, 50 gram of the first agent (paste form water based agent), shown in Table 17, was charged into the lower chamber of the container, and 50 gram of the second agent (water based creamy agent), shown in Table 18, was charged into the upper chamber of the container. Other manufacturing processes were same with the example 8.

TABLE 17

| The first agent | Weight(%) |
|---|---|
| Concentrated glycerin | 65.0 |
| Benzine alcohol | 3.0 |
| Benton | 1.0 |

TABLE 17-continued

| The first agent | Weight(%) |
|---|---|
| Propylene glycol | 1.0 |
| Zeolite | 30.0 |
| Total | 100.0 |

TABLE 18

| The second agent | Weight(%) |
|---|---|
| Liquid paraffin | 76.0 |
| Diglycerine monooleate | 2.0 |
| Sorbitan sesquioleate | 2.0 |
| Sylopure | 10.0 |
| Purified water | 10.0 |
| Total | 100.0 |

The obtained dispenser product was operated to dispense the contents. The zeolite dispersed in the first agent was dissolved in the water in the second agent to generate heat when the contents were mixed on the palm. When this dispensed substance was applied to skin, it gave warm feeling to the skin and the make up on the skin was easily removed.

Example 13

Two-liquid mixture type agent shown in Table 19 and Table 20 were used as contents, the contents were charged in a container shown in FIG. 34, and a dispenser product for skin care was obtained. The aluminum was used for the container body and PE/EvOH/PE was used for the inner bag.

The air in the space between the container body and the inner bag was evacuated by vacuuming, then the nitrogen gas was charged into the space. The valve was fixed to the opening of the container body to close the opening of the inner bag. Next, the stem of the valve was lowered so as to evacuate the air of the upper and lower chambers. Further, 12 gram of the first agent (Oil based liquefied agent), shown in Table 19, was charged through the passage that communicate with the lower chamber with only opening the passage communicating the lower chamber and the atmosphere. Then 48 gram of the second agent (water in oil type creamy agent), shown in the Table 20, was charged through the other passage that communicates with the upper chamber. The inner pressure of the container was 0.8 Pa.

TABLE 19

| The first agent | Weight(%) |
|---|---|
| Retinol | 0.125 |
| Tocopheryl Acetate | 0.125 |
| Dibutyl hydroxy toluene | 0.05 |
| Caprylic/Capric Acid Triglyceride | 5.6 |
| Squalane | 60.0 |
| Octyldodecyl Myristate | 30.0 |
| Dextrin palmitate | 4.0 |
| Propyl paraben | 1.0 |
| Total | 100.0 |

TABLE 20

| The second agent | Weight(%) |
|---|---|
| Stearic acid | 7.0 |
| Cetyl alcohol | 2.0 |
| Diglycerin stearate (SE) | 1.0 |
| N-acyl-L-monosodium glutaminate | 1.0 |
| Sodium hydorate | 0.825 |
| Sorbitol | 3.0 |
| Glycerin | 3.0 |
| Methyl paraben | 0.2 |
| Propyl paraben | 1.1 |
| Purified water | 81.615 |
| Total | 100.0 |

The obtained dispenser product was able to preserve without effective ingredient (retinol) contacting with water and to mix the contents at desirable time. Therefore, the effect of the retinal was kept for a long period time without deteriorating.

Comparative Example 1

As a container, the container shown in FIG. 12*c* having a publicly known bottomed tubular inner bag in place of the plural chambers was used. The first agent shown in Table 1 was charged in the inner bag and the second agent shown in Table 2 was charged. Further, as a propellant, nitrogen gas was charged through the gap between the opening and the opening of the inner bag, the valve being fixed to the opening of the container. This was regarded to be the comparative example 1. The container was made of aluminum and the inner bag was made of PE/EvOH/PE.

Comparative Example 2

As a container, the inner bag without plural chambers was used for the container shown in FIG. 23. By the similar procedure with the comparative example 1, the first agent and the second agent were charged and then the propellant was charged in the container, the valve was fixed to the opening of the container. This was regarded to be the comparative example 2. For the container, polyethylene terephthalate was used. For the inner bag, PE/EvOH/PE was used.

The dispensers of example 1 to 3 and comparative example 1, 2 were stored for a given period (one month, three months, six months) and an inner pressure of stored products, conditions of the stored products, performance tests were carried out.

Measurements of the product pressure were carried out with the products stored at 45° C. for a given month and adjusted to 25° C. by storing in a tropical aquarium of 25° C. for one hour. The results are shown in Table 21.

The contents of the stored products were observed visually to know the conditions of the products. The results are shown in Table 22.

For the performance test, the contents were dispensed over a bundle of hair (human hair, black, 10 Cm long) and a coloring process was carried out. The finish of the dispenser products in which had not been stored were used as a standard for evaluation of the coloring-processed bundle of the hair. The results are shown in Table 23.

TABLE 21

| Product Pressure (MPa) | Before Test | One Month | Three Month | Four Month |
|---|---|---|---|---|
| Example 1 | 0.60 | 0.62 | 0.65 | 0.67 |
| Example 2 | 0.60 | 0.63 | 0.66 | 0.68 |
| Example 3 | 0.60 | 0.61 | 0.62 | 0.62 |
| Comparative Example 1 | 0.60 | 0.64 | 0.69 | 0.73 |
| Comparative Example 2 | 0.60 | 0.61 | 0.64 | 0.68 |

TABLE 22

| Condition of Storage | One Month | Three Month | Four Month |
|---|---|---|---|
| Example 1 | ◎ | ◎ | ○ |
| Comparative example 1 | Δ | X | X |

◎: No color change was observed in both of the first agent and second agent near the partitioning.
○: A slight color change was observed in both of the first agent and second agent near the partitioning.
Δ: Color change was observed in both of the first agent and second agent near the partitioning.
X: Color Change was observed also in other parts than the first agent and second agent near the partitioning.

TABLE 23

| Performance Test | One Month | Three Month | Four Month |
|---|---|---|---|
| Example 1 | ◎ | ◎ | ○ |
| Example 2 | ◎ | ◎ | ○ |
| Example 3 | ◎ | ◎ | ○ |
| Example 4 | ◎ | ◎ | ◎ |
| Comparative example 1 | Δ | X | X |
| Comparative example 2 | Δ | X | X |

◎: No remarkable difference observed in the color of the hair bundle.
○: A slight deterioration observed in the hair bundle processed after storage. But it is not a cause for concern.
Δ: Deterioration was observed in the hair bundle processed after storage.
X: Remarkable deterioration was observed in the hair bundle processed after storage.

It was concluded from these results that in the example 1 to 4 of the dispenser product of this invention no remarkable abnormality was observed in the containers and the contents.

What is claimed is:

1. A container for dispensing plural contents comprising, an outer container, a collapsible inner bag having upper and lower chambers provided vertically and a constriction provided between said upper and lower chambers, said inner bag inserted in the outer container, a plurality of passages which communicates said upper and lower chambers with an atmosphere, a partition member engaged within the constriction to isolate the lower chamber from the upper chamber, except for the passage which communicates the lower chamber with the atmosphere, a dispensing valve releasing the passages simultaneously, a discharging member activating the valve, wherein the inner bag is substantially one bag divided into said upper and lower chambers by the partition member, and each chamber has at least a collapsible part.

2. A container according to claim 1, wherein the plurality of passages allows a flowing of the contents and at least one of the passages has a means to stop the flowing when the valve is closed.

3. A container according to claim 1, wherein an opening of at least one of the chambers is closed by the valve.

4. A container according to claim 1, wherein in the plurality of passages, each independently communicates each chamber with the atmosphere.

5. A container according to claim 1, further comprising a gas absorbent provided on outer surface of the inner bag and/or inside of the outer container.

6. A dispenser comprising; the container described in claim 1, contents of two or more different kinds, and a means for pressurizing the inner bag to discharge the contents, wherein each chamber is filled with one kind of content.

7. A dispenser according to claim 6, wherein the container has two chambers and each chamber is filled with different kinds of contents.

8. A dispenser according to claim 6, wherein the contents contain reactive components, which react and display an effect when the contents are contacted or mixed with each other.

9. A dispenser according to claim 8, wherein the reaction of the reactive components is any one of the reactions selected from the group consisting neutralization, hydration, redox-reaction, ion-exchange reaction, dissolution, and decomposition.

10. A dispenser according to claim 7, wherein a capacity ratio of the chambers is from 1:5 to 5:1 and the contents charged in the chambers are discharged in the same ratio as the capacity ratio.

11. A dispenser according to claim 10, wherein the content charged in one of the chamber is a first agent of hair-dye containing oxidation dye and the content charged in the other chamber is a second agent of hair-dye containing oxidant.

12. A dispenser according to claim 11, wherein the inner bag has upper and lower chamber, the inner bag is formed by blow forming using synthetic resin with laminated structure having gas-absorbance layer or gas-barrier layer, the first agent of hair-dye contains amines, and the first agent is charged in the upper chamber and the second agent is charged in the lower chamber.

13. A dispenser according to claim 11, further comprising a means to check the residual amount of the contents.

14. A container according to claim 1, wherein the partition member is easily closable.

15. A container according to claim 14, wherein the outer container has an opening, and the constriction is of a size smaller than the opening formed at its midway.

16. A container according to claim 14, wherein a part of the passage from the lower chamber to the valve is a tube and penetrates the upper chamber.

17. A container according to claim 16, wherein the valve has a valve housing and at least a part of the tube is placed as to be movable up and down against the valve housing and/or the partition member.

18. A process for producing dispenser having a container described in claim 1, different kinds of contents and a propellant charged in the outer container, comprising a steps of, placing the inner bag into the outer container, charging the contents into the chambers after fixing the valve to the outer container charging the propellant into a space between the outer container and the inner bag anytime after inserting the inner bag into the outer container.

19. A process for producing dispenser having a container described in claim 5, different kinds of contents and a propellant charged in the outer container, comprising a steps of, charging one content into one chamber, isolating one chamber from the other chamber, charging the other content into the other chamber, fixing the valve to the outer container, charging the propellant into a space between the inner bag and the outer container anytime before fixing the valve to the outer container.

20. A container according to claim 7, wherein the partition member has an engaging member and the tube is fitted to the engaging member.

* * * * *